US005403811A

United States Patent [19]

Mikoshiba et al.

[11] Patent Number: 5,403,811

[45] Date of Patent: Apr. 4, 1995

[54] THERMAL TRANSFER DYE DONATING MATERIALS

[75] Inventors: Hisashi Mikoshiba; Mitsugu Tanaka; Masakazu Morigaki; Seiiti Kubodera, all of Kanagawa, Japan

[73] Assignee: Fuji Photo Film Co., Ltd., Kanagawa, Japan

[21] Appl. No.: 105,946

[22] Filed: Aug. 13, 1993

Related U.S. Application Data

[60] Division of Ser. No. 871,082, Apr. 20, 1992, Pat. No. 5,262,377, which is a continuation-in-part of Ser. No. 599,785, Oct. 18, 1990, abandoned.

[30] Foreign Application Priority Data

Oct. 18, 1989 [JP] Japan ..... 1-271078

[51] Int. Cl.[6] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 4,833,123 | 5/1989 | Hashimoto et al. | 503/227 |
| 4,912,084 | 3/1990 | Kanto | 503/227 |

FOREIGN PATENT DOCUMENTS

| | | | |
|---|---|---|---|
| 0247737 | 12/1987 | European Pat. Off. | 503/227 |
| 0323259 | 7/1989 | European Pat. Off. | 503/227 |
| 2609937 | 7/1988 | France | 503/227 |
| 3524519 | 1/1986 | Germany | 503/227 |
| 1268494 | 11/1986 | Japan | 503/227 |
| 3182191 | 7/1988 | Japan | 503/227 |
| 2161824 | 1/1986 | United Kingdom | 503/227 |

OTHER PUBLICATIONS

Patent Abstracts of Japan, vol. 13, No. 36 (M-790) (3384), Jan. 26, 1989, "Anthraquinone Magenta Coloring Matter for Sublimation Transfer Type Thermal Recording" (63-246286(A)).

*Primary Examiner*—B. Hamilton Hess

*Attorney, Agent, or Firm*—Sughrue, Mion, Zinn, Macpeak & Seas

[57] ABSTRACT

A thermal transfer dye donating material comprising a support having thereon a dye donating layer which contains a thermo-mobile dye, wherein the thermo-mobile dye is a dye which can be represented by the general formula (I) indicated below.

$$A—(L—B)_q \qquad (I)$$

In this formula, A represents a dye residue which has an absorbance in the visible region and/or infrared region, L represents a divalent linking group or a simple bond, and B represents an atomic grouping which has the effect of suppressing the fading of the dye. Moreover, q is 1 or 2, and when q is 2, L and B may be the same or different.

3 Claims, No Drawings

THERMAL TRANSFER DYE DONATING MATERIALS

This is a divisional of application Ser. No. 07/871,082, filed Apr. 20, 1992, now U.S. Pat. No. 5,262,377, which is a continuation-in-part of application Ser. No. 07/599,785, filed Oct. 18, 1990, now abandoned.

FIELD OF THE INVENTION

This invention relates to thermal transfer dye donating materials in which thermo-mobile dyes are used, and more precisely it relates to thermal transfer dye donating materials (i.e., dye providing material) with which dye images which hardly cause to color fading can be formed.

BACKGROUND OF THE INVENTION

Various information processing systems have been developed with the rapid development of the information industry in recent years. In addition, methods of recording and recording equipment which are suitable for these information processing systems have been developed and put into use. Thermal transfer recording, which is one such recording method, involves the use of equipment which is light in weight and compact and which runs without noise, and which also has excellent operating and maintenance characteristics. Moreover, color recording can be achieved easily and the use of this type of equipment has become widespread in recent times.

The thermal transfer recording method includes systems in which a thermal transfer dye donating material comprising a thermo-fusible ink layer which is carried on a support is heated by means of a thermal head and the ink is fused and transferred to an image receiving material (fusion transfer systems) and systems in which a thermal transfer dye donating material which has a dye donating layer which contains a thermo-mobile dye and a binder is heated with a thermal head and recording is achieved by the thermal migration of just the dye to the image receiving layer of an image receiving material (thermo-mobile systems), generally referred to as sublimation type heat sensitive transfer systems.

This invention relates to thermal transfer dye donating materials which are used in the latter of the above mentioned thermal migration systems. Moreover, the thermo-mobile dyes referred to here are dyes which are transferred from a thermal transfer dye donating material to a thermal transfer image receiving material by sublimation or diffusion in a medium However, various limitations have arisen with the thermo-mobile dyes which have been used in this type of system in the past and there are very few thermo-mobile dyes which satisfy the conditions required. The conditions required are that the dye should have the preferred spectral characteristics with respect to color reproduction, that the dye should not change color or fade as a result of the action of light or heat, that there should be little denaturation due to the action of various chemicals, that there should be little or no loss of sharpness after image formation, that the image should not be liable to re-transferrence, and that the thermal transfer dye donating material should be simple to produce.

Furthermore, the light fastness of the color image may particularly decrease in an area where dyes having a different absorption wavelength are present together, resulting in a problem. Among them, the decrease of the light fastness of a cyan dye or a magenta dye, which is caused by the 10-presence of a cyan dye was particularly serious. This has not yet been made clear in detail, though it may be considered to be caused by mutual action between the different dyes, and improvements thereof have been keenly demanded.

Still further, color images of the thermo-mobile transfer mode involved a phenomenon that the light fastness remarkably decreases in a low-density area, resulting in a problem. This has not yet been made clear in detail, though it may be considered to be caused by the matter that a heat energy applied from a thermal head is not sufficient so that the dye is not thoroughly dyed into the image receiving layer. Thus, an improvement of the light fastness of the color image in a low-density area has been keenly demanded.

Among these requirements, the fact that the dyes are not liable to change in color or fade as a result of light and heat is of special importance in the case of image recording. However, the thermo-mobile dyes which have been used conventionally have been unsatisfactory in this respect, changes in color or fading have inevitably occurred in a short period of time and there has been a strong demand for improvement from the image storage point of view.

Consequently, the use of various anti-fading techniques has been suggested as a means of increasing image fastness. In one such technique, various additives which have an anti-fading action are included in the image receiving layer. Such additives include ultraviolet absorbers, auto-antioxidants, singlet oxygen quenchers, super-oxide quenchers, peroxide degrading agents and other types of stabilizers. For example, the use of ultraviolet absorbers in the image receiving layer has been disclosed in JP-A-62-260152 and JP-A-63-145089. (The term "JP-A" as used herein signifies an "unexamined published Japanese patent application".) Furthermore, the use of metal complexes has been disclosed in JP-A-1-105789 and JP-A-1-146787. The use of other light stabilizers has been disclosed, for example, in JP-A-63-74686, JP-A-63-122596, JP-A-1-127387 and JP-A-1-171887.

However, no great anti-color fading effect can be achieved with the addition of compounds which have an anti-fading action to the image receiving layer.

Further, an improvement in the decrease of the light fastness of a cyan dye or a magenta dye to be present together with a yellow dye has not yet been achieved.

Still further, an improvement of the light fastness in a low-density area has not yet been achieved, too.

On the other hand, in the field of dyes in general, attempts have been made to increase the light fastness of dyes by bonding atomic groups which have the effect of inhibiting fading of the dye. Typical examples have been described in *J. Appl. Chem. Biotechnol.*, 1977, 27, pp. 558–564.

However, there is no description or suggestion in the literature of the fact that these dyes can be used in thermo-mobile type thermal transfer applications. With the method used for thermal transfer recording in the experiments described in he literature, dyes which have been substituted with tertiary amino groups, which are supposed to have an anti-fading effect according to the results of the latest polypropylene film and polyester fiber dying experiments, in fact have a lower fastness than unsubstituted dyes.

Furthermore, the bonding of atomic groupings, which have an anti-fading action, to the couplers which are used in silver salt color photography has been disclosed, for example, in JP-A-53-82411, JP-A-55-7702, JP-A-50-20723, JP-A-59-45442, JP-A-60-222852, JP-A-61-50136, JP-A-63-24256, JP-A-1-191141, JP-A-1-186951, JP-A-1-180547, EP 178165, EP 17684, EP 117765 and U.S. Pat. No. 3,519,429.

However, the couplers which are used in silver salt color photography mentioned above are designed in such a way as not to diffuse from the film of the photosensitive material during the course of the operations of development processing. On the other hand, the dyes which are used in the thermo-type of thermal transfer are such that the dyes are transferred directly by sublimation or thermal diffusion on the application of heat. Hence, unless the thermo-mobility of a dye is very high it is impossible to obtain satisfactory image densities and it cannot be used to form thermal transfer images.

Thus, the design concept for couplers which are to be used in silver salt color photography and the dyes originating therefrom are incompatible with the design concept for the dyes which are used in thermal migration type thermal transfer materials. It is to be expected that the couplers which are used in silver salt color photography and the dyes derived therefrom will not be usable in thermo-mobile dye type thermal transfer recording.

In addition, it is unpredictable from the above-cited conventional techniques that a color image formed from the thermal dye donating material of this invention exhibits extremely high fastness even in a gray area or hardly causes a reduction of the fastness even in a low-density area.

Furthermore, JP-A-63-246285, JP-A-63-246286 and JP-A-64-77584 disclose anthraquinone dyes substituted with an alkoxyphenoxy group.

However, since in these anthraquinone dyes the alkoxyphenoxy group is directly conjugated with a dye-$\pi$ conjugation system, the alkoxyphenoxy group constitutes a part of the color forming system and does not inherently have the effect of suppressing the fading. Therefore, these patents are irrelevant to the subject matter of this invention.

In detail, the subject matter of this invention is to suppress the fading more effectively by bonding an atomic grouping which inherently has the effect of suppressing the fading to a dye moiety via a connecting group. Examples of the effects which are brought by suppressing the fading include ultraviolet light absorption action, automatic anti-oxidant action, singlet oxygen extinction action, superoxide extinction action, peroxide decomposition action, and radical trapping action as well as light stabilization action (e.g., extinction action in the dye excited state by electron transfer or energy transfer).

The atomic groupings are required to have a special structure meeting the respective actions. However, if an unnecessary substituent group is introduced, its effect disappears. The above-described alkoxyphenoxy group of the anthraquinone dye is directly conjugated with a dye-$\pi$ conjugation system and, therefore, an ability of the alkoxyphenoxy group to cause the electron transfer or energy transfer disappears. This is evident from a phenomenon that the electron transfer or energy transfer takes place between at least two independent systems.

SUMMARY OF THE INVENTION

Thus, an object of this invention is to provide thermal transfer dye donating materials in which thermo-mobile dyes of which the fastness has been improved without destroying the characteristics required of a thermo-mobile dye, such as its hue and transfer properties, are used.

Another object of this invention is to provide thermal transfer dye donating materials which are improved in the reduction of light fastness of color images in an area where different dyes are present together.

A still another object of this invention is to provide thermal transfer dye donating materials which are improved in the reduction of light fastness of color images in a low-density area.

These objects of the invention have been realized by means of a thermal transfer dye donating material comprising a support having thereon a dye donating layer which contains a thermo-mobile dye wherein the thermo-mobile dye is a dye which can be represented by the general formula (I) indicated below.

$$A-(L-B)_q \qquad (I)$$

In this formula, A represents a dye residue which has an absorbance in the visible region and/or infrared region, L represents a divalent linking group or a simple bond, and B represents an atomic grouping which has the effect of suppressing the fading of the dye. Moreover, q is 1 or 2, and when q is 2, L and B may be the same or different.

DETAILED DESCRIPTION OF THE INVENTION

Surprisingly, although the above mentioned thermo-mobile dyes of this invention have an increased molecular weight due to the presence of an atomic grouping which has an anti-fading effect, there is no loss of thermo-mobility when compared with dyes which do not have this atomic grouping.

The invention is described in more detail below.

Thermo-mobile dyes are best for the dye residue represented by A in general formula (I), and azo dyes, azomethine dyes, indoaniline dyes, anthraquinone dyes, naphthoquinone dyes, styryl dyes, quinophthalone dyes, bisazo dyes and merocyanine dyes can be used.

Those cases in which A is a dye residue represented by general formulae (II) or (III) indicated below are preferred.

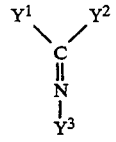

(II)

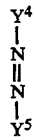

(III)

In these formulae, $Y^1$, $Y^2$, $Y^3$, $Y^4$ and $Y^5$ represent the atomic groupings which are required to provide the dye residues represented by the general formulae (II) and (III) with absorbance in the visible and/or infrared region. $Y^1$ and $Y^2$ may be jointed together to form a ring.

General formula (II) is described in more detail below. Thus, the dye residues which can be represented by the general formula (X) are preferred from among those represented by general formula (II)

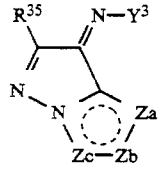

(X)

$R^{35}$ represents a hydrogen atom or a non-metal substituent group and Za, Zb and Zc each represent —N= or

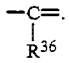

$R^{36}$ represents a hydrogen atom or a non-metal substituent group.

$Y^3$ is a structure which can be represented by general formula (XI)

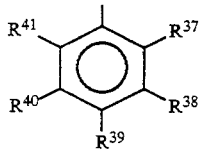

(XI)

Here, $R^{37}$, $R^{38}$, $R^{39}$, $R^{40}$ and $R^{41}$ represent hydrogen atoms or substituent groups which can be substituted on a benzene ring.

However, at least one of $R^{37}$ and $R^{39}$ must be

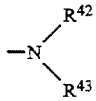

or —OH. $R^{42}$ and $R^{43}$ represent hydrogen atoms, alkyl groups, aryl groups or heterocyclic groups.

Those of the groups $R^{37}$ to $R^{41}$ which are in an ortho position to one another may be joined together to form a ring structure.

$R^{42}$ and $R^{43}$ can be joined together to form a ring structure. $R^{42}$ and $R^{43}$ may also be bonded to any of $R^{37}$ to $R^{41}$ to form a ring.

Dye residues of general formulae (XII) from among those represented by formula (X) are especially desirable.

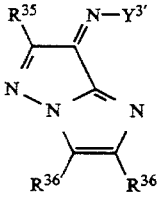

(XII)

-continued

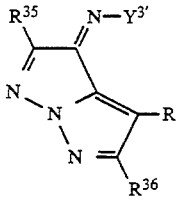

(XIII)

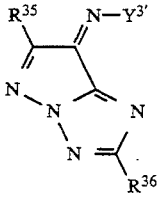

(XIV)

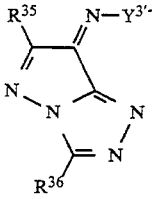

(XV)

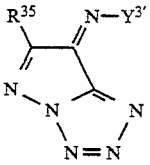

(XVI)

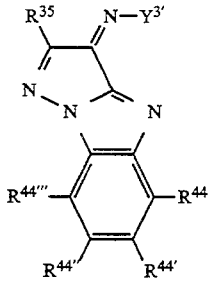

(XVII)

$R^{35}$ represents a hydrogen atom or a non-metal substituent group, and of these, a hydrogen atom, a halogen atom, alkyl groups, cycloalkyl groups, alkoxy groups, aryl groups, aryloxy groups, aralkyl groups, cyano groups, acylamino groups, alkoxycarbonylamino groups, sulfonylamino groups, ureido groups, alkylthio groups, arylthio groups, alkoxycarbonyl groups, carbamoyl groups, sulfamoyl groups, sulfonyl groups, acyl groups, amino groups and anilino groups are preferred.

These are described in more detail below. Thus, $R^{35}$ represents a hydrogen atom, a halogen atom (for example, chlorine, bromine), an alkyl group (which has from 1 to 12 carbon atoms, for example, methyl, ethyl butyl, isopropyl, tert-butyl, hydroxyethyl, methoxyethyl, cyanoethyl, trifluoromethyl), a cycloalkyl group (for example, cyclopentyl, cyclohexyl), an alkoxy group (which has from 1 to 12 carbon atoms, for example, methoxy, ethoxy, isopropoxy, methoxyethoxy, hydroethoxy), an aryl group (for example, phenyl, p-tolyl, p-methoxyphenyl, p-chlorophenyl, o-methoxyphenyl), an aryloxy group (for example, phenoxy, p-methylphenoxy, p-methoxyphenoxy, o-methoxyphenoxy), an aralkyl group (for example, benzyl, 2-phenethyl), a cyano group, an acylamino group (for example, acetylamino, propionylamino, isobutyroylamino), a sulfonylamino group (for example, methanesulfonylamino, benzenesulfonylamino, trifluoromethanesulfonylamino), a ureido group (for example, 3-methylureido, 3,3-dimethylureido, 1,3-dimethylureido), an alkylthio group (for example, methylthio, butylthio), an arylthio group (for example, phenylthio, p-tolylthio), an alkoxycarbonyl group (for example, methoxycarbonyl, ethoxycarbonyl), a carbamoyl group (for example, methylcarbamoyl, dimethylcarbamoyl), a sulfamoyl group (for example, dimethylsulfamoyl, diethylsulfamoyl), a sulfonyl group (for example, methanesulfonyl, butanesulfonyl, phenylsulfonyl), an acyl group (for example, acetyl, butyroyl), an amino group (for example, methylamino, dimethylamino) or an anilino group (for example, anilino).

$R^{36}$ represents a hydrogen atom or a non-metal substituent group, and from among these, a hydrogen atom, an alkyl group, a cycloalkyl group, an aralkyl group, an aryl group, an alkoxy group, an aryloxy group, an amino group or an alkoxycarbonyl group is preferred. Those described for $R^{35}$ can be cited as actual examples of these substituent groups.

All of the represented by $R^{36}$ are desirable for $R^{36'}$, and acyl groups, cyano groups, carbamoyl groups and formyl groups are also desirable for $R^{36'}$. Those described for $R^{35}$ can be cited as actual examples of these groups.

Those in which $R^{44}$, $R^{44'}$, $R^{44''}$ and $R^{44'''}$ are all represented by $R^{35}$ are preferred.

From among these, the hydrogen atom is the most desirable.

Those represented by formula (XVIII) are preferred for $Y^{3'}$.

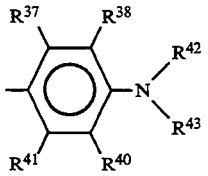

(XVIII)

$R^{37}$, $R^{38}$, $R^{40}$ and $R^{41}$ represent hydrogen atoms, alkyl groups (which preferably have from 1 to 12 carbon atoms, for example, methyl, ethyl, propyl, butyl), alkoxy groups (which preferably have from 1 to 12 carbon atoms, for example, methoxy, ethoxy, methoxyethoxy, isopropoxy), halogen atoms (bromine, fluorine, chlorine), acylamino groups (preferably alkylcarbonylamino groups which have from 2 to 12 carbon atoms, for example, acetylamino, propionylamino and cyanoacetylamino, and arylcarbonylamino groups which have from 7 to 15 carbon atoms, for example, benzoylamino, p-toluylamino, pentafluorobenzoylamino and m-methoxybenzoylamino), alkyloxycarbonyl groups (which preferably have from 2 to 13 carbon atoms, for example, methoxycarbonyl, ethoxycarbonyl), cyano groups, sulfonylamino groups (which preferably have from 1 to 10 carbon atoms, for example, methanesulfonylamino, ethanesulfonylamino, N-methylmethanesulfonylamino), carbamoyl groups (preferably alkylcarbamoyl groups which have from 2 to 12 carbon atoms, for example, methylcarbamoyl, dimethylcarbamoyl, butylcarbamoyl, isopropylcarbamoyl, t-butylcarbamoyl, cyclopentylcarbamoyl, cyclohexylcarbamoyl, methoxyethylcarbamoyl, chloroethylcarbamoyl, cyanoethylcarbamoyl, ethylcyanoethylcarbamoyl, benzylcarbamoyl, ethoxycarbonylmethylcarbamoyl, furfurylcarbamoyl, tetrahydrofurfurylcarbamoyl, phenoxymethylcarbamoyl, allylcarbamoyl, crotylcarbamoyl, prenylcarbamoyl, 2,3-dimethyl-2-butenylcarbamoyl, homoallylcarbamoyl, homocrotylcarbamoyl and homoprenylcarbamoyl; arylcarbamoyl groups which have from 7 to 15 carbon atoms, for example, phenylcarbamoyl, p-tolylcarbamoyl, m-methoxyphenylcarbamoyl, 4,5-dichlorophenylcarbamoyl, p-cyanophenylcarbamoyl, p-acetylaminophenylcarbamoyl, p-methoxycarbonylphenylcarbamoyl, m-trifluoromethylphenylcarbamoyl, o-fluorophenylcarbamoyl, and 1-naphthylcarbamoyl; and heterylcarbamoyl groups which preferably have from 4 to 12 carbon atoms, for example, 2-pyridylcarbamoyl, 3-pyridylcarbamoyl, 4-pyridylcarbamoyl, 2-thiazolylcarbamoyl, 2-benzthiazolylcarbamoyl, 2-benzimidazolylcarbamoyl, and 2-(4-methyl)-1,3,4-thiadiazolylcarbamoyl), sulfamoyl groups (which preferably have from 0 to 12 carbon atoms, for example, methylsulfamoyl, dimethylsulfamoyl), aminocarbonylamino groups (which preferably have from 1 to 10 carbon atoms, for example, methylaminocarbonylamino, dimethylaminocarbonylamino), or alkoxycarbonylamino groups (which preferably have from 2 to 10 carbon atoms, for example, methoxycarbonylamino, ethoxycarbonylamino).

A hydrogen atom is preferred for $R^{38}$, $R^{40}$ and $R^{41}$.

The preferred groups for $R^{37}$ are a hydrogen atom, alkyl groups which have from 1 to 4 carbon atoms, alkoxy groups which have from 1 to 3 carbon atoms, halogen atoms (fluorine, chlorine, bromine), acylamino groups which have from 1 to 4 carbon atoms, sulfonylamino groups which have from 0 to 4 carbon atoms, aminocarbonylamino groups which have from 1 to 4 carbon atoms and alkoxycarbonylamino groups which have from 1 to 4 carbon atoms.

$R^{42}$ and $R^{43}$ represent hydrogen atoms, alkyl groups (which preferably have from 1 to 12 carbon atoms, for example, methyl, ethyl, propyl, isopropyl, butyl, 2-methoxyethyl, 3-methoxypropyl, ethoxyethyl, 2-phenylethyl, 2-cyanoethyl, cyanomethyl, 2-chloroethyl, 3-bromopropyl, 2-methoxycarbonylethyl, 3-ethoxycarbonylpropyl, 2-(N-methylaminocarbonyl-)ethyl, 3-(N,N-dimethylaminocarbonyl)propyl, 2-acetylaminoethyl, 3-(ethylcarbonylamino)propyl, 2-acetyloxyethyl), or aryl groups (which preferably have from 6 to 14 carbon atoms, for example, phenyl, p-tolyl, p-methoxyphenyl, 2,4-dichlorophenyl, p-nitrophenyl, 2,4-dicyanophenyl, 2-naphthyl).

Alkyl groups (for example, methyl, ethyl, propyl, 2-cyanoethyl, 2-acetyloxyethyl, 2-ethoxycarbonylethyl, 2-methoxyethyl) are preferred for $R^{42}$ and $R^{43}$.

Formula (XIX) is a also a suitable structure for the dye residues represented by formula (II)

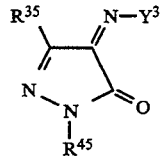

(XIX)

$R^{35}$ has the same significance as $R^{35}$ in formula (X). $Y^3$ is a structure represented by formula (XI). $R^{45}$ has the same significance as $R^{42}$. The substituents described for the aforementioned $R^{35}$ and $R^{42}$ can be cited as actual examples of these substituents.

$R^{35}$ is preferably an acylamino group (for example, acetylamino, benzoylamino), an anilino group (for example, methylamino, anilino, o-chloroanilino) or an alkyl group (for example, methyl).

$R^{45}$ is preferably a hydrogen atom, an alkyl group (which preferably has from 1 to 12 carbon atoms, for example, methyl, ethyl methoxyethyl, benzyl, 2,4,6-trichlorophenylmethyl, 2-phenethyl) or an aryl group (for example, phenyl, trichlorophenyl, dichlorophenyl, 4-chlorophenyl, 4-aminophenyl).

The structure shown in formula (XVIII) is preferred for $Y^3$.

Formulae (XX) and (XXI) are other preferred structures for the dye residue represented by formula (II).

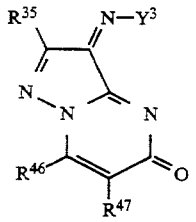

(XX)

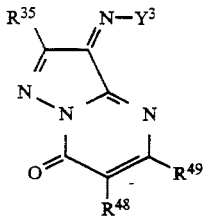

(XXI)

In these formulae, the group represented by $R^{35}$ is the same as that represented by $R^{35}$ in formula (XII). The substituent groups described for $R^{35}$ can be cited as actual examples of this substituent group. $Y^3$ has a structure represented by formula (XI).

$R^{46}$, $R^{47}$, $R^{48}$ and $R^{49}$ represent groups the same as those represented by $R^{36}$ described earlier.

Those described for $R^{36}$ can be cited as actual examples of the substituent groups.

$R^{35}$ in formula (XX) and formula (XXI) is preferably an alkyl group (for example, methyl, ethyl, t-butyl) or an aryl group (for example, phenyl). $R^{46}$ to $R^{49}$ are preferably hydrogen atoms or alkyl groups (for example, methyl, ethyl) or joined together to form aromatic rings.

The structure represented by formula (XVIII) is preferred for $Y^3$.

General formula (XXII) is another preferred structure for the dye residue represented by formula (II).

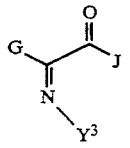

(XXII)

G and J represent hydrogen atoms or non-metal substituent groups or G and J may be joined together to form a ring structure.

The structure represented by formula (XVIII) is preferred for $Y^3$.

G is preferably a heterocyclic group, an aryl group, or a

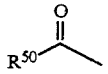

group, wherein $R^{50}$ is an alkyl group, an aryl group, or a heterocyclic group.

J is preferably an alkyl group, an amino group (including substituted amino groups such as an alkylamino group and an anilino group), an aryl group, or a heterocyclic group.

Among the dyes represented by formula (XXII) are preferred those represented by formula (XXII)-1.

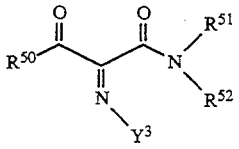

(XXII)-1

$R^{50}$ is an alkyl group or an aryl group. $R^{51}$ is a hydrogen atom, an alkyl group or an aryl group. Those described for $R^{35}$ can be cited as actual examples. $Y^3$ is a structure as represented by formula (XI).

$R^{50}$ is most desirably a tert-butyl group and $R^{51}$ is most desirably an o-chloroaryl group or an alkyl group (e.g., those having from 1 to 12 carbon atoms, for example, methyl). $R^{52}$ is most desirably a hydrogen atom.

The structure represented by formula (XVIII) is preferred for $Y^3$.

(XXIII) and (XXIV) are other preferred structures for the dye residue represented by formula (II).

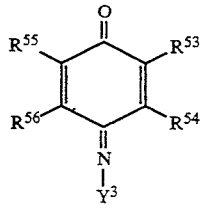

(XXIII)

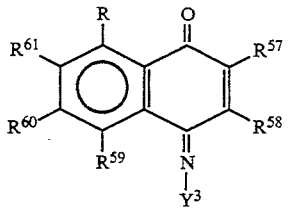

(XXIV)

$R^{53}$ to $R^{61}$ are groups the same as those represented by $R^{35}$. The groups described for $R^{35}$ can be cited as actual examples of these groups. $Y^3$ is a structure which can be represented by formula (XI).

In formula (XXIII), $R^{53}$ is most desirably an acylamino group (for example, acetylamino, furoylamino, benzoylamino) Moreover, $R^{56}$ is preferably an acylamino group or an alkyl group (for example, methyl, ethyl).

$Y^3$ is preferably a structure which can be represented by formula (XVIII).

In formula (XXIV), $R^{57}$ is preferably a carbamoyl group (for example, methylcarbamoyl). $R^{58}$ to $R^{60}$ are preferably hydrogen atoms.

$Y^3$ is preferably a structure which can be represented by (XVIII).

Formula (XXV) is another preferred structure of the dye residue represented by formula (II).

(XXV)

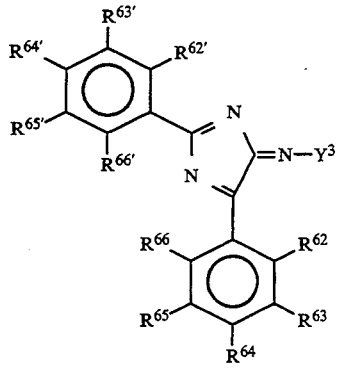

$R^{62}$ to $R^{66}$ and $R^{62'}$ to $R^{66'}$ have the same significance as the group represented by $R^{35}$. $Y^3$ is a structure which can be represented by formula (XI) . Those described for $R^{35}$ can be cited as actual examples.

can be cited as actual examples.

$R^{62}$ and $R^{62'}$ are preferably acylamino groups (for example, acetylamino), sulfonylamino groups (for example, methanesulfonylamino), alkyl groups (for example, methyl) or hydrogen atoms.

$R^{63}$ to $R^{66}$ and $R^{63'}$ to $R^{66'}$ are preferably hydrogen atoms.

Y is preferably a structure which can be represented by general formula (XVIII).

Of the structures represented by the formulae (XII), (XIII), (XIV), (XV), (XVI), (XVII), (XIX), (XX), (XXI), (XXII), (XXIII), (XXIV) and (XXV) described above, (XII), (XIV), (XV) and (XVII) are preferred.

Groups represented by the general formulae (IV) to (IX) indicated below are preferred for B (the group which has the effect of suppressing fading) in general formula (I).

(IV)

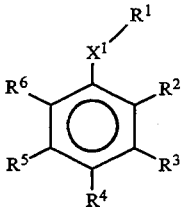

(V)

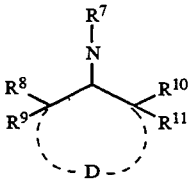

(VI)

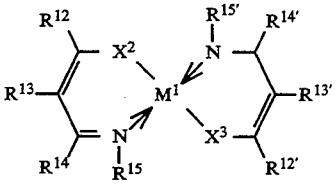

-continued (VII)

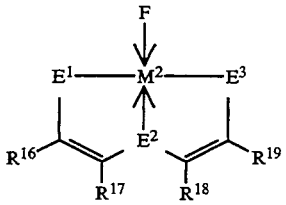

(VIII)

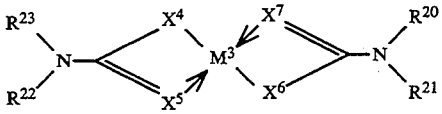

(IX)

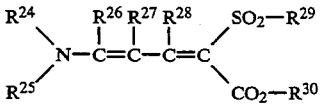

In these formulae, $R^1$ represents a hydrogen atom, an alkyl group, an alkenyl group, an aryl group, a heterocyclic group, a silyl group or a phosphino group.

$X^1$ represent —O—, —S— or

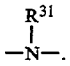

$R^{31}$ represents a hydrogen atom, an alkyl group or an aryl group $R^2$, $R^3$, $R^4$, $R^5$ and $R^6$ represent hydrogen atoms or non-metal substituent groups. Any of the groups $R^1$ to $R^6$ which are in positions ortho to one another can be joined together to form a five to seven membered ring.

$R^7$ represents a hydrogen atom, an alkyl group, an alkenyl group, an aryl group, a hydroxyl group, an acyl group, a sulfonyl group or a sulfinyl group.

D represents a group of non-metal atoms which is required to form a five to seven membered ring.

$R^8$, $R^9$, $R^{10}$ and $R^{11}$ represent hydrogen atoms or non-metal substituent groups.

$M^1$ and $M^2$ represent copper, cobalt, nickel, palladium or platinum.

$R^{12}$, $R^{13}$, $R^{14}$, $R^{12'}$, $R^{13'}$ and $R^{14'}$ represent hydrogen atoms, alkyl groups or aryl groups.

$R^{15}$ and $R^{15'}$ represent hydrogen atoms, alkyl groups, aryl groups, hydroxyl groups, alkoxy groups or aryloxy groups.

$X^2$ and $X^3$ each represent —O— or —S—. $R^{15}$ and $R^{15'}$ may be joined together. Furthermore, adjacent groups from among the substituent groups $R^{12}$ to $R^{14}$, $R^{12'}$ to $R^{14'}$ may be joined together to form aromatic rings or five to eight membered rings.

$E^1$ and $E^3$ represent oxygen atoms, sulfur atoms, hydroxyl groups, mercapto groups, alkoxy groups, alkylthio groups or

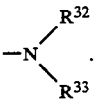

$R^{32}$ and $R^{33}$ represent hydrogen atoms, alkyl groups, aryl groups or hydroxyl groups.

$E^2$ represents —O—, —S—, or $$-\overset{\overset{R^{34}}{|}}{N}-.$$

$R^{34}$ represents a hydrogen atom, an alkyl group or an aryl group.

Here, $R^{16}$, $R^{17}$, $R^{18}$ and $R^{19}$ independently represent hydrogen atoms, alkyl groups or aryl groups, and $R^{16}$ and $R^{17}$, $R^{18}$ and $R^{19}$ and/or $R^{17}$ and $R^{18}$ may be joined together to form an aromatic ring or a five to eight membered ring.

F represents a compound which can coordinate with $M^2$. The coordination number of this compound is from 1 to 5.

$R^{20}$, $R^{21}$, $R^{22}$ and $R^{23}$ represent hydrogen atoms, alkyl groups, aryl groups or heterocyclic groups. $X^4$ to $X^7$ each represent a sulfur atom or an oxygen atom. $M^3$ represents nickel or cobalt.

$R^{20}$ and $R^{21}$ and/or $R^{22}$ and $R^{23}$ may be joined together to form a ring structure.

$R^{24}$, $R^{25}$, $R^{26}$, $R^{27}$, $R^{28}$, $R^{29}$ and $R^{30}$ are non-metal substituent groups which are determined in such a way that the atomic grouping represented by formula (IX) has an ultraviolet absorbing action.

Formula (III) is described in more detail below.

Formula (XXVI) is a preferred structure for the dye residues represented by formula (III).

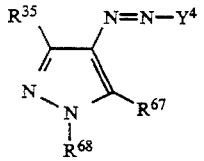

(XXVI)

$R^{35}$ is the same as $R^{35}$ in formula (XII). $R^{68}$ has the same significance as $R^{42}$. $R^{67}$ represents an OH group or $$-\overset{\overset{R^{69}}{|}}{N}-R^{70}.$$

$R^{69}$ and $R^{70}$ are the same as $R^{42}$. $Y^4$ is an aryl group or a heteryl group.

$R^{35}$ is preferably an alkyl group (which preferably has from 1 to 6 carbon atoms and which may be substituted, for example, methyl, ethyl, t-butyl). $R^{67}$ is preferably an amino group (for example, amino, methylamino). Of these, the unsubstituted amino group is the most desirable. $R^{68}$ is preferably an aryl group (for example, phenyl, 2,4,6-trichlorophenyl). $Y^4$ is preferably an aryl group (for example, p-nitrophenyl, 3,4-dicyanophenyl).

Formula (XXVII) is another preferred structure of a dye residue represented by formula (III).

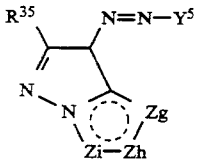

(XXVII)

$R^{35}$ is the same as $R^{35}$ in formula (X). Zg, Zh and Zi represent —N= or $$-\overset{\overset{R^{71}}{|}}{C}=.$$

$R^{71}$ has the same significance as $R^{36}$.

$Y^5$ is an aryl group or a heteryl group.

The most desirable dye residues represented by formula (XXVII) are those which can be represented by the formula (XXVIII), (XXIX), (XXX) or (XXXI).

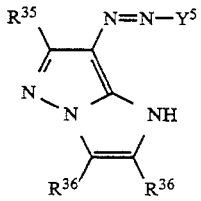

(XXVIII)

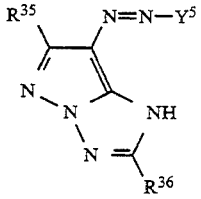

(XXIX)

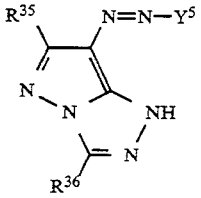

(XXX)

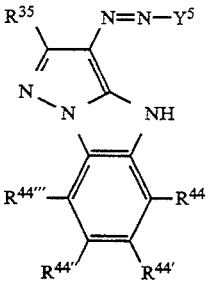

(XXXI)

$R^{35}$, $R^{36}$, $R^{36'}$, $R^{44}$, $R^{44'}$, $R^{44''}$, $R^{44'''}$ and $Y^5$ have the same significance as described earlier. Those groups described for $R^{35'}$, $R^{36}$, $R^{36'}$ and $R^{44}$ can be cited as actual examples, and the preferred examples are just the same as before. $Y^5$ is preferably an aryl group (which has from 6 to 10 carbon atoms, for example, p-nitrophenyl, 3,4-dicyanophenyl).

Formula (XXXII) is another preferred structure of the dye residues represented by formula (IV).

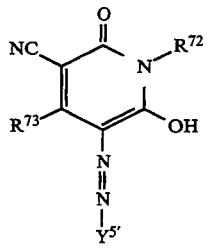

(XXXII)

$R^{73}$ has the same significance as $R^{35}$. $R^{72}$ has the same significance as $R^{42}$ described earlier. $Y^{5'}$ represents an aryl group or a heteryl group.

$R^{73}$ is preferably an alkyl group (which has from 1 to 6 carbon atoms, for example, methyl, ethyl). $R^{72}$ is preferably an alkyl group (which has from 1 to 6 carbon atoms, for example, methyl, ethyl).

$Y^{5'}$ is preferably an aryl group (which has from 6 to 15 carbon atoms, for example, p-nitrophenyl, p-benzyloxycarbonylphenyl, p-chlorophenyl).

Formula (XXXIII) is another preferred structure of the dye residues represented by formula (III).

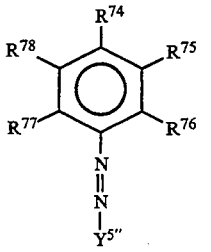

(XXXIII)

Here, $R^{74}$, $R^{75}$, $R^{76}$, $R^{77}$ and $R^{78}$ each have the same significance as the group represented by $R^{35}$. Those described for $R^{35}$ can be cited as actual examples of these groups. However, at least one of $R^{74}$ and $R^{76}$ must be

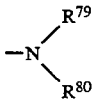

or —OH. $R^{79}$ and $R^{80}$ are hydrogen atoms, alkyl groups or aryl groups. $R^{79}$ and $R^{80}$ may be joined together to form a ring structure. $R^{79}$ and $R^{80}$ are preferably alkyl groups which have from 1 to 6 carbon atoms.

Those of the groups $R^{74}$ to $R^{78}$ which are in positions ortho to one and other may be joined together to form rings. $R^{77}$ is preferably an acylamino group (which has from 1 to 6 carbon atoms) or an alkyl group (which as from 1 to 6 carbon atoms). $R^{75}$ and $R^{76}$ are preferably hydrogen atoms.

$Y^{5''}$ is an aryl group or a heteryl group. $Y^{5''}$ is preferably a substituted benzene ring (for example, 2-cyano-4-methanesulfonylphenyl, 2,4,5-tricyanophenyl, 4-nitrophenyl, 3,4-trichlorophenyl).

The structure represented by formula (XXVI) is especially desirable among the structures represented by the formulae (XXVI), (XXVII), (XXVIII), (XXIX), (XXX), (XXXI), (XXXII) and (XXXIII) which have been described above.

The formulae (IV), (V), (VI), (VII), (VIII) and (IX) are described in detail below.

In formula (IV), $R^1$ is a hydrogen atom, an alkyl group, an alkenyl group, an aryl group, a heterocyclic group, a silyl group or a phosphino group, and it is preferably a hydrogen atom, an alkyl group (which has from 1 to 6 carbon atoms, for example, methyl, ethyl, isopropyl) or an aryl group (for example, phenyl).

$X^1$ represents —O—, —S— or

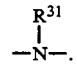

$R^{31}$ is a hydrogen atom, an alkyl group or an aryl group. $X^1$ is preferably —O—.

$R^2$, $R^3$, $R^4$, $R^5$and $R^6$ represent hydrogen atoms or non-metal substituent groups. For example, they may be hydrogen atoms, —$X^1$—$R^1$, alkyl groups, alkenyl groups, aryl groups, heterocyclic groups, alkyloxycarbonyl groups, aryloxycarbonyl groups, halogen atoms, acyl groups, sulfonyl groups, carbamoyl groups, sulfamoyl groups, cyano groups, nitro groups, sulfo groups, carboxyl groups or —$NR^{31}(R^1)$.

Among them are preferred those wherein $X^1$ represents —O—; $R^1$ represents an alkyl group; and at least one of $R^2$ and $R^4$ represents —O—$R^1$, wherein $R^1$ represents an alkyl group, or

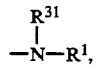

wherein $R^1$ represents an alkyl group.

Among them are the most preferred those represented by the following formulae.

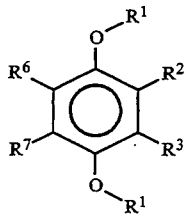

(IV-α)

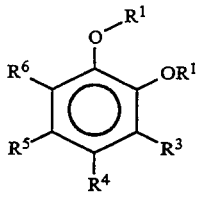

(IV-β)

Other examples of the most preferred compounds are those represented by the following formulae:

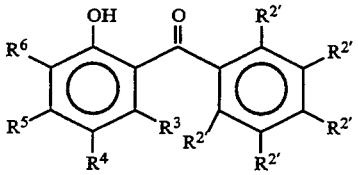

(IV-γ)

-continued (IV-δ)

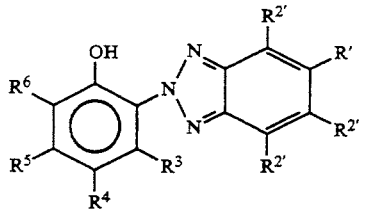

$R^3$, $R^4$, $R^5$ and $R^6$ are the same as defined above; and $R^{2'}$ is the same as that defined for $R^2$.

$R^2$ to $R^6$ are preferably hydrogen atoms, —O—$R^1$, —S—$R^1$, alkyl groups (which have from 1 to 6 carbon atoms, for example, methyl, ethyl, tert-butyl), halogen atoms (for example, F, Cl), acyl groups (for example, acetyl), acylamino groups (for example, acetylamino) or alkoxycarbonyl groups (for example, methoxycarbonyl).

The substituent groups among $R^1$ to $R^6$ which are in positions ortho to one another may be joined together to form five to seven membered rings.

In formula (V), $R^7$ represents a hydrogen atom, an alkyl group, an alkenyl group, an aryl group, a hydroxyl group, an acyl group, a sulfonyl group or a sulfinyl group.

From among these groups, $R^7$ is preferably a hydrogen atom, an alkyl group (which has from 1 to 6 carbon atoms, for example, methyl, ethyl, tert-butyl) or an acyl group (which has from 1 to 7 carbon atoms, for example, acetyl, propionyl, acryloyl).

D represents a group of non-metal atoms which is required to form a five to seven membered ring. From among these, the structures represented by formulae (XXXIV), (XXXV) and (XXXVI) together with the atom to which they are bonded are preferred.

(XXXIV)

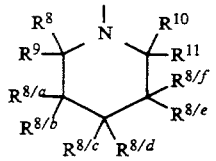

(XXXV)

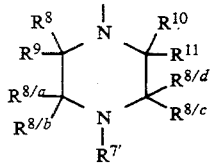

(XXXVI)

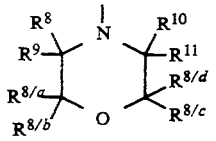

$R^8$, $R^9$, $R^{10}$ and $R^{11}$ may be the same or different. They are preferably hydrogen atoms or alkyl groups (which have from 1 to 6 carbon atoms, for example, methyl ethyl).

$R^{8/a}$ to $R^{8/f}$ are preferably hydrogen atoms, alkyl groups, hydroxyl groups, alkoxy groups, acyloxy groups, alkylamino groups, arylamino groups, or sulfonamido groups. Adjacent groups among $R^{8/a}$, $R^{8/b}$, $R^{8/c}$, $R^{8/d}$, $R^{8/e}$ and $R^{8/f}$ may be joined together to form from five to seven membered rings.

$R^{7'}$ is the same as in $R^7$.

In formula (V), $M^1$ represents copper, cobalt, nickel, palladium or platinum.

$R^{12}$, $R^{13}$, $R^{14}$, $R^{12'}$, $R^{13'}$ and $R^{14'}$ represent hydrogen atoms, alkyl groups or aryl groups.

$R^{15}$ and $R^{15'}$ represent hydrogen atoms, alkyl groups, aryl groups, hydroxyl groups, alkoxy groups or aryloxy groups.

$X^2$ and $X^3$ each represents —O— or —S—, $R^{15}$ and $R^{15'}$ may be joined together. Furthermore, adjacent groups among the substituent groups $R^{12}$ to $R^{14}$, and $R^{12'}$ to $R^{14'}$, may be joined together to form aromatic rings or five to eight membered rings.

In formula (VII), $E^1$ and $E^3$ represent oxygen atoms, sulfur atoms, hydroxyl groups, mercapto groups, alkoxy groups, alkylthio groups or

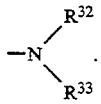

$R^{32}$ and $R^{33}$ represent hydrogen atoms, alkyl groups, aryl groups or hydroxyl groups. A sulfur atom or an oxygen atom is preferred for $E^1$ and $E^3$. $M^2$ has the same significance as $M^1$ described above.

$E^2$ represents —O—, —S— or

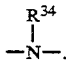

$R^{34}$ represents a hydrogen atom, an alkyl group or an aryl group. $E^2$ is preferably an oxygen atom or a sulfur atom.

Here, $R^{16}$, $R^{17}$, $R^{18}$ and $R^{19}$ independently represent hydrogen atoms, alkyl groups or aryl groups, and $R^{16}$ and $R^{17}$, $R^{18}$ and $R^{19}$, and/or $R^{17}$ and $R^{18}$ may be joined together to form an aromatic ring or a five to eight membered ring. Of these, $R^{16}$ and $R^{17}$ and/or $R^{18}$ and $R^{19}$ preferably form an aromatic ring jointly.

F represents a compound which can coordinate with $M^2$.

The coordination number of this compound is from one to five.

In formula (VIII), $R^{20}$, $R^{21}$, $R^{22}$ and $R^{23}$ represent hydrogen atoms, alkyl groups or aryl groups. $M^3$ represents nickel, cobalt or iron.

$X^4$, $X^5$, $X^6$ and $X^7$ are oxygen atoms or sulfur atoms. They are preferably sulfur atoms.

$R^{20}$ and $R^{21}$ and/or $R^{22}$ and $R^{23}$ may be joined together to form a ring structure.

$R^{24}$, $R^{25}$, $R^{26}$, $R^{27}$, $R^{28}$, $R^{29}$ and $R^{30}$ are non-metal substituent groups which are determined in such a way that the atomic group represented by formula (IX) has an ultraviolet absorbing action. $R^{24}$ to $R^{30}$ are preferably hydrogen atoms, alkyl groups (which have from 1 to 6 carbon atoms, for example, methyl, ethyl) or aryl groups (which have from 6 to 10 carbon atoms, for example, phenyl). From among these groups, $R^{26}$, $R^{27}$ and $R^{28}$ are preferably hydrogen atoms. $R^{24}$ is preferably an aryl group.

B may be bonded by L to any of D, $R^1$ to $R^{34}$, $R^{12'}$ to $R^{15'}$ and F.

The B part of formula (I) is described in more detail below. It has been mentioned before as a structure which can be represented by the general formula (IV), (V), (VI), (VI), (VIII) or (IX) which are preferred for the B part. However, all of these five structures do not have an equal fading suppressing effect. When part A in formula (I) is a dye residue which can be represented by general formula (II) a structure represented by formula (IV) or (V) for part B provides especially good fastness and this is desirable. Moreover when, in formula (II), the dye residue is represented by formula (XII), (XIV), (XV) or (XVII), the structures (IV) and (V) are especially appropriate for the B part.

Furthermore, the structures represented by formulae (IV) and (V) are also preferred for the B part when the A part in formula (I) is a dye residue represented by general formula (III).

Actual examples of structures for B in formula (I) are indicated below, but the invention is not limited by these examples.

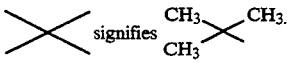

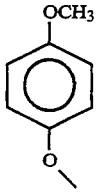

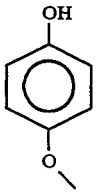

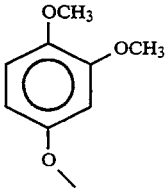

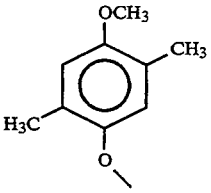

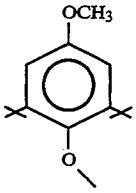

-continued

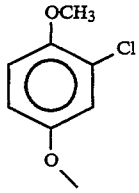

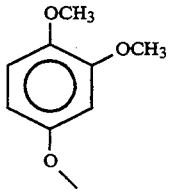

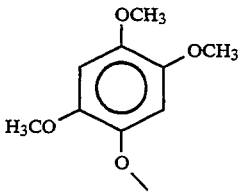

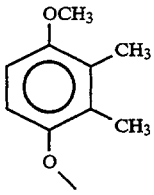

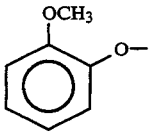

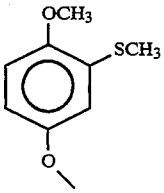

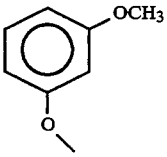

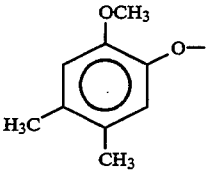

-continued
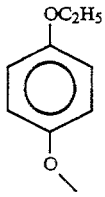
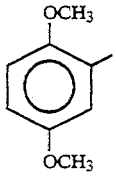
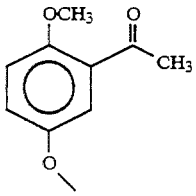
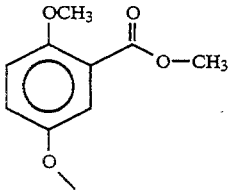
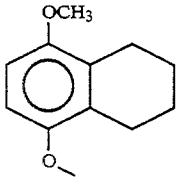
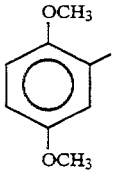
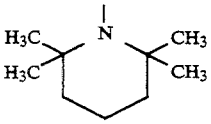
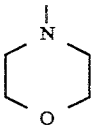
-continued
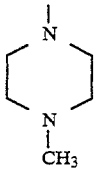
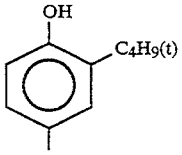
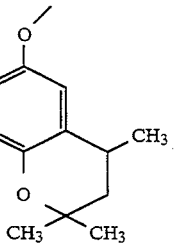
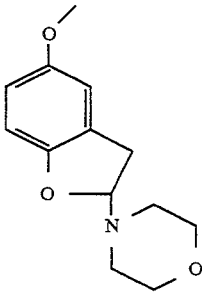
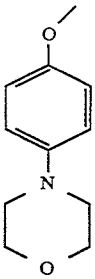
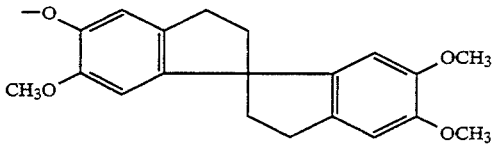

-continued
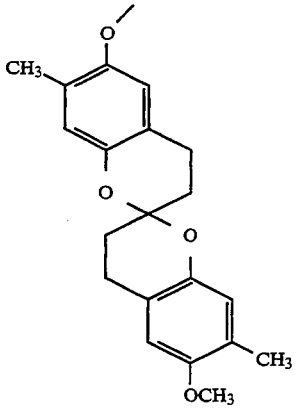
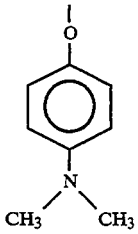
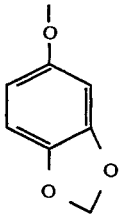
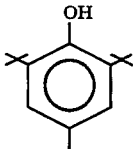
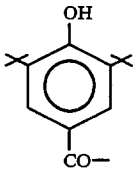
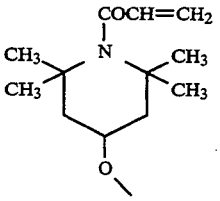
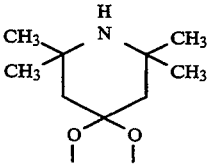
-continued
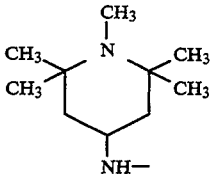
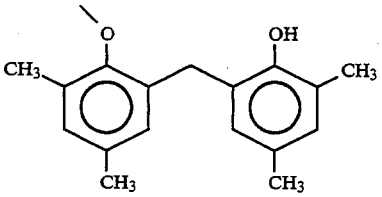
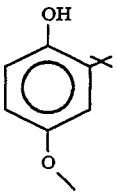
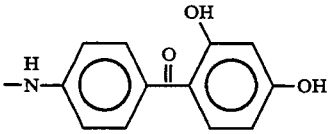
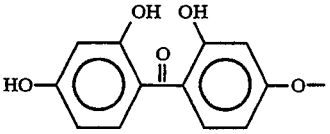
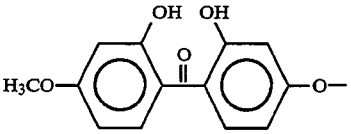
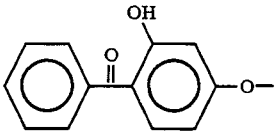
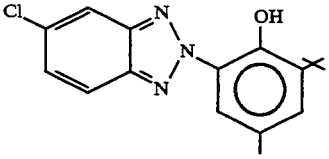
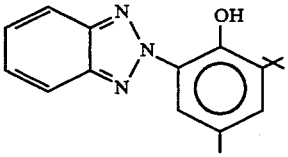

-continued

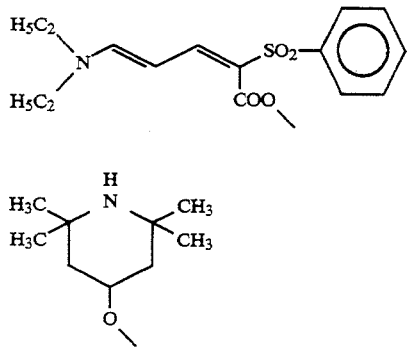

In these formula,

The linking group represented by L in general formula (I) is preferably an

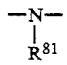

group (where $R^{81}$ represents a hydrogen atom, an alkyl group (including substituted alkyl groups), or an aryl group), an $—SO_2—$ group, an alkylene group (including substituted alkylene groups), a phenylene group (including substituted phenylene groups), a naphthylene group (including substituted naphthylene groups), —O—, —S— or a group comprised of a combination of two or more of these groups. Groups represented by $—NR^{81}—SO_2—$, $—NR^{81}—CO—$ and $—R^{82}—(L')_k—(R^{83})_l—$ are preferred from among these groups, where $R^{82}$ and $R^{83}$ each represents an alkylene group, a phenylene group or a naphthylene group, L' represents —O—, —CO—, —SO—, $—SO_2—$, $—SO_2NH—$, $NHSO_2—$, —CONH— or —NHCO—, and k represents 0 or 1, and l represents 1 when k=1, and 0 or 1 when k=0.

Furthermore, combinations of $—N(R^{81})—SO_2—$ or $—N(R^{81})—CO—$ and $—R^{82}—(L)_k—(R^{83})_l—$ are preferred.

$R^{81}$ is preferably a hydrogen atom or an alkyl group which has from 1 to 6 carbon atoms.

Preferred examples of $R^{82}$ and $R^{83}$ include alkylene groups which have from 1 to 6 carbon atoms (including those which have alkyl groups, alkoxy groups, hydroxyl groups, halogen atoms and cyano groups, for example, as substituent groups), phenylene groups (including ortho, meta and para phenylene groups, and those which have alkyl groups, alkoxy groups, halogen atoms, hydroxyl groups, carboxyl groups, sulfamoyl groups, alkylsulfonylamino groups and sulfamoyl groups, for example, as substituent groups), and naphtylene groups (including those which have the substituent groups described for phenylene groups as substituent groups).

In formula (I), when L represents a simple bond, the atomic grouping represented by B is required such that its effect of suppressing fading does not disappear.

In particular, when B represents the structure represented by formulae (IV), (VI), (VII), (VIII) or (IX), B must not be conjugated directly with the dye color-forming system ($\pi$-conjugation system).

However, in the case that a bulky substituent group is introduced into a portion adjacent to the bonding site between the A and B parts to sterically twist the conjugation system of the A part and the conjugation system of the B part whereby the conjugated systems are substantially insulated, B may be formally conjugated directly with the dye color-forming system.

Among the dyes of this invention, the more desirable are those of which B in general formula (I) is a structure which can be represented by formula (XXXVII) ($R^{1'}$ represents a group the same as those represented by $R^1$ and $R^2$, $R^3$, $R^5$ and $R^6$ represent hydrogen atoms or alkoxy groups) and A is a dye residue which can be represented by general formula (XII), (XIV), (XV) or (XVII).

(XXXVII)

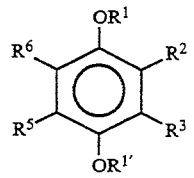

Examples of groups represented by formula (XXXVII) are as follows:

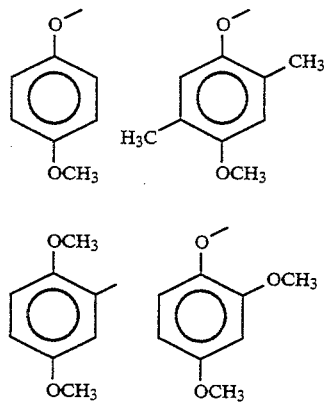

The invention is not limited to these compounds.

The position at which the dye residue represented by formula (II) and the atomic grouping represented by formula (XXXVII) are bonded is preferably bonded at the $Y^3$ moiety.

Further, $Y^3$ is preferably bonded at $R^{42}$ in formula (XVIII).

Among them, $R^{43}$ is more preferably an alkyl group having an electron withdrawing group.

$Y^3$ is most preferably represented by formula (XXXVIII).

(XXXVIII)

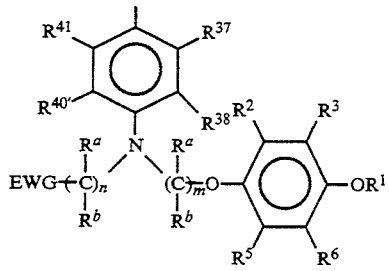

$R^{37}$, $R^{38}$, $R^{40}$ and $R^{41}$ are the same as those defined for formula (XVIII).

$R^a$ and $R^b$ represent hydrogen atoms or alkyl groups.

$R^1$, $R^2$, $R^3$, $R^5$ and $R^6$ and are the same as defined above.

n represents an integer of from 1 to 3.

m represents an integer of from 1 to 4.

EWG represents an electron withdrawing group.

Among the dye moieties represented by formula (II) are preferred those represented by formulae (XII), (XIV), (XV) and (XVII), with those represented by formula (XIV) being particularly preferred.

A preferred structure of the dye represented by the formula (I) is one represented by the following formula (II)-A.

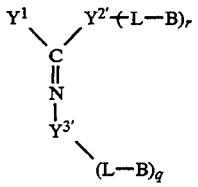

(II)-A

In the formula (II)-A, $Y^1$ and $Y^{2'}$ each represents an atomic grouping which is required such that the dye represented by the formula (II)-A becomes an azomethine dye with absorbance in the visible and/or infrared region. $Y^1$ and $Y^{2'}$ may be joined together to form a ring.

$Y^{3'}$ represents a divalent structure of an aryl group or a heterocyclic group, from which one hydrogen atom has been eliminated.

r and q are each 0 or 1. When r or q is 0, then the corresponding -(L—B) moiety represents a hydrogen atom or a halogen atom.

B represents a structure represented by one of the following formulae (IV)-A, (IV)-B, (V)-A, and (V)-B.

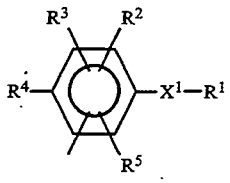

(IV)-A

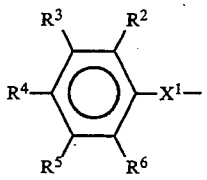

(IV)-B

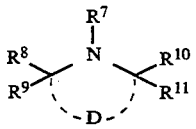

(V)-A

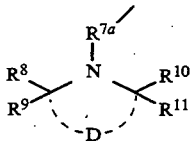

(V)-B

In the formulae (IV)-A and (IV)-B, $X^1$, $R^1$, $R^2$, $R^3$, $R^4$, $R^5$, and $R^6$ are respectively the same as $X^1$, $R^1$, $R^2$, $R^3$, $R^4$, $R^5$, and $R^6$ in the formula (IV).

In the formulae (V)-A and (V)-B, $R^7$, $R^8$, $R^9$, $R^{10}$, $R^{11}$, and D are respectively the same as $R^7$, $R^8$, $R^9$, $R^{10}$, $R^{11}$, and D in the formula (V).

$R^{7a}$ represents a divalent group corresponding to the substituent group represented by $R^7$, from which one hydrogen atom has been eliminated.

L represents a divalent linking group represented by one of the following formulae (L-I) to (L-VII).

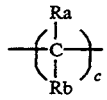

(L-I)

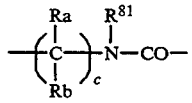

(L-II)

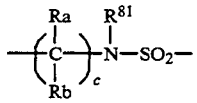

(L-III)

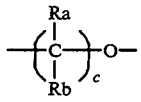

(L-IV)

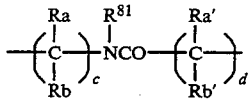

(L-V)

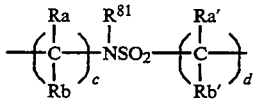

(L-VI)

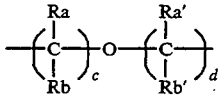

(L-VII)

In the formulae (L-I) to (L-VII), Ra, Rb, Ra', and Rb' each independently represents an alkyl group, a hydrogen atom, an aryl group, a halogen atom, an alkoxy group, an aryloxy group, an acylamino group, or an acyloxy group.

c and d each represents a positive integer.

$R^{81}$ represents a hydrogen atom, an alkyl group, or an aryl group.

The formula (II)-A is hereunder described in detail.

Among the dyes represented by the formula (II)-A are preferred those represented by the following formulae (X)-A, (XIX)-A, (XX)-A, (XXI)-A, (XXII)-A, (XXIII)-A, (XXIV)-A, and (XXV)-A.

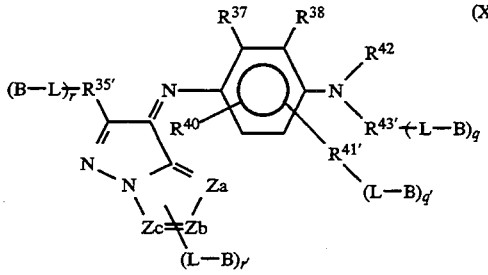

(X)-A

-continued (XIX)-A

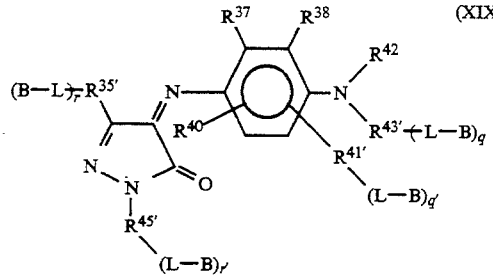

(XX)-A

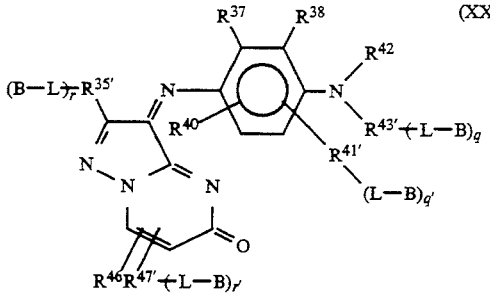

(XXI)-A

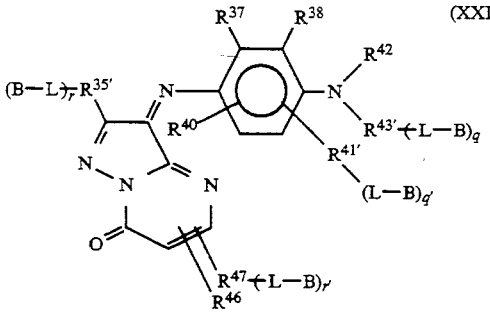

(XXII)-A

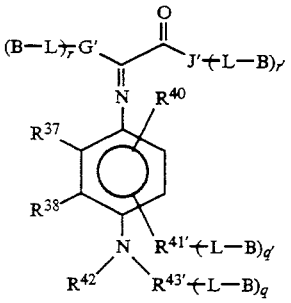

(XXIII)-A

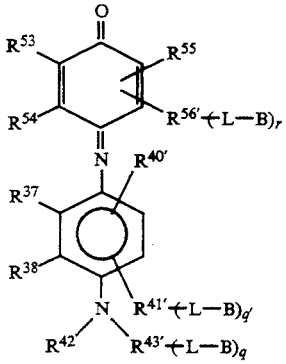

-continued (XXIV)-A

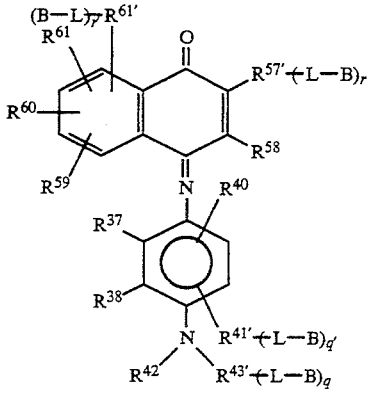

(XXV)-A

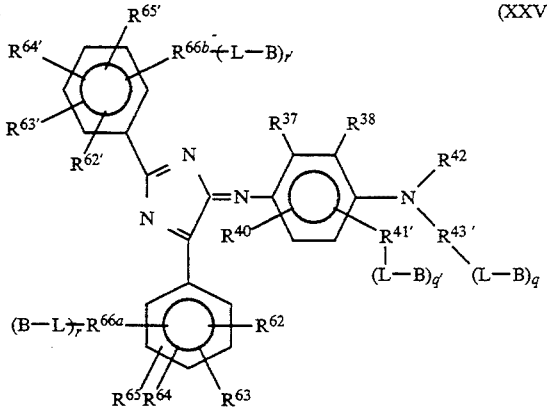

In the formulae (X)-A, (XIX)-A, (XX)-A, (XXI)-A, (XXII)-A, (XXIII)-A, (XXIV)-A, and (XXV)-A, q, q', r, and r' are each 0 or 1. The sum of q, q', r, and r' is 1 or 2. When q, q', r, or r' is 0, then the corresponding ⟨L—B) moiety represents a hydrogen atom or a halogen atom.

$R^{37}$, $R^{38}$, $R^{40}$, $R^{42}$, $R^{46}$, $R^{47}$, $R^{53}$, $R^{54}$, $R^{55}$, $R^{58}$, $R^{59}$, $R^{60}$, $R^{62}$, $R^{62'}$, $R^{63}$, $R^{63'}$, $R^{64}$, $R^{64'}$, $R^{65}$, and $R^{65'}$ are the same as $R^{37}$, $R^{38}$, $R^{40}$, $R^{42}$, $R^{46}$, $R^{47}$, $R^{53}$, $R^{54}$, $R^{55}$, $R^{58}$, $R^{59}$, $R^{60}$, $R^{62}$, $R^{62'}$, $R^{63}$, $R^{63'}$, $R^{64}$, $R^{64'}$, $R^{65}$, and $R^{65'}$ in the formulae (X), (XVIII), (XIX), (XX), (XXI), (XXII), (XXIII), (XXIV), and (XXV).

$R^{41'}$ and $R^{43'}$ respectively represent a divalent structure of $R^{41}$ and $R^{43}$ in the formula (X), from which one hydrogen atom has been eliminated.

L and B are the same as those defined for the formula (II)-A.

In the formula (X)-A, $R^{35'}$ represents a divalent structure of $R^{35}$ in the formula (X), from which one hydrogen atom has been eliminated; and Za, Zb, and Zc are the same as Za, Zb, and Zc in the formula (X).

In the formula (XIX)-A, $R^{35'}$ and $R^{45'}$ respectively represent a divalent structure of $R^{35}$ and $R^{45}$ in the formula (XIX), from which one hydrogen atom has been eliminated.

In the formulae (XX)-A and (XXI)-A, $R^{35'}$ and $R^{47'}$ respectively represent a divalent structure of $R^{35}$ and $R^{47}$ in the formulae (XX) and (XXI), from which one hydrogen atom has been eliminated.

In the formula (XXII)-A, G' and J' respectively represent a divalent structure of G and J in the formula (XXII), from which one hydrogen atom has been eliminated.

In the formula (XXIII)-A, $R^{56'}$ represents a divalent structure of $R^{56}$ in the formula (XXIII), from which one hydrogen atom has been eliminated.

In the formula (XXIV)-A, $R^{57'}$ and $R^{61'}$ respectively represent a divalent structure of $R^{57}$ and $R^{61}$ in the formula (XXIV), from which one hydrogen atom has been eliminated.

In the formula (XXV)-A, $R^{66a}$ and $R^{66b}$ respectively represent a divalent structure of $R^{66}$ and $R^{66'}$ in the formula (XXV), from which one hydrogen atom has been eliminated.

Among the dyes represented by the formulae (X)-A, (XIX)-A, (XX)-A, (XXI)-A, (XXII)-A, (XXIII)-A, (XXIV)-A, and (XXV)-A are preferred those wherein q is 1, and q', r, and r' are all 0.

Among the dyes represented by the formula (II)-A are more preferred those represented by the formulae (X)-A and (XXIII)-A.

Among the dyes represented by the formula (X)-A are preferred those represented by the following formulae (XII)-A, (XIV)-A, (XV)-A, (XVI)-A, and (XVII)-A.

(XII)-A

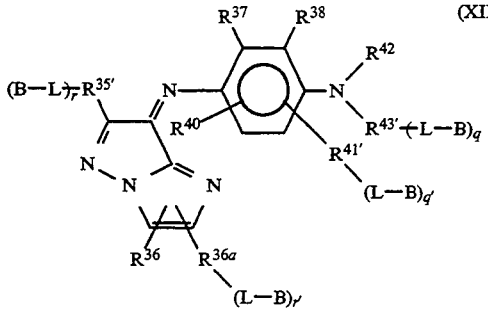

(XIV)-A

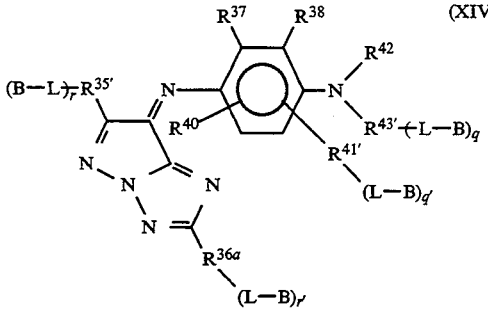

(XV)-A

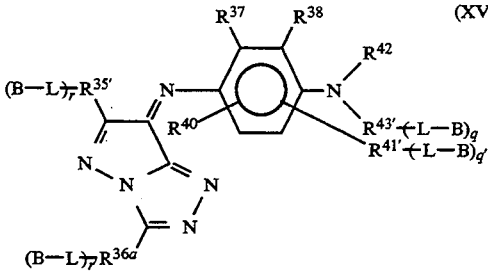

-continued (XVI)-A

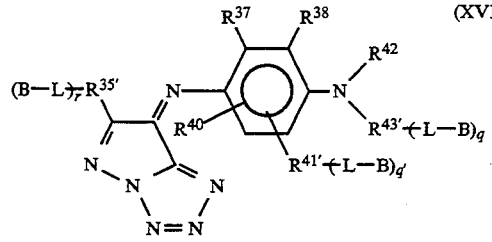

(XVII)-A

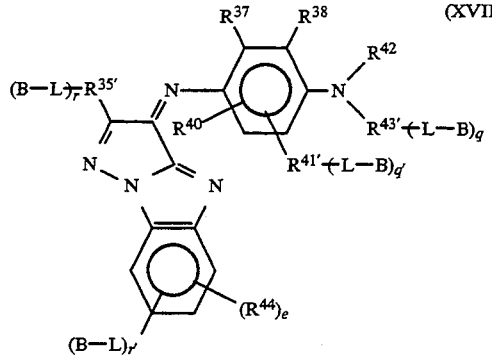

In the formulae (XII)-A, (XIV)-A, (XV)-A, (XVI)-A, and (XVII)-A, q, q', r, and r' are each 0 or 1. The sum of q, q', r, and r' is 1 or 2. When q, q', r, or r' is 0, then the corresponding ⟨—L—B) moiety represents a hydrogen atom or a halogen atom.

$R^{36}$, $R^{37}$, $R^{38}$, $R^{40}$, $R^{42}$ are the same as $R^{36}$, $R^{37}$, $R^{38}$, $R^{40}$, and $R^{42}$ in the formula (XII). Specific and preferred examples thereof are those enumerated in the formulae (XII), (XIV), (XV), (XVI), and (XVII).

$R^{35'}$, $R^{36a}$, $R^{43'}$, $R^{41'}$, respectively represent a divalent structure of $R^{35}$, $R^{36}$, $R^{43}$, and $R^{41}$ in the formula (XII), from which one hydrogen atom has been eliminated.

$R^{44}$ is the same as $R^{44}$ in the formula (XVII).

e represents an integer of from 0 to 4.

The sum of e and r' does not exceed 4.

A preferred structure of the dye represented by the formula (I) other than that of the formula (II)-A is one represented by the following formula (III)-A.

(III)-A

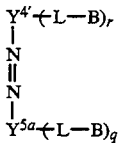

In the formula (III)-A, $Y^{4'}$ represents a divalent atomic grouping which is required to provide the azo dye represented by the formula (III)-A with absorbance in the visible and/or infrared region.

$Y^{5a'}$ represents a divalent structure of an aryl group or a heterocyclic group, from which one hydrogen atom has been eliminated.

L and B are the same as defined for the formula (II)-A.

r and q are each 0 or 1. When r or q is 0, then the corresponding —L—B) moiety represents a hydrogen atom or a halogen atom. The formula (III)-A is hereunder described in detail.

Among the dyes represented by the formula (III)-A are preferred those represented by the following formulae (XXVI)-A, (XXVII)-A, (XXXII)-A, and (XXIII)-A.

(XXVI)-A

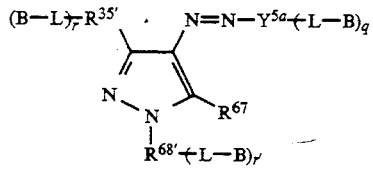

(XXVII)-A

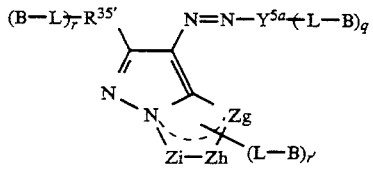

(XXXII)-A

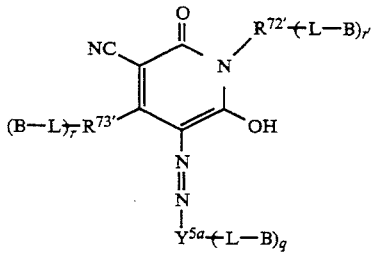

(XXXIII)-A

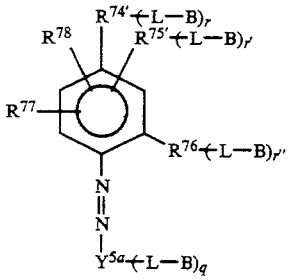

In the formulae (XXVI)-A, (XXVII)-A, (XXXII)-A, and (XXIII)-A, q, r, r', and r'' are each 0 or 1. The sum of q, r, r' and r'' is 1 or 2. When q, r, r', or r'' is 0, then the corresponding -(-L—B) moiety represents a hydrogen atom or a halogen atom.

L and B are the same as defined for the formula (II)-A.

$R^{76}$, $R^{77}$, and $R^{78}$ are the same as $R^{76}$, $R^{77}$, and $R^{78}$ in the formulae (XXVI) and (XXXIII).

In the formula (XXVI)-A and (XXVII)-A, $R^{35'}$, $R^{68'}$, and $Y^{5a}$ respectively represent a divalent structure of $R^{35}$, $R^{68}$, and $Y^5$ of the formulae (XXVI) and (XXVII), from which one hydrogen atom has been eliminated. Specific examples thereof are those enumerated in the formulae (XXVI) and (XXVII).

In the formula (XXXII)-A, $R^{72'}$, $R^{73'}$, and $Y^{5a}$ respectively represent a divalent structure of $R^{72}$, $R^{73}$, and $Y^5$ in the formula (XXXII), from which one hydrogen atom has been eliminated.

In the formula (XXXIII)-A, $R^{74'}$, $R^{75'}$, and $Y^{5a}$ respectively represent a divalent structure of $R^{74}$, $R^{75}$, and $Y^5$ in the formula (XXXIII), from which one hydrogen atom has been eliminated.

Among the dyes represented by the formula (XXVII)-A are preferred those represented by the following formulae (XXVIII)-A, (XXIX)-A, (XXX)-A, and (XXXI)-A.

(XXVIII)-A

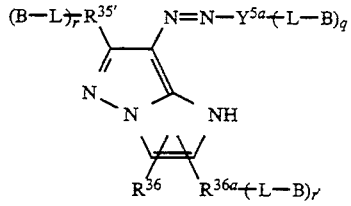

(XXIX)-A

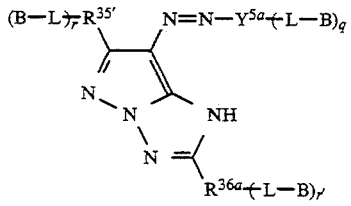

(XXX)-A

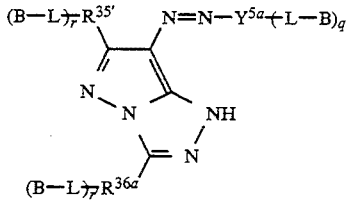

(XXXI)-A

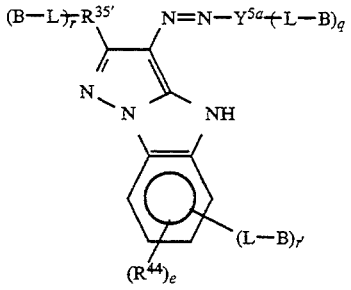

In the formulae (XXVIII)-A, (XXIX)-A, (XXX)-A, and (XXXI)-A, q, q', r, and r' are each 0 or 1. The sum of q, q', r, and r' is 1 or 2.

$R^{36}$ and $R^{44}$ are the same as $R^{36}$ and $R^{44}$ in the formulae (XXVIII) and (XXXI). Specific examples thereof are those enumerated in the formulae (XXVIII) and (XXXI).

$R^{35'}$, $R^{36a}$, and $Y^{5a}$ respectively represent a divalent structure of $R^{35}$, $R^{36}$, and $Y^5$ in the formula (XXVIII), from which one hydrogen atom has been eliminated. Specific examples thereof are those enumerated in the formula (XXVIII).

e represents an integer of from 1 to 4.

The sum of e and r' does not exceed 4.

Among the structures for B represented by the formulae (IV)-A and (IV)-B are preferred those represented by the following formulae (IV)-A-α, (IV)-A-β, (IV)-B-α, (IV)-B-β, (IV)-A-γ, and (IV)-A-δ.

(IV)-A-α

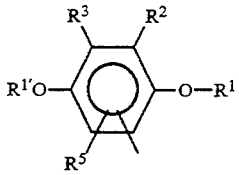

-continued (IV)-A-β

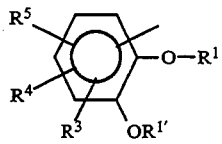

(IV)-B-α

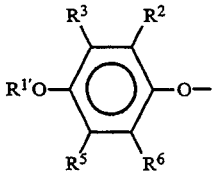

(IV)-B-β

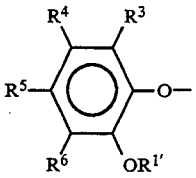

(IV)-A-γ

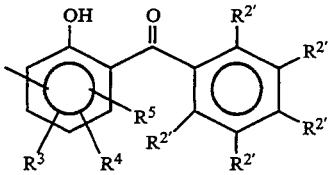

(IV)-A-δ

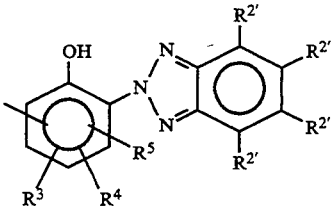

In the formulae (IV)-A-α, (IV)-A-β, (IV)-B-α, (IV)-B-β, (IV)-A-γ, and (IV)-A-δ, $R^1$, $R^{1'}$, $R^2$, $R^3$, $R^4$, $R^5$, $R^6$, $R^{2'}$ are the same as $R^1$, $R^{1'}$, $R^2$, $R^3$, $R^4$, $R^5$, $R^6$, and $R^{2'}$ in the formulae (IV-α), (IV-β), and (IV-γ).

Among the structures for B represented by the formulae (V)-A and (V)-B are preferred those represented by the following formulae (XXXIV)-A, (XXXIV)-B, (XXXV)-A, (XXXV)-B, (XXXVI)-A, and (XXXVI)-B.

(XXXIV)-A

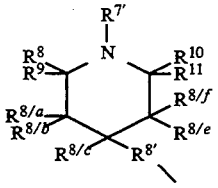

(XXXIV)-B

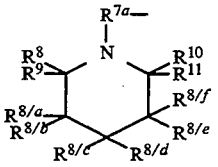

-continued (XXXV)-A

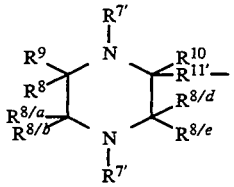

(XXXV)-B

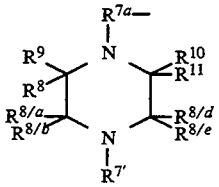

(XXXVI)-A

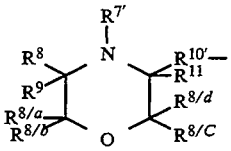

(XXXVI)-B

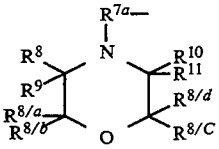

In the formulae (XXXIV)-A, (XXXIV)-B, (XXXV)-A, (XXXV)-B, (XXXVI)-A, and (XXXVI)-B, $R^{7'}$, $R^8$, $R^9$, $R^{10}$, $R^{11}$, $R^{8/a}$, $R^{8/b}$, $R^{8/c}$, $R^{8/d}$, $R^{8/e}$, and $R^{8/f}$ are the same as $R^{7'}$, $R^8$, $R^9$, $R^{10}$, $R^{11}$, $R^{8/a}$, $R^{8/b}$, $R^{8/c}$, $R^{8/d}$, $R^{8/e}$, and $R^{8/f}$ in the formulae (XXXIV), (XXXV), and (XXXVI).

$R^{8'}$, $R^{7a}$, $R^{11'}$, and $R^{10'}$ respectively represent a divalent group of $R^8$, $R^{7'}$, $R^{11}$, and $R^{10}$, from which one hydrogen atom has been eliminated.

Among the dyes represented by the formulae (X)-A, (XIX)-A, (XX)-A, (XXI)-A, (XXII)-A, (XXIII)-A, (XXIV)-A, and (XXV)-A are those wherein the

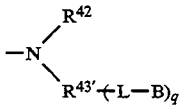

moiety is represented by the following formula (XXXVIII).

(XXXVIII)

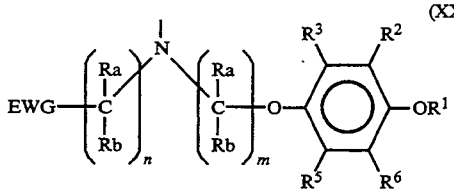

In the formula (XXXVIII), $R^1$, $R^2$, $R^3$, $R^5$, $R^6$ are the same as $R^1$, $R^2$, $R^3$, $R^5$, and $R^6$ in the formulae (IV-α) and (IV-β).

Ra and Rb each represents a hydrogen atom, an alkyl group, or a halogen atom.

n represents an integer of from 1 to 3.

m represents an integer of from 1 to 4.

EWG represents an electron withdrawing group.

Examples of the electron withdrawing group include substituent groups to effect bonding with an atom having a higher electronegativity than carbon; and those having a multiple bond.

Examples of atoms having a higher electro-negativity than carbon include nitrogen, oxygen, fluorine, chlorine, and bromine.

Examples of substituent groups having a multiple bond include

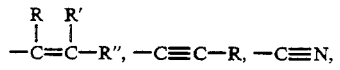

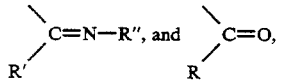

wherein R, R′, and R″ each represents a hydrogen atom or a substituent group. Among them is particularly preferred —C≡N.

Preferred structures of the dye represented by the formula (I) other than those represented by formulae (II)-A and (III)-A are ones represented by the following formulae (a), (b) and (c).

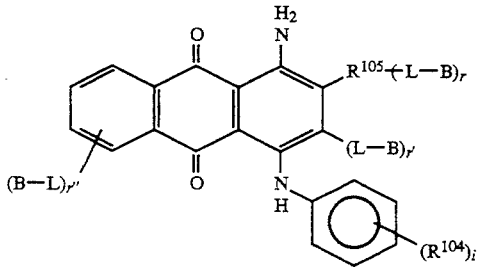

(a)

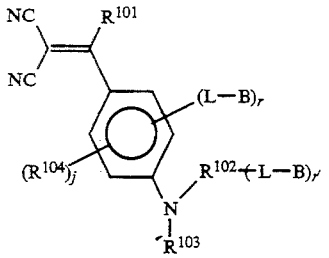

(b)

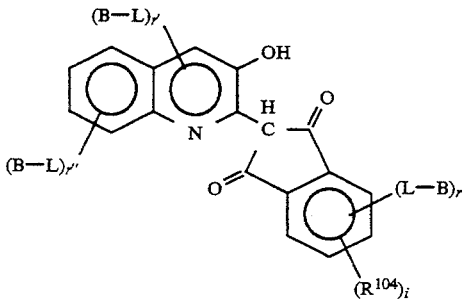

(c)

In the formulae (a), (b), and (c), L and B are the same as L and B in the formula (II)-A.

r, r′, and r″ are each 0 or 1, and the sum of r, r′, and r″ is 1 or 2. When r, r′, or r″ is 0, then the corresponding ⟨L—B⟩ moiety represents a hydrogen atom or a halogen atom.

$R^{104}$ and $R^{105}$ each represents a hydrogen atom, a halogen atom, a cyano group, an aminocarbonyl group, an alkyl group, an aryl group, an alkoxy group, an aryloxy group, or an alkoxycarbonyl group.

$R^{102}$ represents an alkylene group or an arylene group.

$R^{103}$ represents a hydrogen atom, an alkyl group, an aryl group, or a heterocyclic group.

i represents an integer of from 0 to 4.

$R^{101}$ represents a hydrogen atom, an alkyl group, an aryl group, a cyano group, an aminocarbonyl group, an alkoxycarbonyl group, or an aryloxycarbonyl group.

The dyes of this invention preferably have a total molecular weight of not more than 800. From among these dyes, those which have a molecular weight of not more than 700 are the most desirable.

From among these dyes, those in which A is a dye which can be represented by formula (XIV) are the most desirable.

Actual examples of dyes of this invention are indicated below, but the invention is not limited by these examples.

Moreover, the following simplifications have been used in the illustrative compounds indicated below:

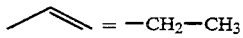

$= -CH_2-CH_3$

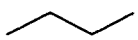

$= -CH_2-CH_2-$ or $-CH_2-CH_2-CH_3$

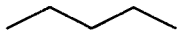

$= -CH_2-CH_2-CH_2-$ or $-CH_2-CH_2-CH_2-CH_3$

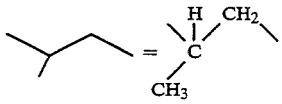

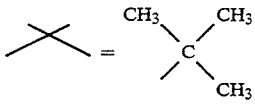

Illustrative Compounds
1.
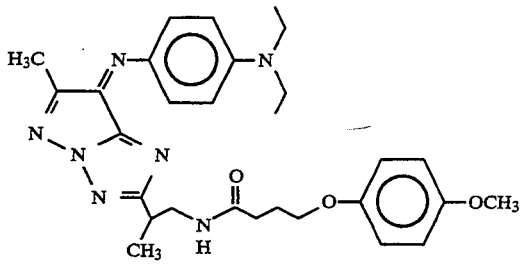
2.
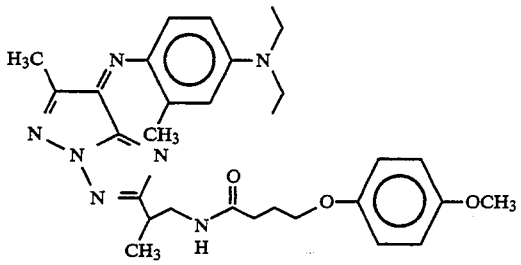
3.
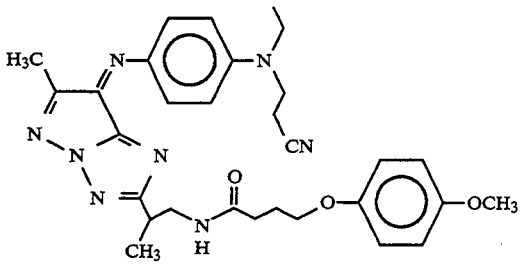
4.
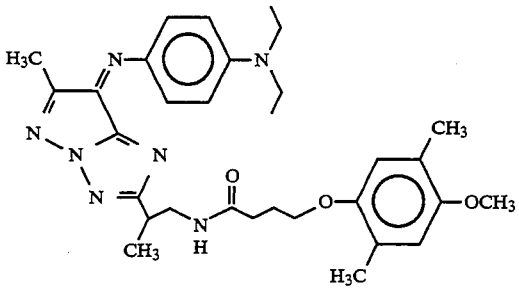
5.
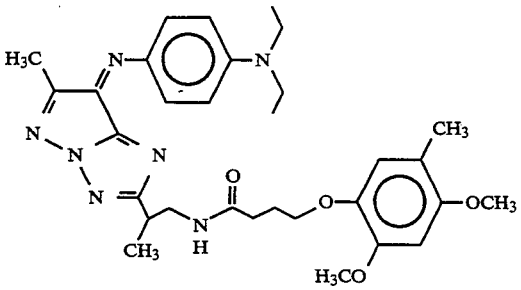
6.
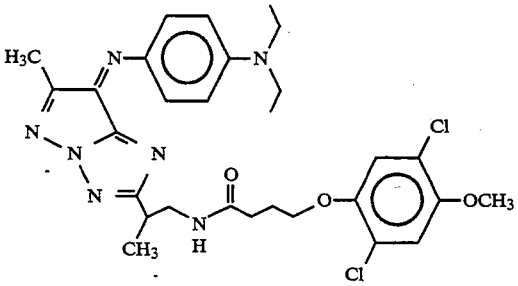
7.
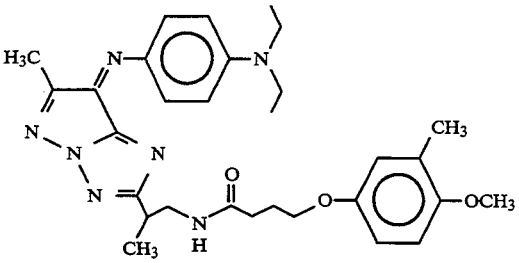
8.
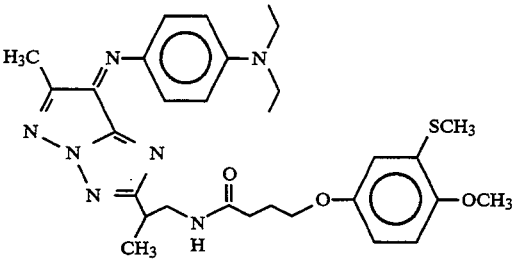
9.
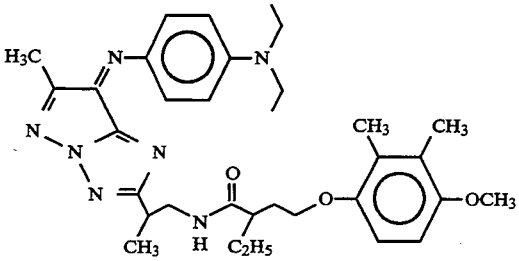
10.
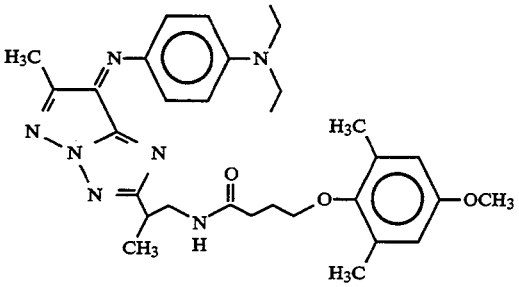

-continued
Illustrative Compounds
11.
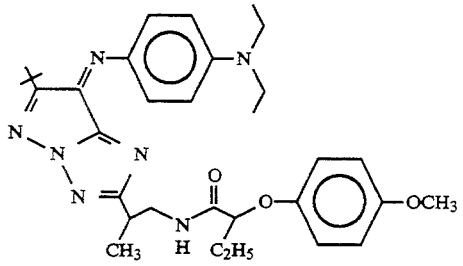
12.
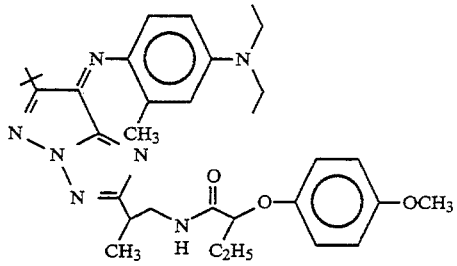
13.
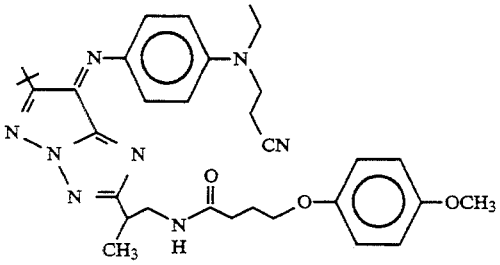
14.
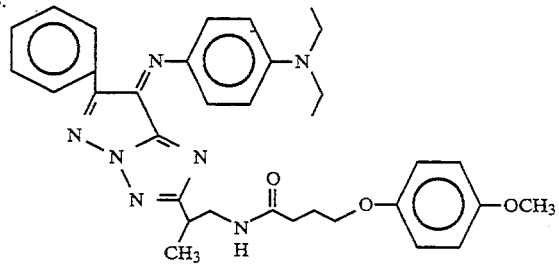
15.
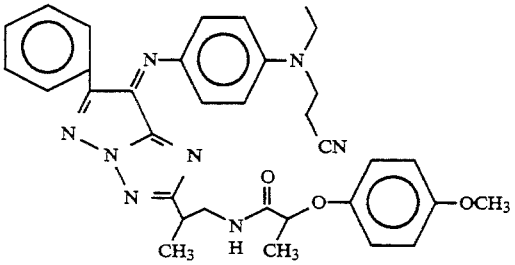
16.
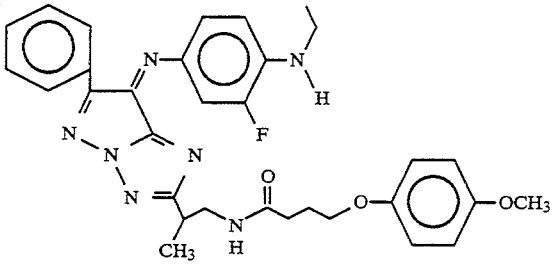
17.
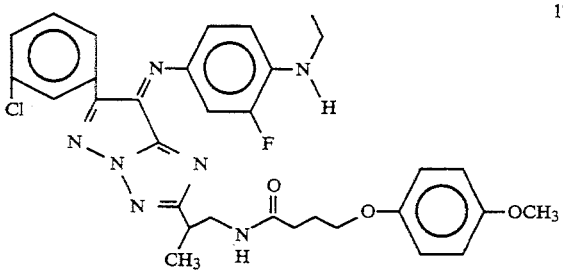
18.
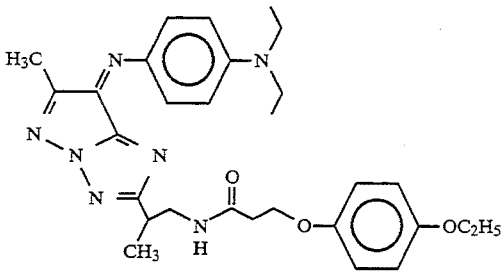
19.
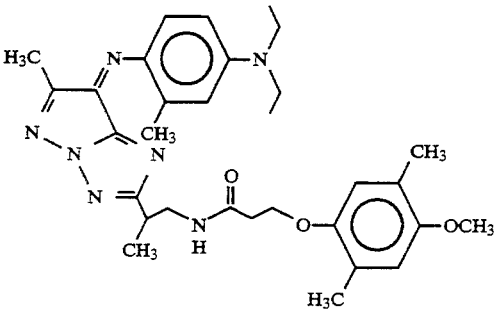
20.
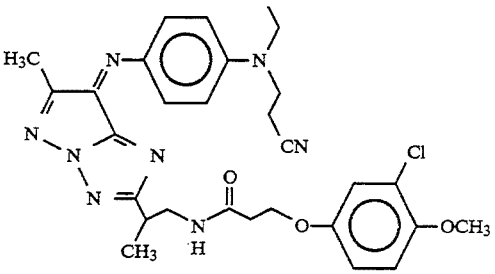

-continued
Illustrative Compounds
21.
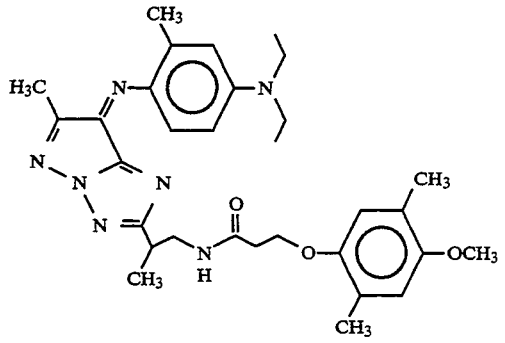
22.
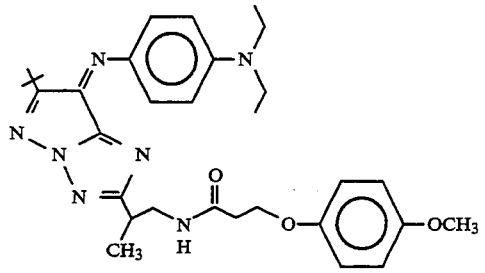
23.
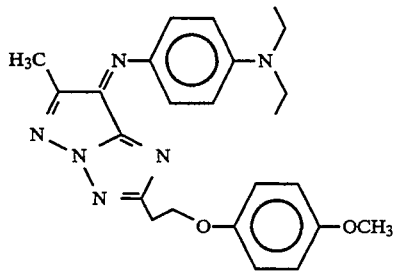
24.
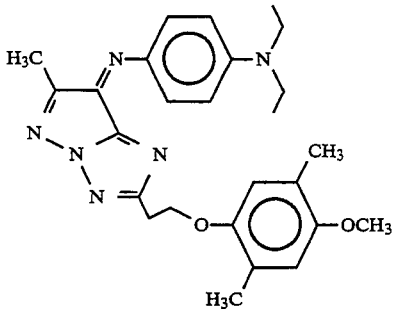
25.
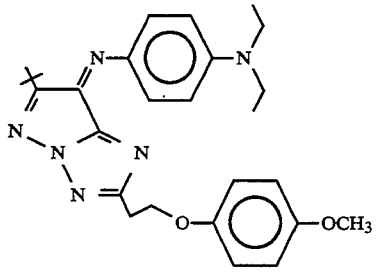
26.
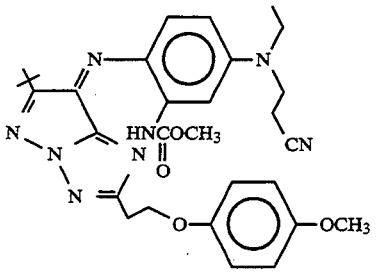
27.
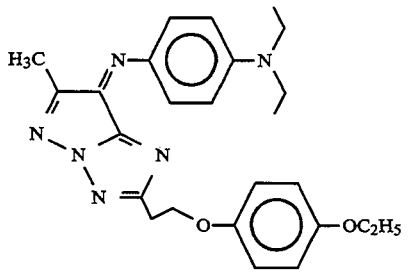
28.
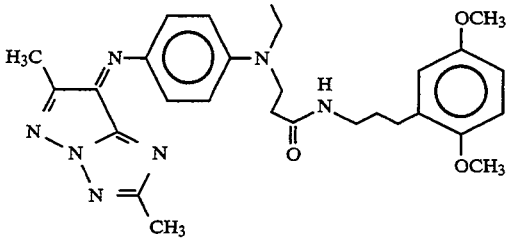
29.
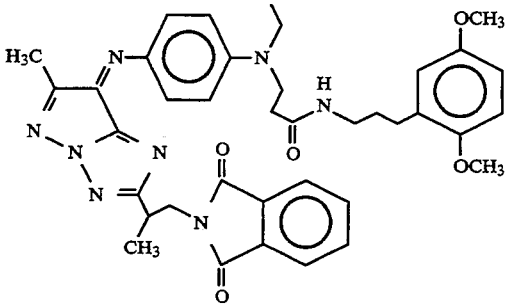
30.
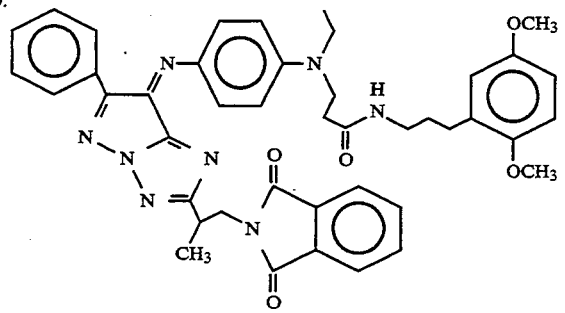

-continued
Illustrative Compounds
31.
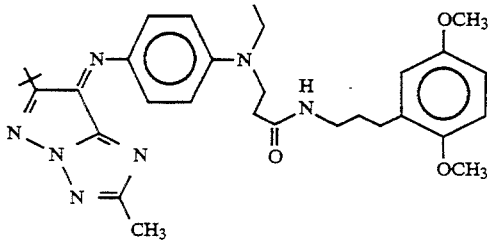
32.
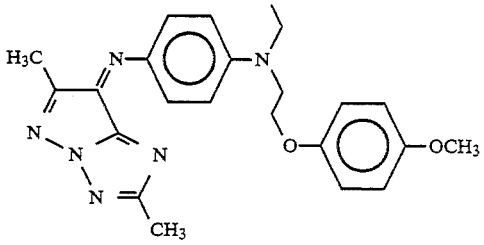
33.
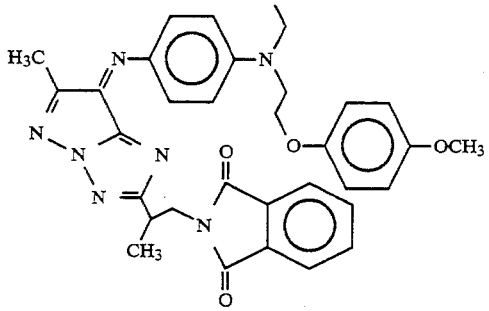
34.
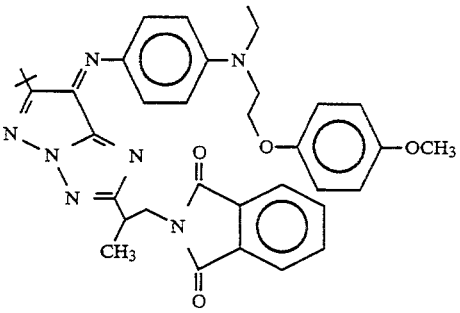
35.
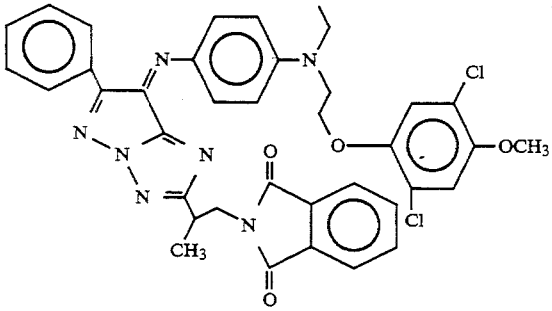
36.
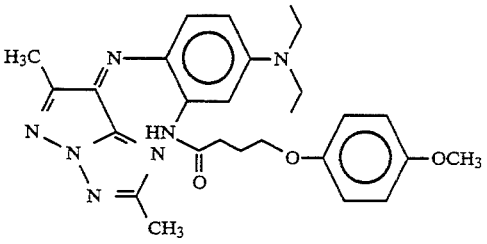
37.
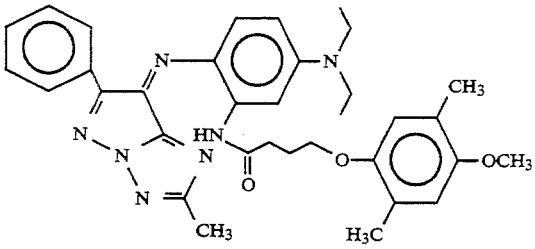
38.
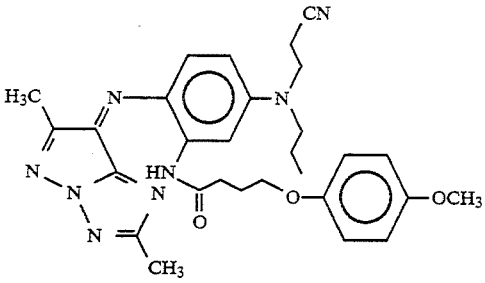
39.
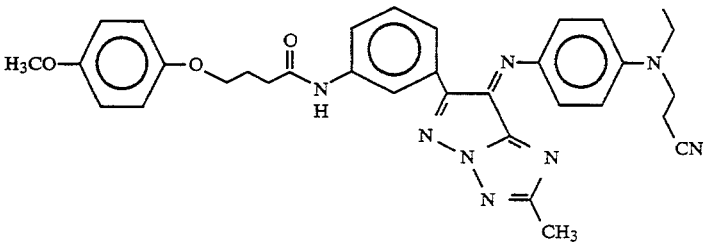

-continued
Illustrative Compounds
40.
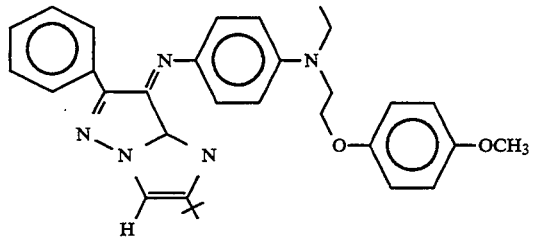
41.
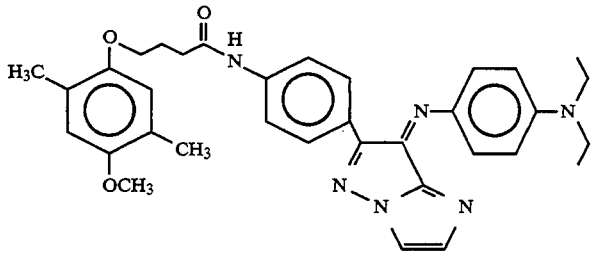
42.
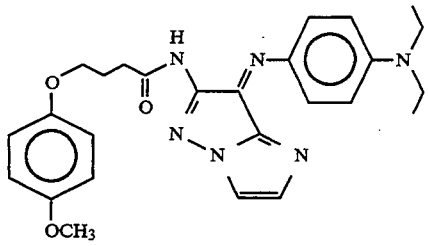
43.
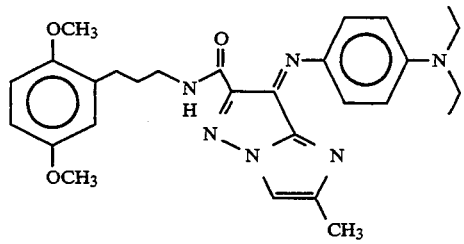
44.
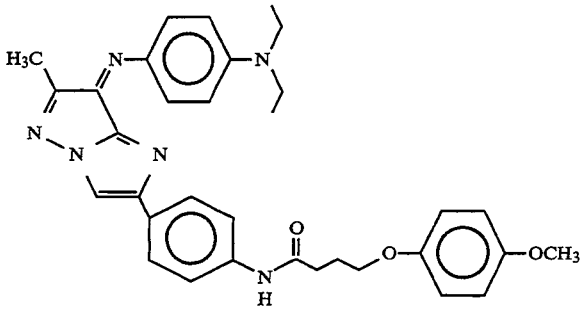
45.
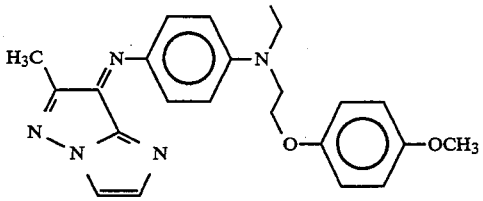
46.
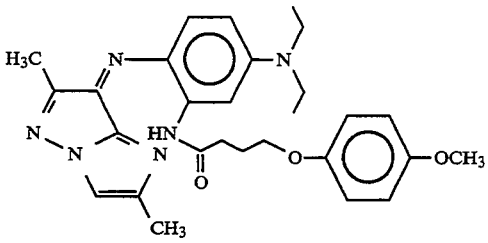
47.
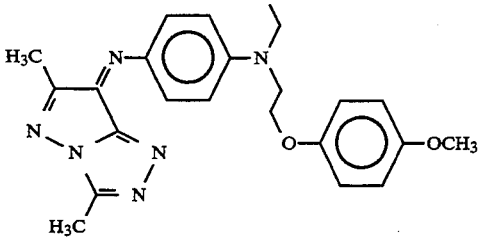
48.
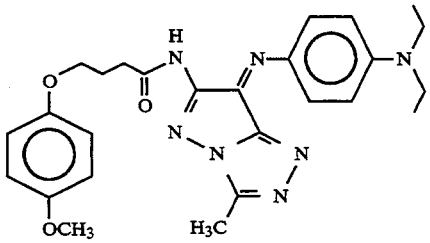

-continued
Illustrative Compounds
49.
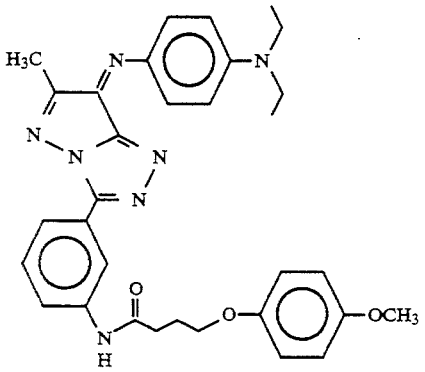
50.
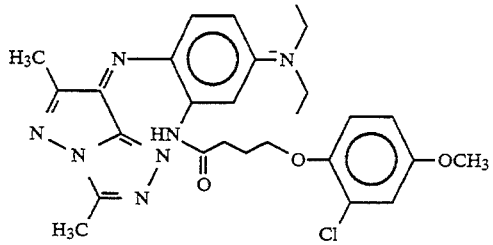
51.
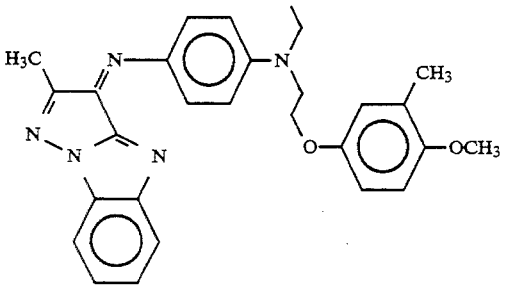
52.
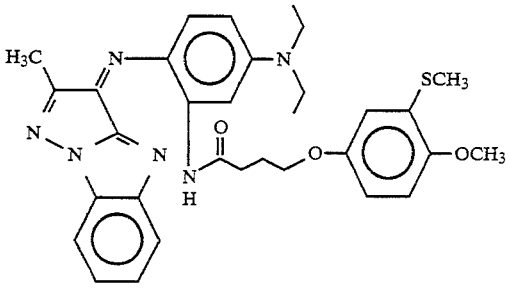
53.
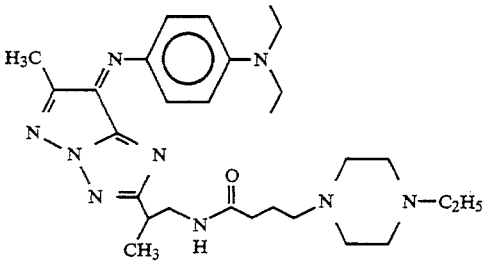
54.
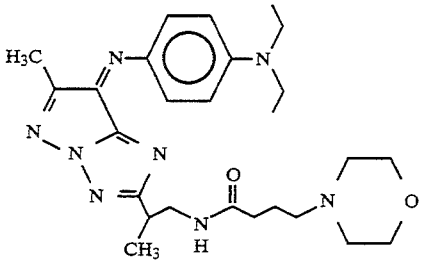
55.
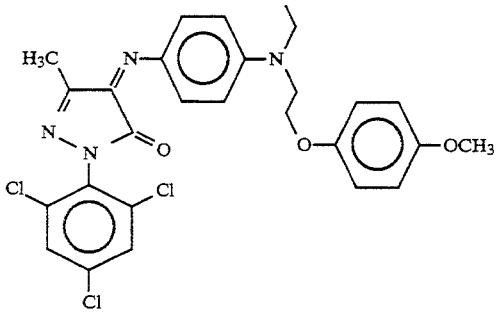
56.
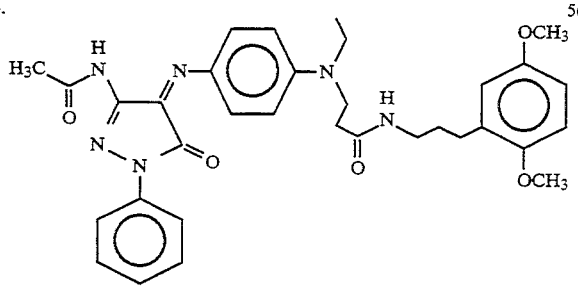
57.
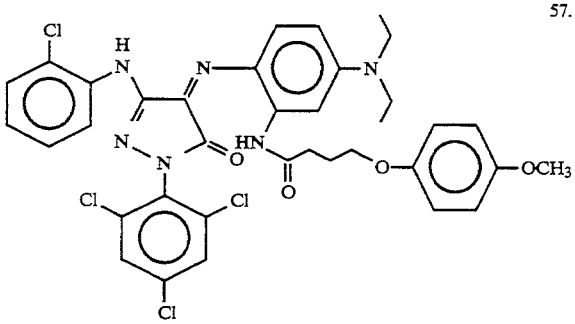
58.
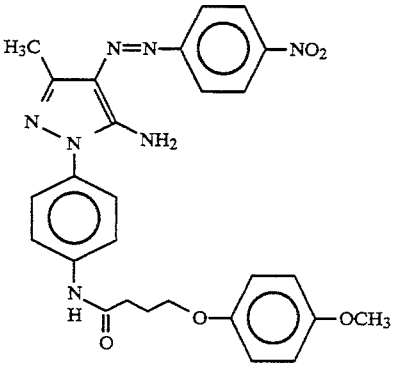

-continued
Illustrative Compounds
59.
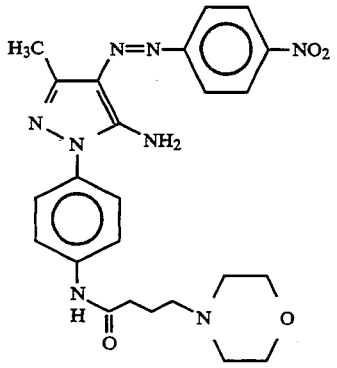
60.
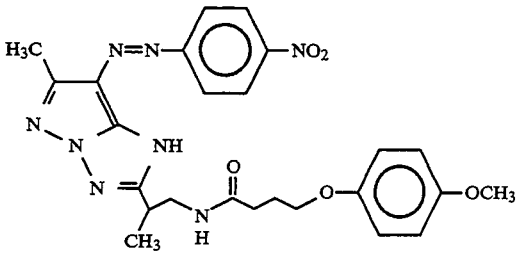
61.
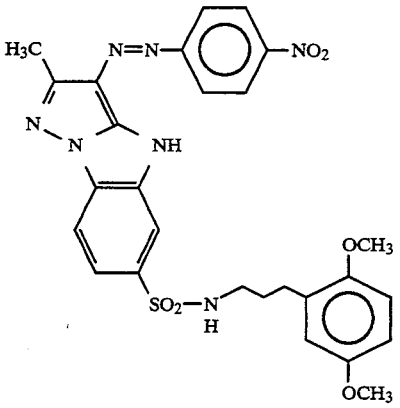
62.
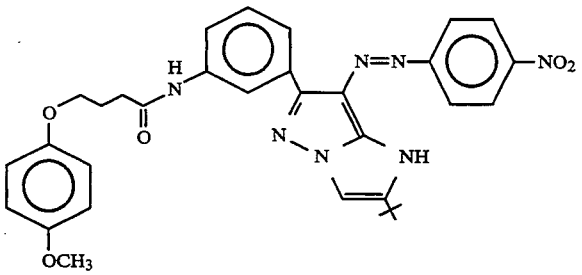
63.
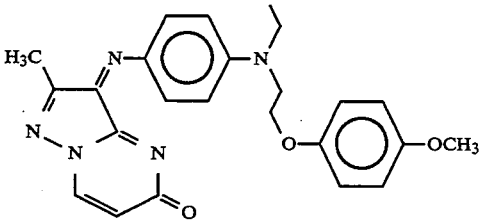
64.
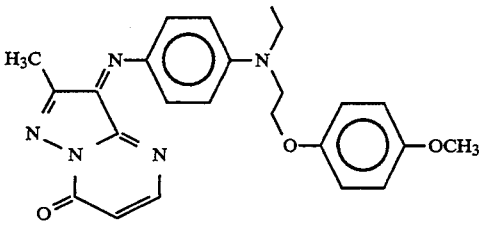

-continued
Illustrative Compounds
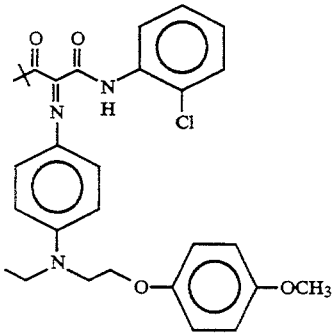
65.
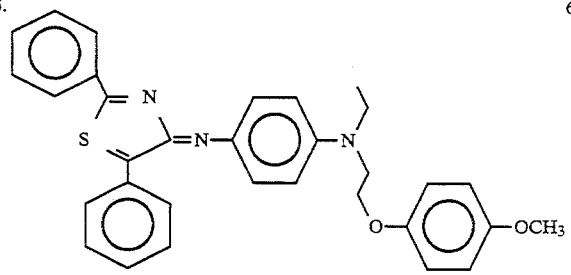
66.
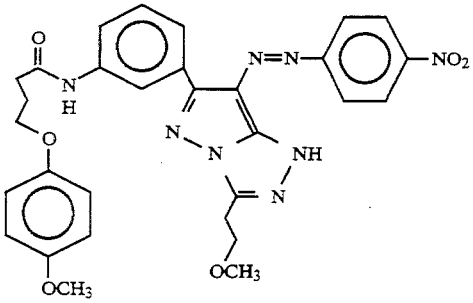
67.
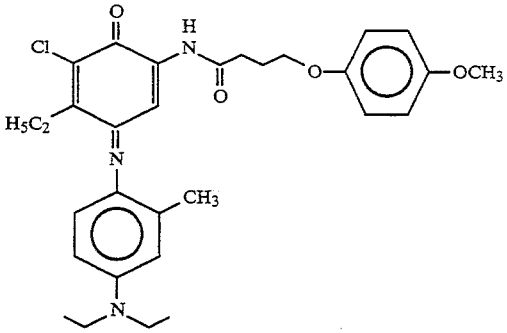
68.
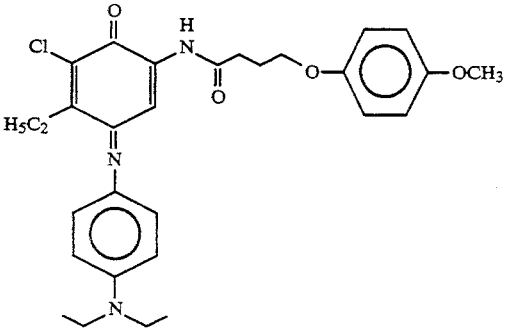
69.
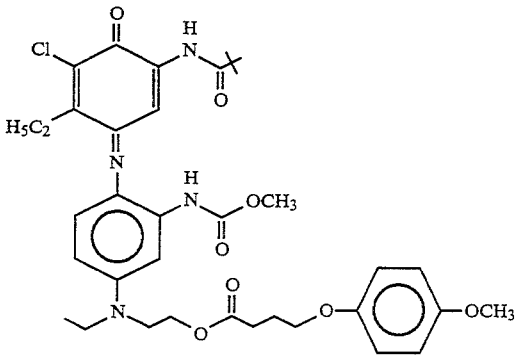
70.
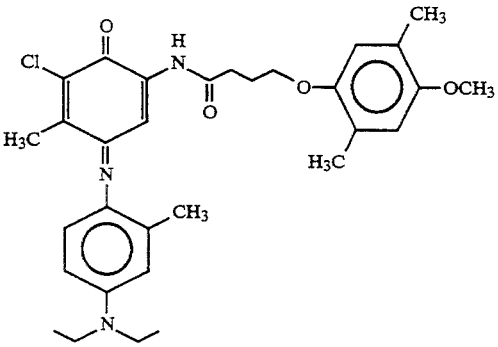
71.
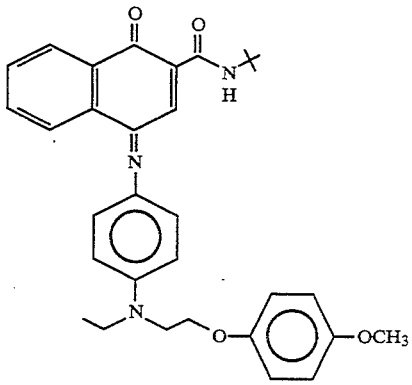
72.

-continued
Illustrative Compounds
73.
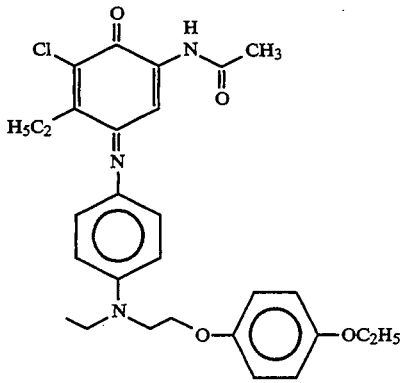
74.
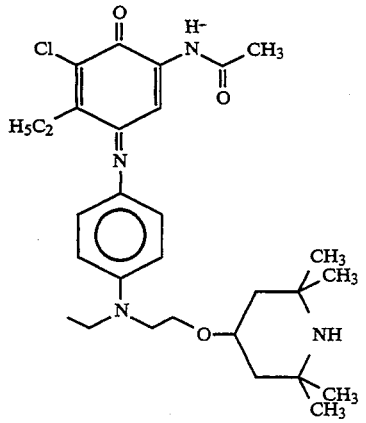
75.
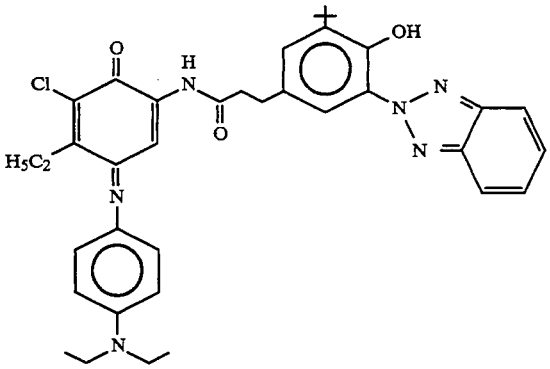
76.
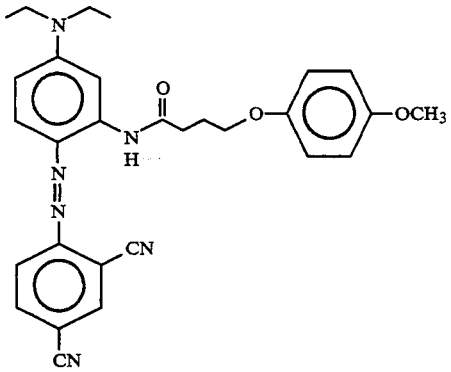
77.
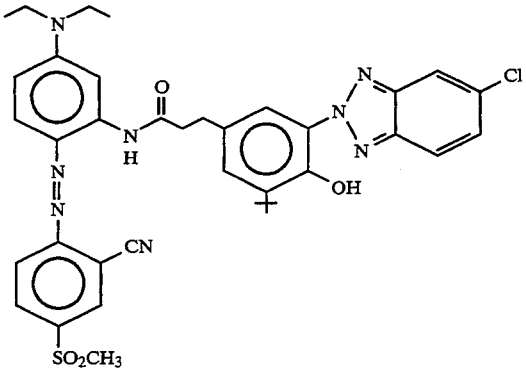
78.
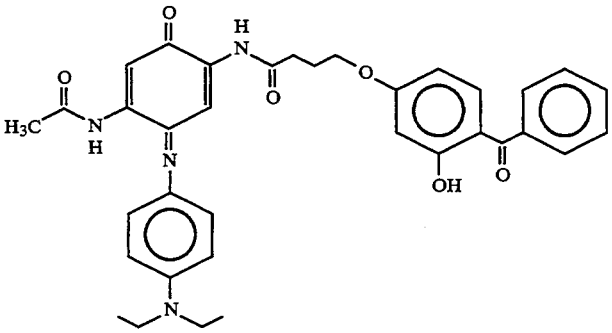

-continued
Illustrative Compounds
79.
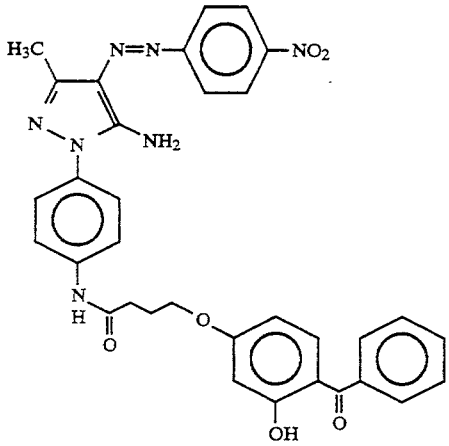
80.
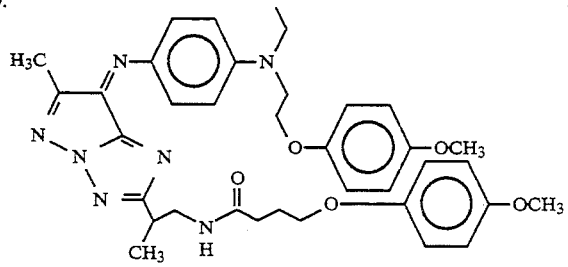
81.
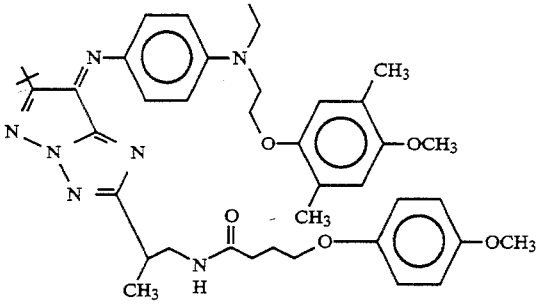
82.
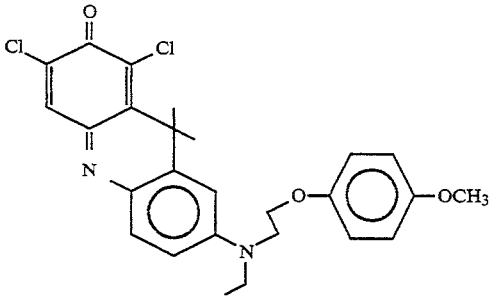
83.
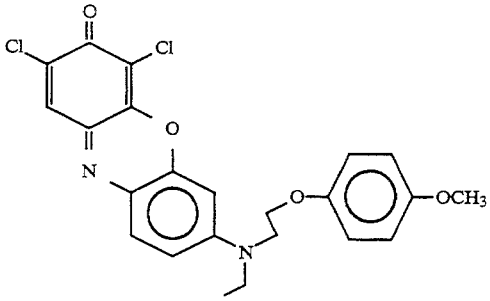
84.
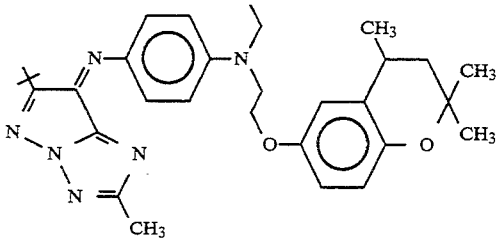
85.
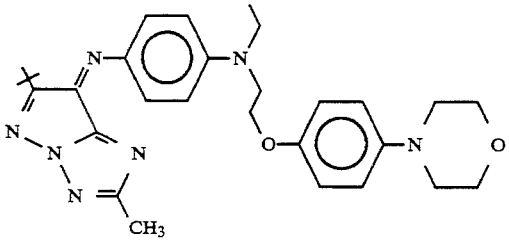
86.
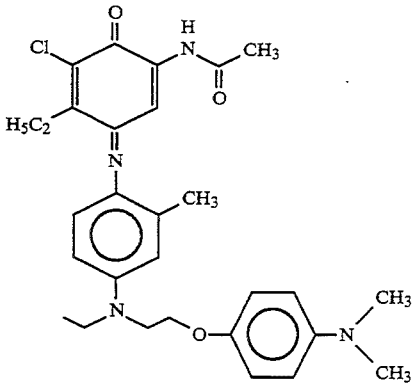

-continued
Illustrative Compounds
88.
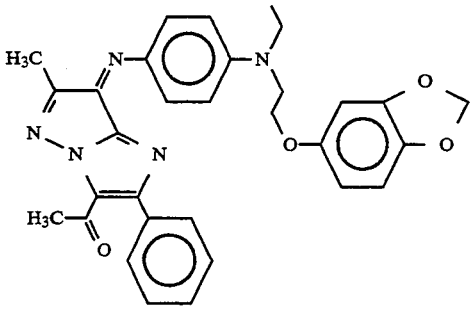
89.
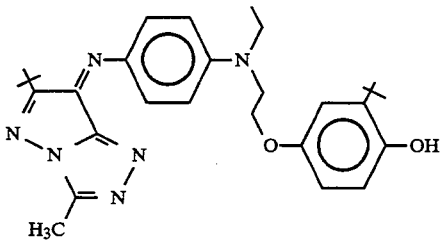
90.
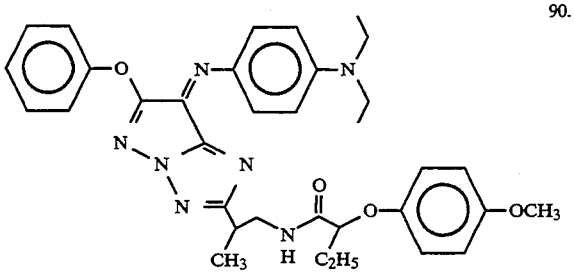
91.
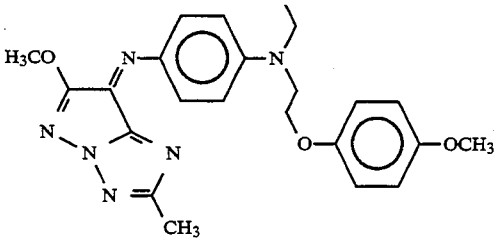
92.
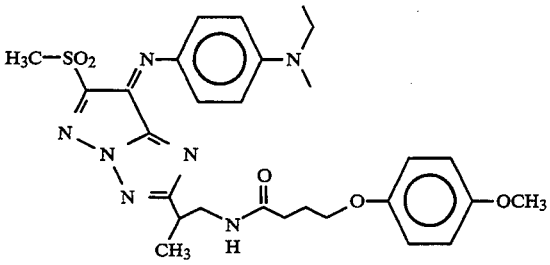
93.
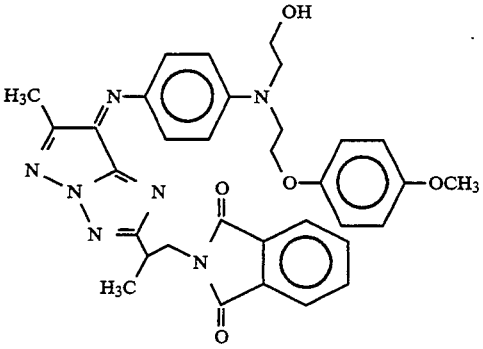
94.
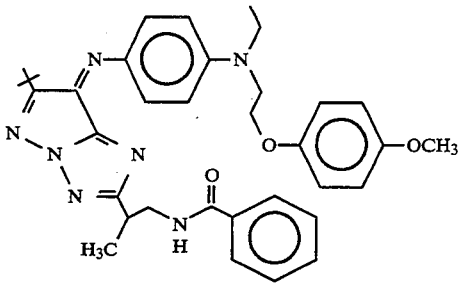
95.
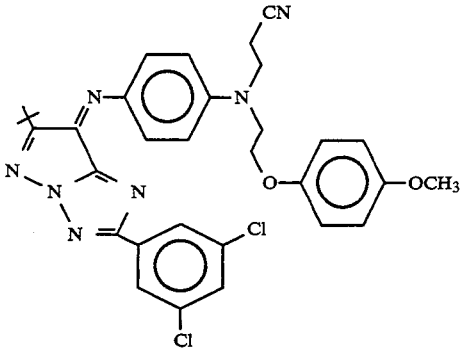
96.
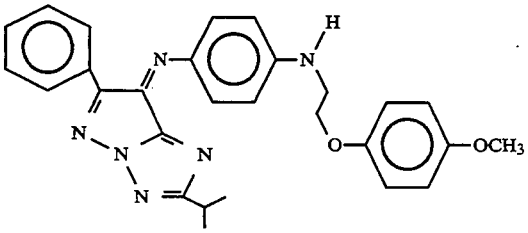
97.
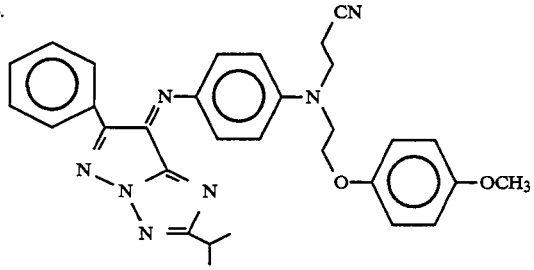

-continued
Illustrative Compounds
98.
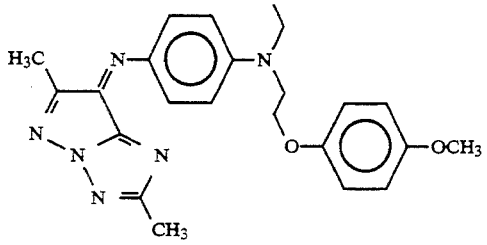
99.
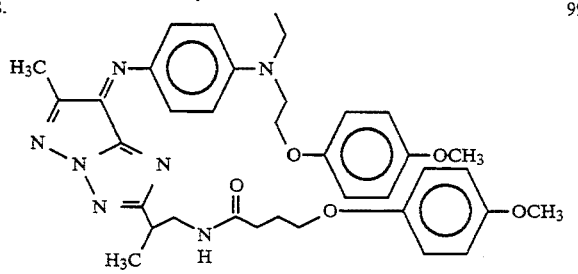
100.
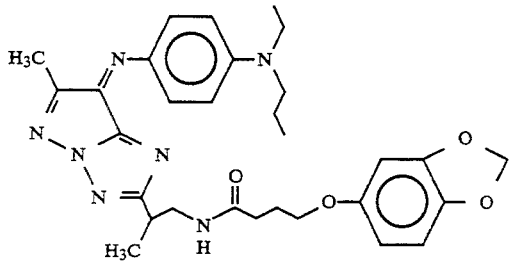
101.
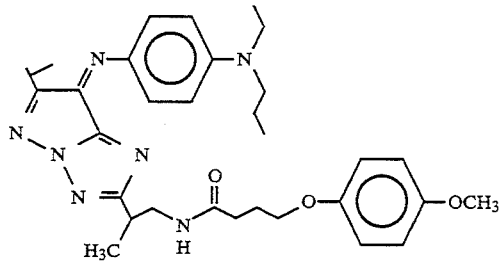
102.
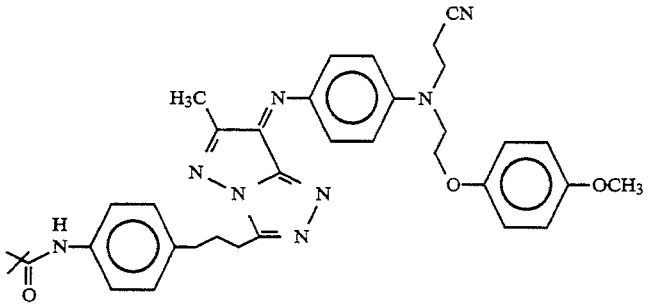
103.
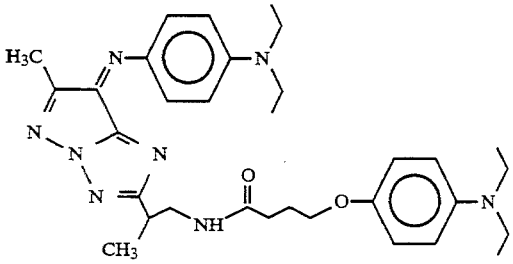
104.
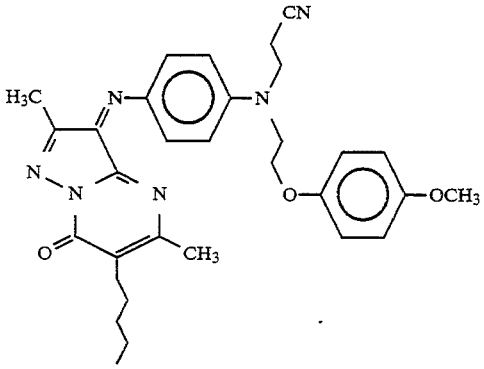
105.
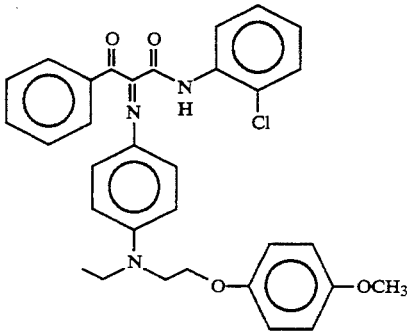
106.
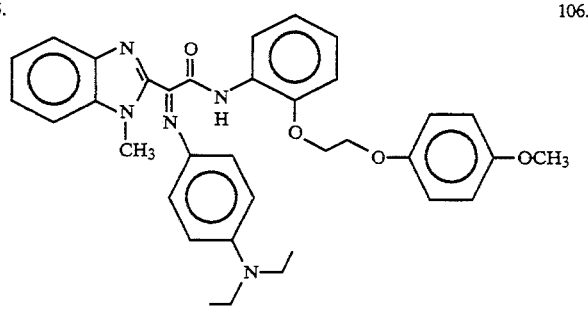

-continued
Illustrative Compounds
107.
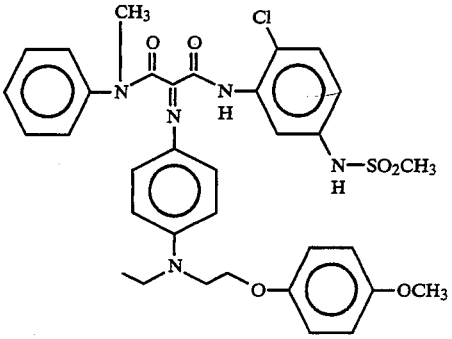
108.
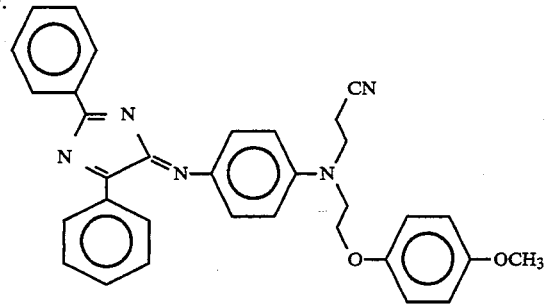
109.
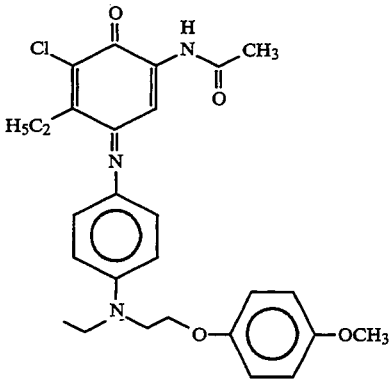
110.
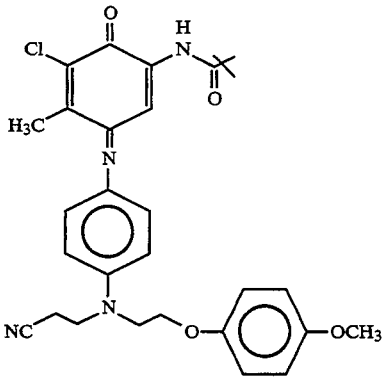
111.
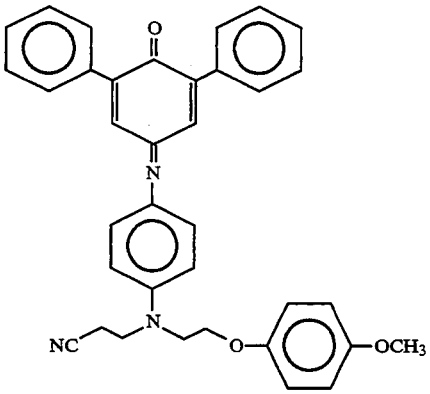
112.
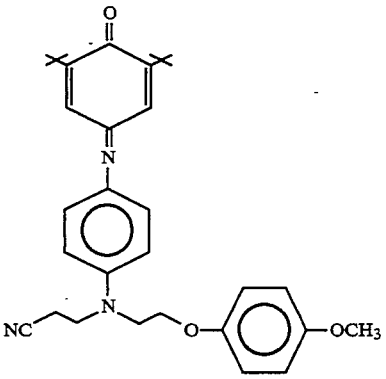
113.
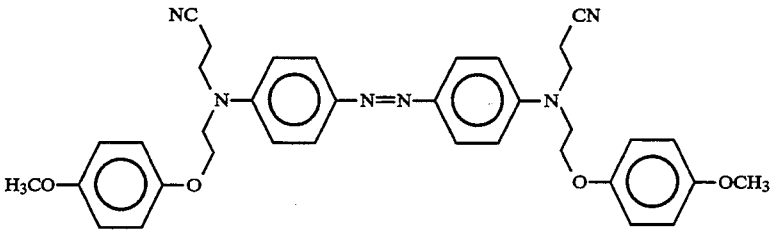

-continued
Illustrative Compounds
114.
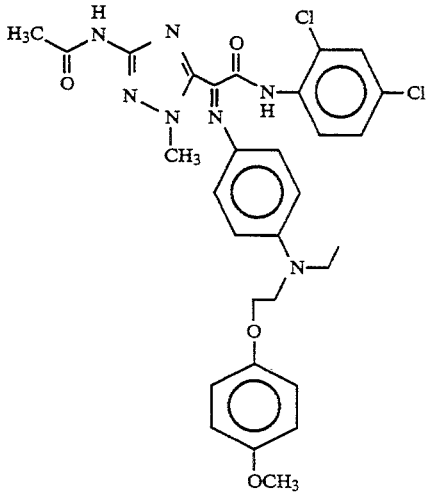
115.
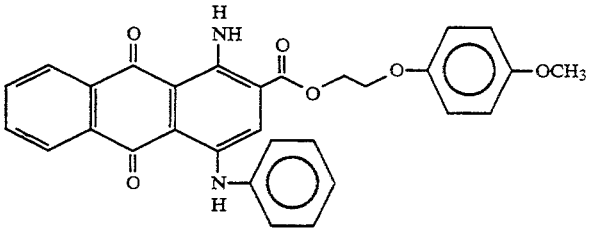
116.
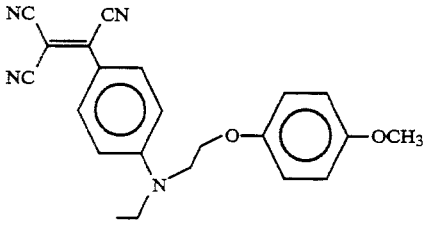
117.
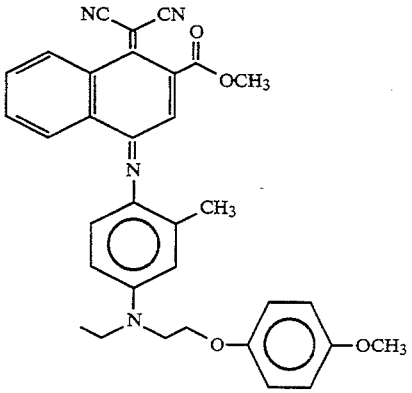
118.
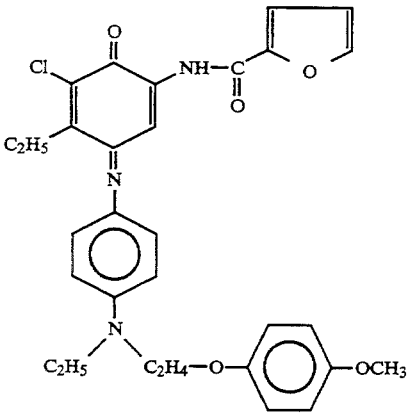
119.
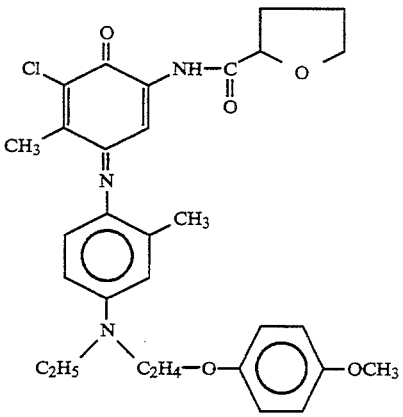

-continued
Illustrative Compounds
120.
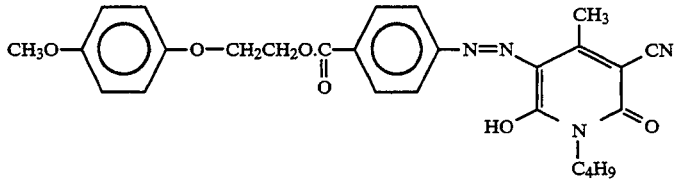
121.
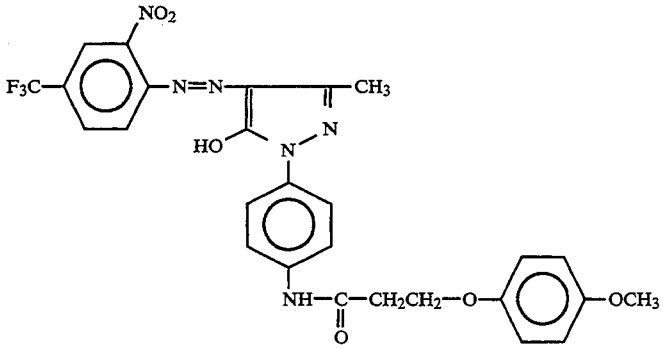
122.
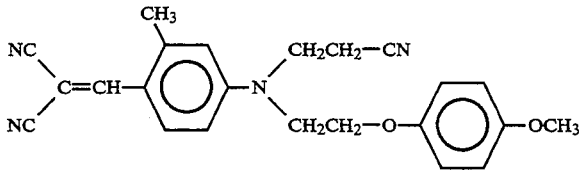
123.
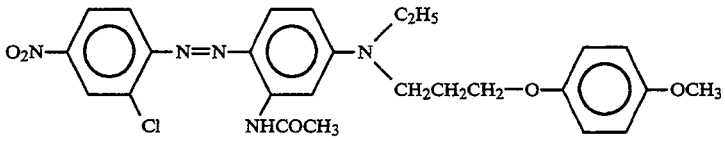
124.
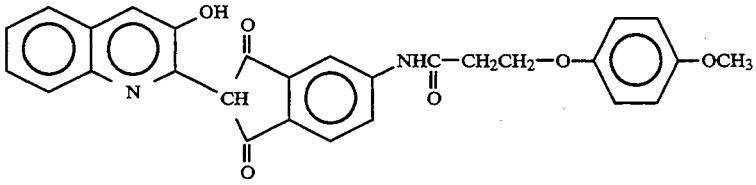
125.
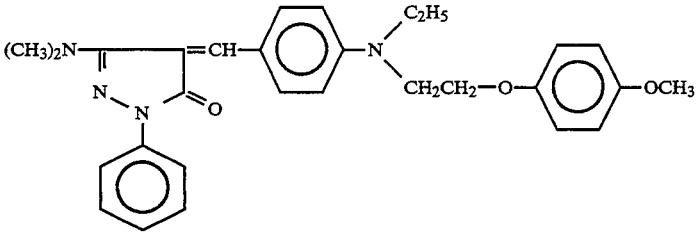
126.
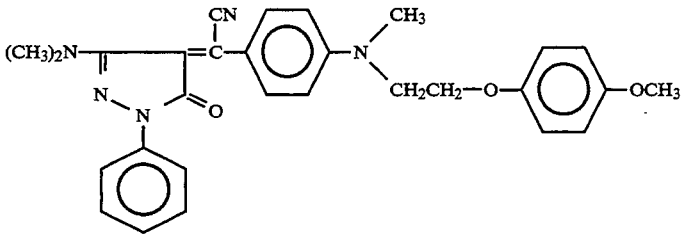

-continued
Illustrative Compounds
127.
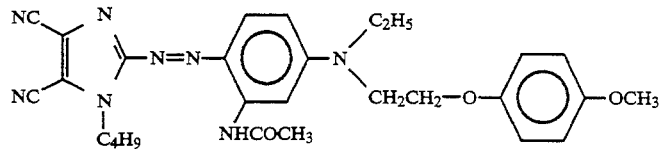
128.
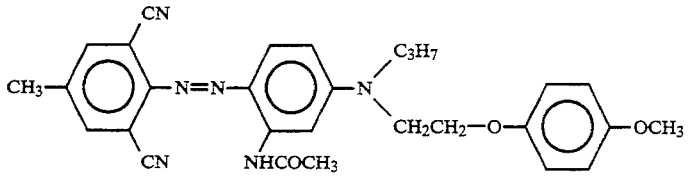
129.
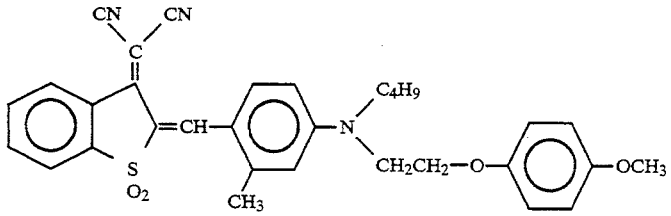
130.
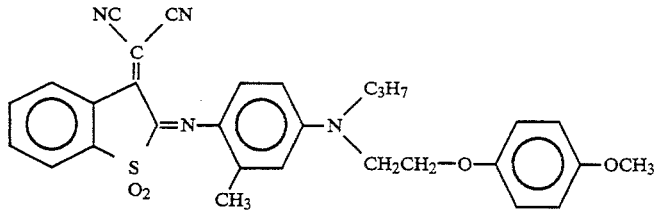
131.
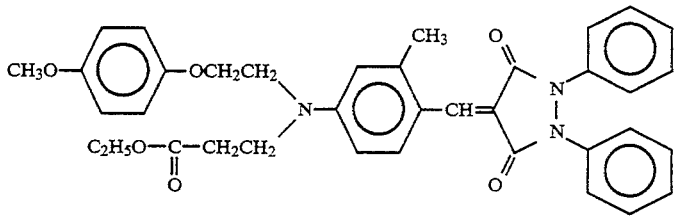
132.
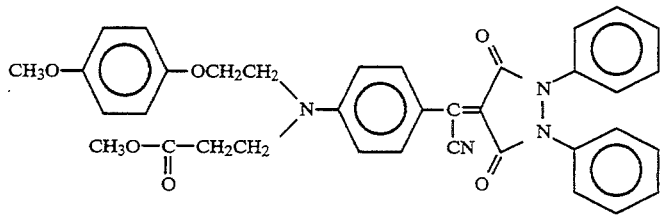
133.
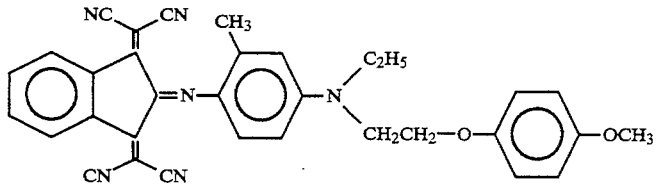
134.
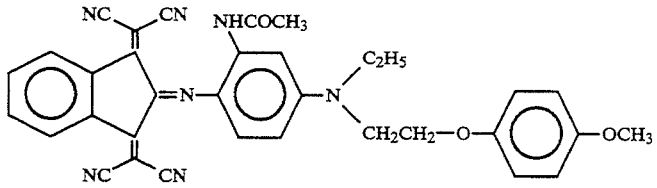

-continued
Illustrative Compounds
135.
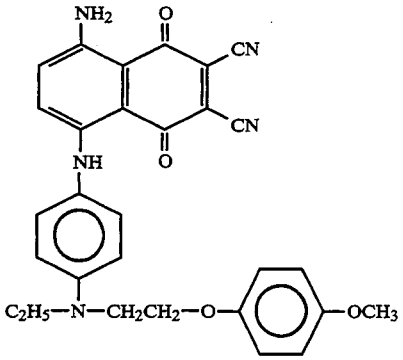
136.
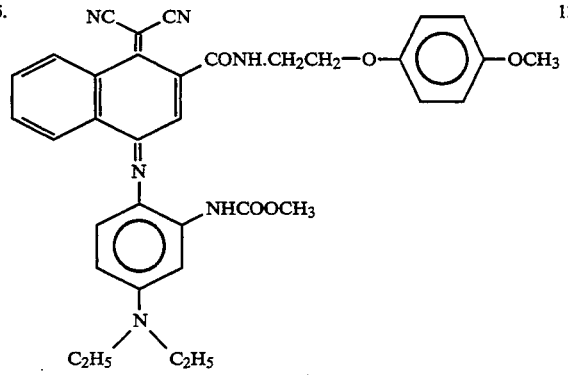
137.
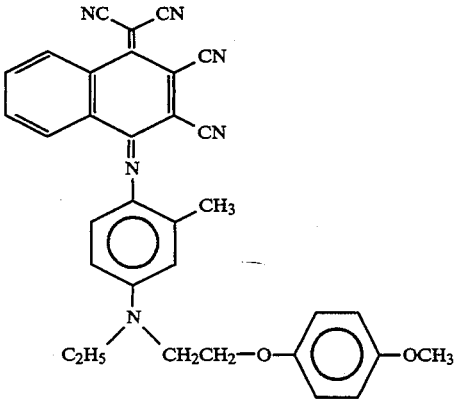
138.
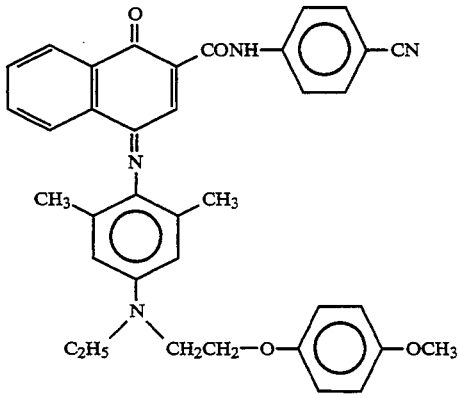
139.
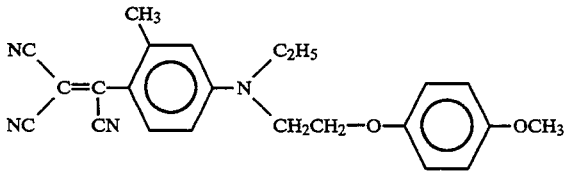
140.
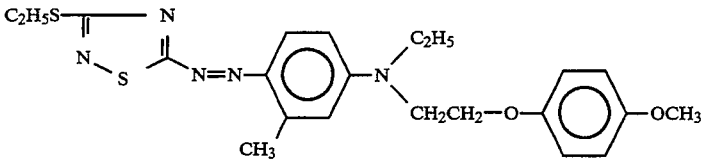
141.
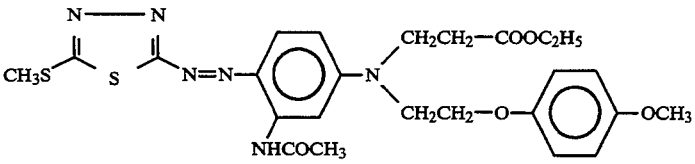
142.
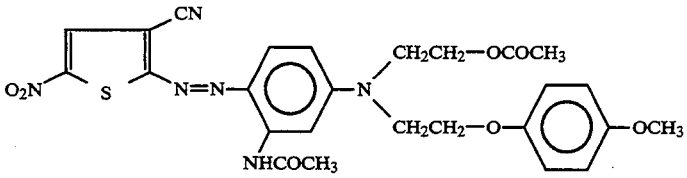

-continued
Illustrative Compounds
143.
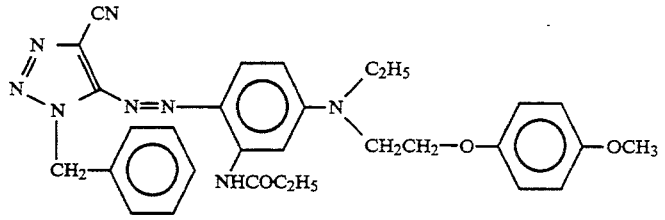
144.
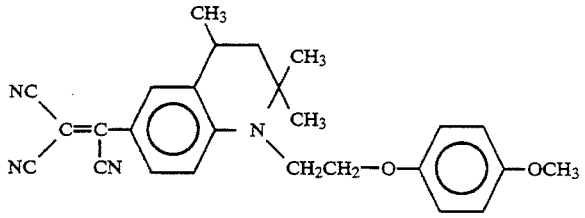
145.
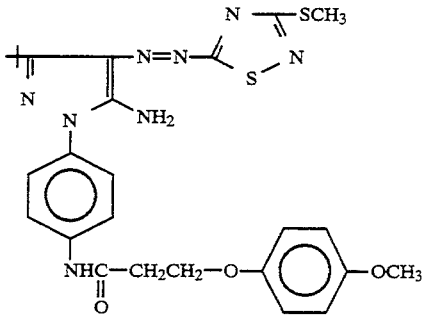
146.
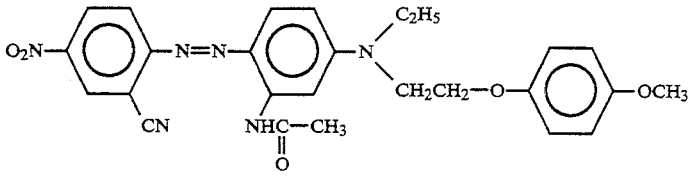
147.
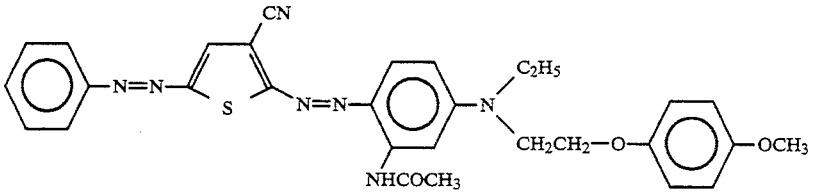
148.
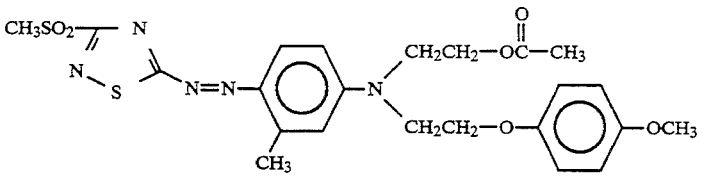
Synthesis Example 1
A method for the preparation of compounds represented by general formula (I) which can be used in this invention is described. The preparation is carried out via the following scheme:
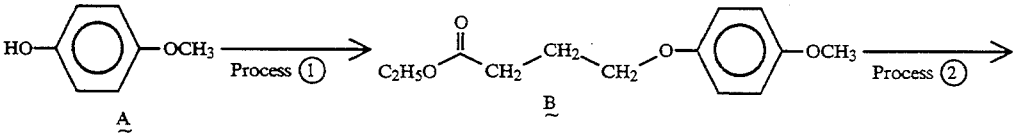

-continued

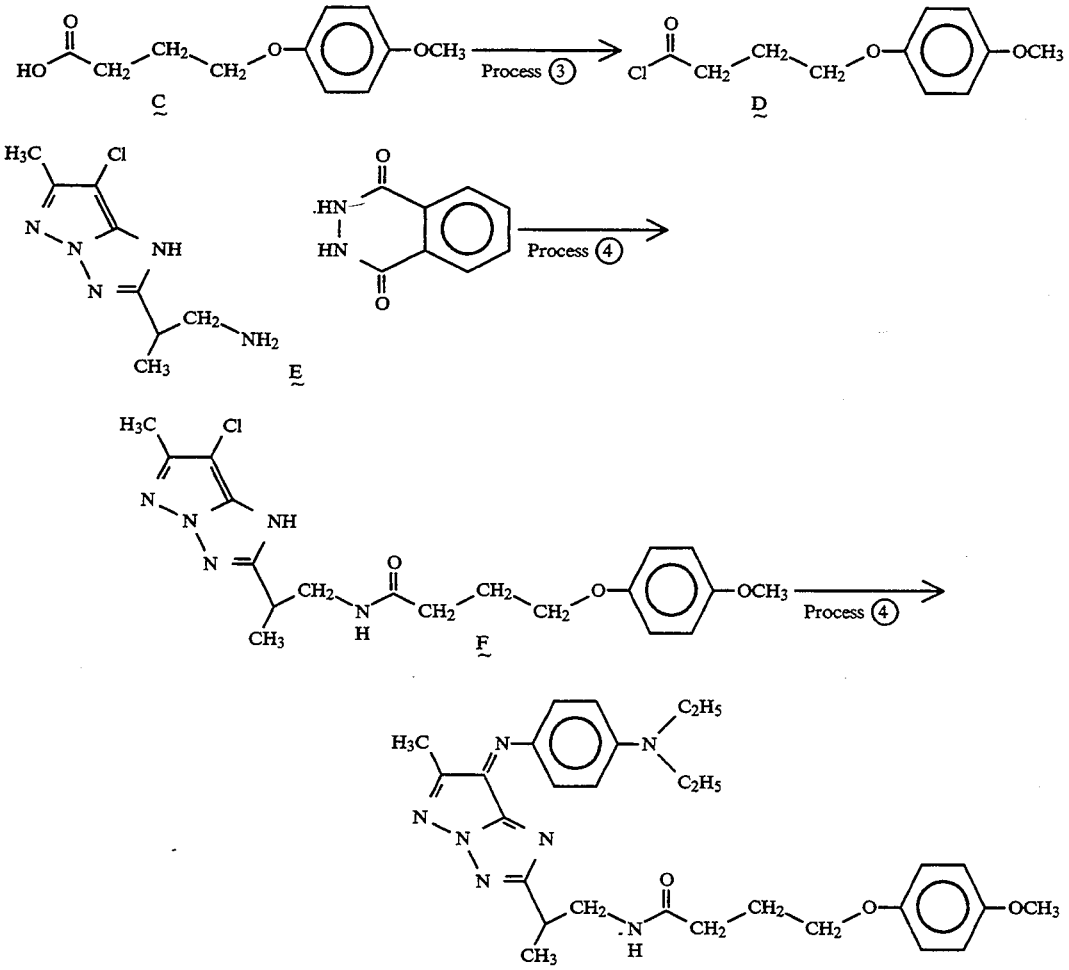

1) Preparation of Ethyl γ-(p-Methoxyphenoxy)butyrate (Process 1)

N,N-dimethylformamide (40.0 cc), 20.0 grams of p-methoxyphenol, 44.6 grams of potassium carbonate and 63.0 grams of ethyl γ-bromobutyrate were reacted for 3 hours at an internal temperature of 100° C.

Then, the reaction mixture was poured into 100 cc of water and extracted with ethyl acetate. The extract was washed with a saturated salt solution and dried over magnesium sulfate, after which the solvent was removed using a rotary evaporator and a crude product was obtained.

The crude product was refined using silica gel column chromatography (using a benzene: ethyl acetate based eluant) and ethyl γ-(p-methoxyphenoxy)butyrate was obtained. 36.2 grams (94.5%)

2) Preparation of Ethyl γ-(p-Methoxyphenoxy)butyric Acid (Process 2)

Methanol(40.0 cc), and 10.0 grams of ethyl γ-(p-methoxyphenoxy)butyrate were agitated with water cooling and a solution obtained by dissolving 10.0 grams of potassium hydroxide in 20.0 cc of water was poured in. Subsequently, the mixture was agitated for 30 minutes at an internal temperature of 40° C. After the reaction had been completed the reaction mixture was poured into 300 cc of water and the solution was adjusted to pH 2 by titration with concentrated hydrochloric acid. The white crystals which precipitated out were recovered by filtration, washed with water and then dried. 7.90 grams (90%).

3) Preparation of Ethyl γ-(p-Methoxyphenoxy)butyric Acid Chloride (Process 3)

Benzene (70.0 cc) and 14.0 grams of γ-(p-methoxyphenoxy)butyric acid were agitated with water cooling and 5.74 cc of thionyl chloride was added dropwise. Subsequently, the mixture was agitated for 10 minutes at an internal temperature of 60° C. After the reaction had been completed, the reaction mixture was cooled and transferred to a separate flask and the solvent and excess thionyl chloride were removed in a rotary evaporator. γ-(p-Methoxyphenoxy)butyric acid chloride was obtained as white crystals.

4) Preparation of Intermediate F (Process 4)

Compound E (25.2 grams), 50.0 cc of N,N-dimethylformamide and 150 cc of ethyl acetate were agitated with water cooling and all of the γ-(p-methoxyphenoxy)butyric acid chloride prepared in process 3 was added. Triethylamine was then added dropwise while maintaining the internal temperature below 30° C., after which the mixture was agitated for 30 minutes at room temperature.

Moreover, 1.0 cc of water was added and, after agitating for 5 minutes, the mixture was filtered and the filtrate was extracted with ethyl acetate. The extract was washed with a saturated salt solution and then dried over magnesium sulfate, the solvent was removed in a rotary evaporator and the intermediate F was obtained as a light brown powder. 15.0 grams (Total yield over processes 3 and 4, 55.3%)

5) Preparation of Compound (1) (Process 5)

Ethyl acetate (45 cc), 45 cc of isopropanol, 45 cc of methylene chloride and 1.5 grams of intermediate F were agitated with water cooling and a solution obtained by dissolving 2.35 grams of sodium carbonate in 45 cc of water was added. Moreover, 1.5 grams of p-amino-N,N-diethylaniline sulfate was added. Subsequently, a solution obtained by dissolving 1.4 grams of ammonium persulfate in 10 cc of water was added and the mixture was agitated for 30 minutes at room temperature.

After the reaction had been completed, the mixture was extracted with ethyl acetate and the extract was washed with a saturated salt solution and dried over sodium sulfate, after which the solvent was removed in a rotary evaporator and a crude product was obtained.

The crude product was refined using silica gel column chromatography (chloroform/methanol based eluant) and a refined target product was obtained. (1.0 gram, 50.9%) Melting point 130°-131° C.

Synthesis Example 2

Preparation of Compound (2)

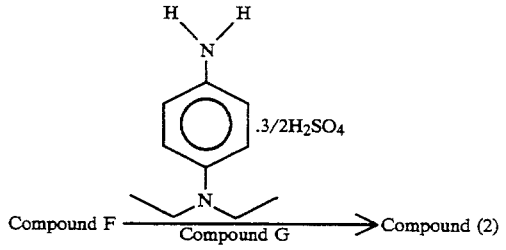

Compound F (1.5 grams), 45 ml of ethyl acetate and 45 ml of ethanol were agitated and 2.4 grams of sodium carbonate dissolved in 45 ml of water was added. Ammonium persulfate (1.4 grams) dissolved in 10 ml of water was then added and the mixture was reacted at 20° C. for one hour. Thereafter, the reaction mixture was extracted with ethyl acetate and the organic layer was washed with water twice and dried over magnesium sulfate, followed by filtration. The solvent was evaporated off in vacuo. The crude product was refined using silica gel column chromatography and recrystallized from methanol to obtain 1.0 gram (yield: 49.6%) of Compound (2).

$\lambda_{max}$: 536 nm (in ethyl acetate)

$\epsilon_{max}$: $5.84\times10^4$ l.mol$^{-1}$.cm$^{-1}$ m.p.: 153° to 154° C.

Synthesis Example 3

Preparation of Compound (3)

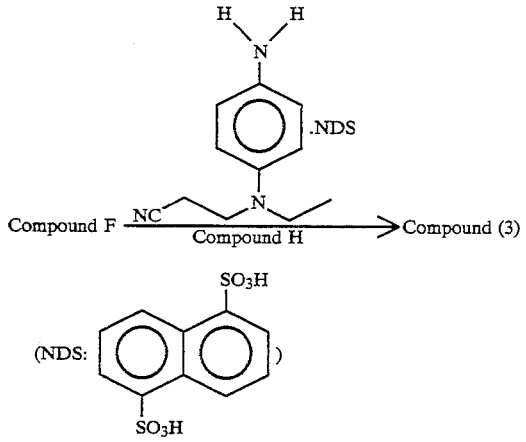

Using 1.5 grams of Compound F, 45 ml of ethyl acetate, 45 ml of ethanol, 55 ml of water, 2.4 grams of sodium carbonate and 1.4 grams of ammonium persulfate, the same procedures as in Synthesis Example 2 were repeated to obtain 0.6 gram (yield: 29.2%) of Compound (3).

$\lambda_{max}$: 511 nm (in ethyl acetate)

$\epsilon_{max}$: $4.67\times10^4$ l.mol$^{-1}$.cm$^{-1}$ m.p.: 127° to 128° C.

Synthesis Example 4

Preparation of Compound (93).

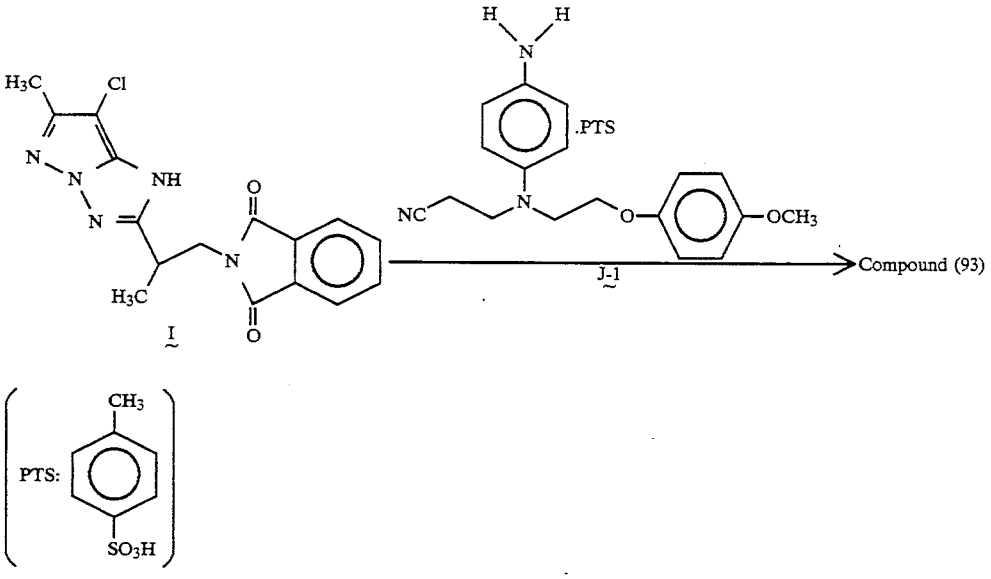

Compound I (20 grams), 36.6 grams of Compound J-I, 38.6 grams of triethylamine and 800 ml of methylene chloride were agitated at room temperature and 13.5 grams of N-bromosuccimide was added. After reacting for one hour, 2.0 l of water was poured into the reaction mixture, and the mixture was agitated for 15 minutes and extracted with ethyl acetate. The reaction mixture was washed with water twice and dried over magnesium sulfate, followed by filtration. The solvent was evaporated off in vacuo. The residue was refined using silica gel column chromatography (hexane/ethyl acetate (1:1) eluant) and recrystallized from methanol to obtain 15.0 grams (yield: 41.8%) of Compound (93).

$\lambda_{max}$: 504 nm (in ethyl acetate)

$\epsilon_{max}$: $4,45\times10^4$ l.mol$^{-1}$.cm$^{-1}$ m.p.: 188° to 190° C.

Synthesis Example 5

Preparation of Compound (94)

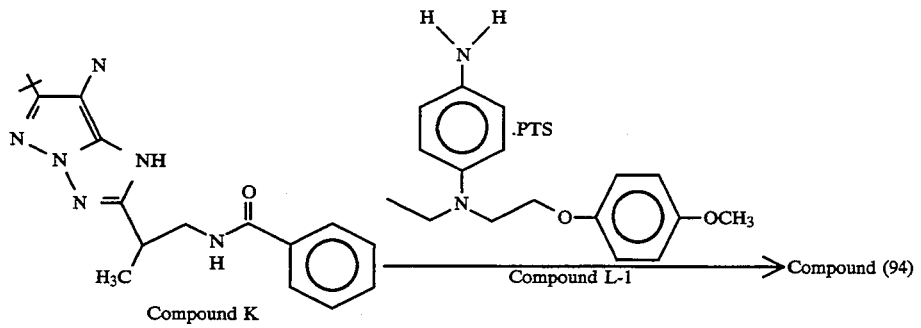

Using Compound K, 200 ml of ethyl acetate, 20 ml of isopropanol, 145 g of potassium carbonate, 160 ml of water, 25 g of Compound L-1 and 37.8 grams of ammonium persulfate, the same procedures as in Synthesis Example 2 were repeated to obtain 15.0 grams (yield: 32.1%) of Compound (94).

$\lambda_{max}$: 524 nm (in ethyl acetate)

$\epsilon_{max}$: $4.90\times10^4$ l.mol$^{-1}$.cm$^{-1}$ m.p.: amorphous state and showing no definite melting point Synthesis Example 6

Preparation of Compound (95)

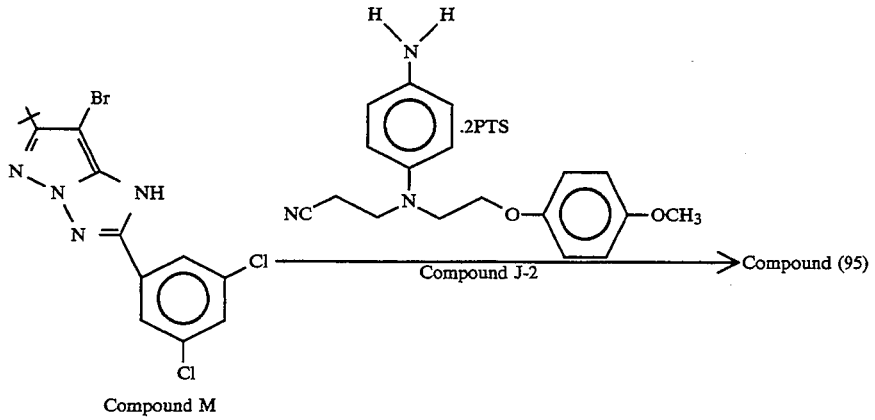

Using 1.0 gram of Compound M, 10 ml of ethyl acetate, 10 ml of ethanol, 12 ml of water, 2.1 grams of potassium carbonate, 2.1 grams of Compound J-2 and 1.4 grams of ammonium persulfate, the same procedures as in Synthesis Example 2 were repeated to obtain 0.3 gram (yield: 18.9%) of Compound (95).

$\lambda_{max}$: 520 nm (in ethyl acetate)

$\epsilon_{max}$: $4.69\times10^4$ l.mol$^{-1}$.cm$^{-1}$ m.p.: 201° to 202° C.

Synthesis Example 7

Preparation of Compound (96)

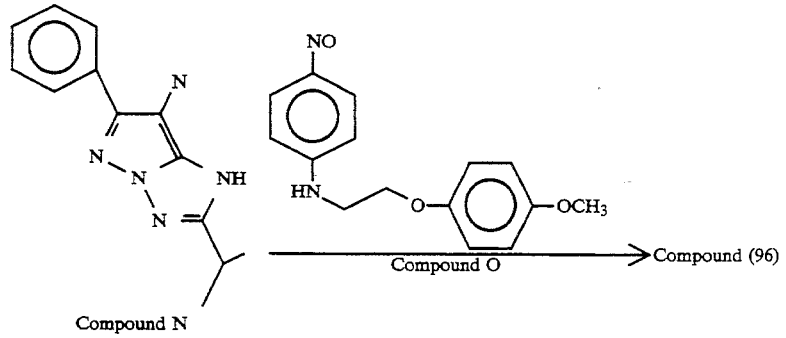

Compound N (6.7 grams), 8.3 grams of Compound O and 160 ml of ethanol were agitated at room temperature and 4.6 grams of acetic anhydride was added dropwise. The mixture was reacted for 30 minutes and the reaction mixture was poured into water. The resulting mixture was extracted with ethyl acetate, and the organic layer was washed with water twice and dried, followed by filtration. The solvent was evaporated off in vacuo and the crude product was recrystallized from methanol to obtain 1.3 grams (yield: 26.7%) of Compound (96).

$\lambda_{max}$: 524 nm (in ethyl acetate)

$\epsilon_{max}$: $4.69\times10^4$ l.mol$^{-1}$.cm$^{-1}$ m.p.: 149° to 151° C.

Synthesis Example 8

Preparation of Compound (97)

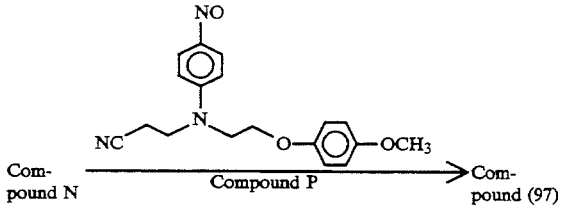

Compound N (6.0 grams), 8.7 grams of Compound P and 120 ml of ethanol were agitated at room temperature and 4.2 grams of acetic anhydride was added dropwise. The mixture was reacted for 30 minutes and the reaction mixture was poured into water. The resulting mixture was extracted with ethyl acetate and dried over magnesium sulfate, followed by filtration. The solvent was evaporated off and the crude product was refined by silica gel column chromatography (hexane/ethyl acetate (2/1) eluant). The solvent was evaporated off and the residue was evaporated to dryness to obtain 8.0 grams (yield: 56%) of Compound (97).

$\lambda_{max}$: 524 nm (in ethyl acetate)

$\epsilon_{max}$: $4.33\times10^4$ l.mol$^{-1}$.cm$^{-1}$ m.p.: amorphous state and gummy at 60° C. and showing no definite melting point Synthesis Example 9

Preparation of Compound (98)

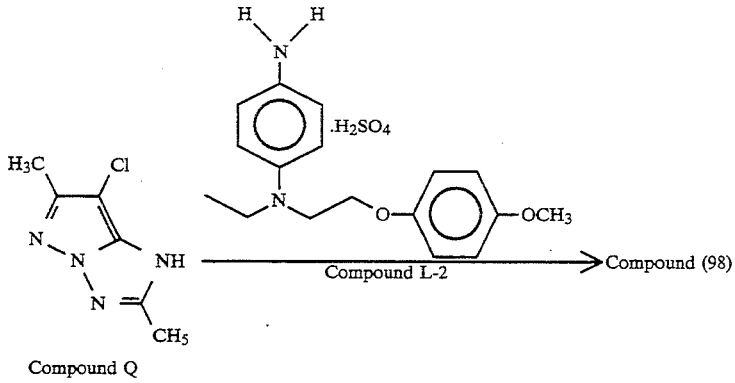

Using 1.0 gram of Compound Q, 20 ml of ethyl acetate, 20 ml of ethanol, 24 ml of water, 3.7 grams of sodium carbonate, 3.4 grams of Compound L-2 and 2.6 grams of ammonium persulfate, the same procedures as in Synthesis Example 2 were repeated to obtain 1.2 grams (yield: 49.0%) of Compound (98).

$\lambda_{max}$: 518 nm (in ethyl acetate)

$\epsilon_{max}$: $4.95\times10^4$ l.mol$^{-1}$.cm$^{-1}$ m.p.: 97° to 98° C.

Synthesis Example 10

Preparation of Compound (99)

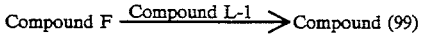

Using 2.4 grams of Compound F, 20 ml of ethyl acetate, 20 ml of ethanol, 30 ml of water, 4.1 grams of sodium carbonate, 3.0 grams of Compound L-1 and 4.3 grams of ammonium persulfate, the same procedures as in Synthesis Example 2 were repeated to obtain 2.0 grams (yield: 47.0%) of Compound (99).

$\lambda_{max}$: 522 nm (in ethyl acetate)

$\epsilon_{max}$: $5.50\times10^4$ l.mol$^{-1}$.cm$^{-1}$ m.p.: 142° to 143° C.

Synthesis Example 11

Preparation of Compound (100)

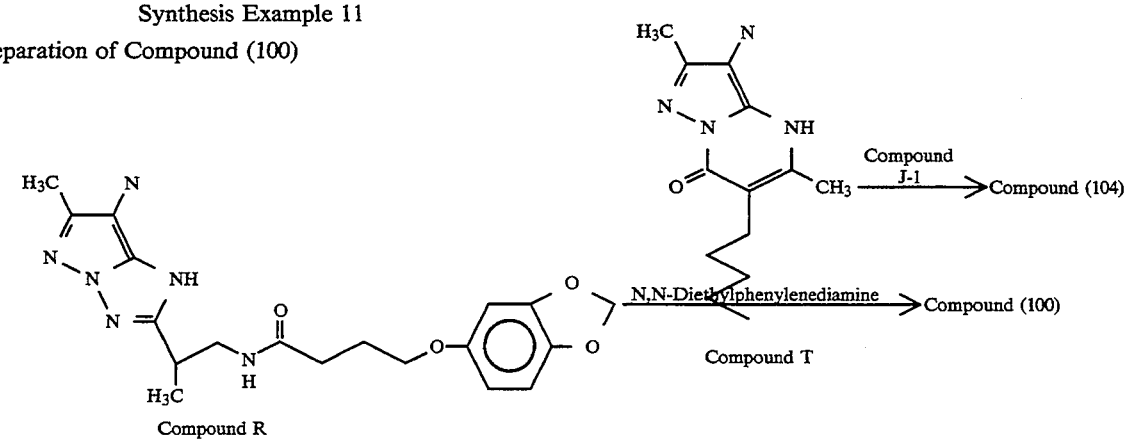

Compound R could be prepared in a good yield using

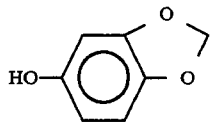

in the same manner as in Synthesis Example 1.

Then, using 1.0 gram of Compound R, 10 ml of ethyl acetate, 10 ml of ethanol, 12 ml of water, 2.1 grams of potassium carbonate, 1.0 gram of N,N-diethyl-p-phenylenediamine sulfate and 1.1 grams of ammonium persulfate, the same procedures as in Synthesis Example 2 were repeated to obtain 0.60 gram (yield: 44.4%) of Compound (100).

$\lambda_{max}$: 528 nm (in ethyl acetate)

$\epsilon_{max}$: $5.30\times10^4$ l.mol$^{-1}$.cm$^{-1}$ *m.p.*: 145° to 147° C.

Synthesis Example 12

Preparation of Compound (102)

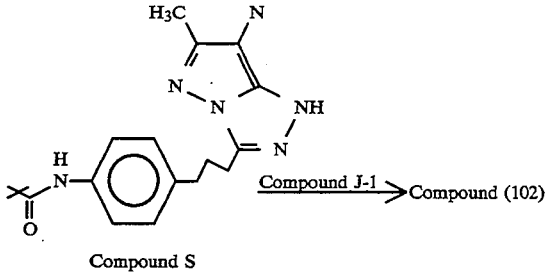

Using 2.0 grams of Compound S, 80 ml of ethyl acetate, 20 ml of ethanol, 80 ml of methylene chloride, 80 ml of water, 4.9 grams of sodium carbonate, 3.4 grams of Compound J-1 and 4.2 grams of sodium persulfate, the same procedures as in Synthesis Example 2 were repeated to obtain 1.4 grams (yield: 36.7%) of Compound (102).

$\lambda_{max}$: 496 nm (in ethyl acetate)

$\epsilon_{max}$: $3.57\times10^4$ l.mol$^{-1}$.cm$^{-1}$ m.p.: 149° to 150° C.

Synthesis Example 13

Preparation of Compound (104)

Using 1.5 grams of Compound T, 40 ml of ethyl acetate, 40 ml of ethanol, 44 ml of water, 20 ml of methylene chloride, 4.7 grams of sodium carbonate, 3.3 grams of Compound J-1 and 2.7 g of sodium persulfate, the same procedures as in Synthesis Example 2 to obtain 1.2 grams (yield: 39.2%) of Compound (104).

$\lambda_{max}$: 546 nm (in ethyl acetate)

$\epsilon_{max}$: $3.57\times10^4$ l.mol$^{-1}$.cm$^{-1}$ m.p.: 198° to 199° C.

Synthesis Example 14

Preparation of Compound (108)

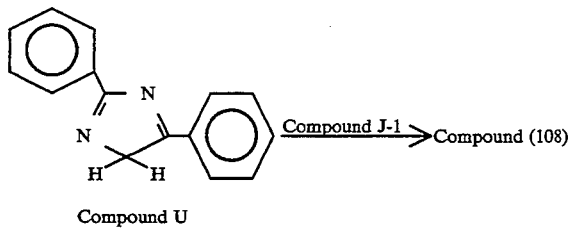

Using 1.0 gram of Compound U, 4.5 grams of Compound J-1, 40 ml of methylene chloride, 2.3 grams of triethylamine and 2.1 grams of N-bromosuccinimide, the same procedures as in Synthesis Example 4 were repeated to obtain 0.9 gram (yield: 37.5%) of Compound (108).

$\lambda_{max}$: 576 nm (in ethyl acetate)

$\epsilon_{max}$: $4.09\times10^4$ l.mol$^{-1}$.cm$^{-1}$ m.p.: loosely gummy at 106° to 115° C.

Synthesis Example 15

Preparation of Compound (109)

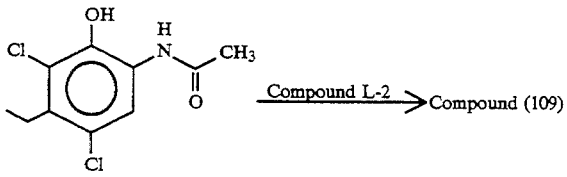

Compound V

Using 1.0 gram of Compound V, 20 ml of ethyl acetate, 20 ml of ethanol, 24 ml of water, 2.6 grams of sodium carbonate, 2.3 grams of Compound L-2 and 1.8 grams of ammonium persulfate, the same procedures as in Synthesis Example 2 were repeated to obtain 0.60 gram (yield: 29.9%) of Compound (109).

$\lambda_{max}$: 619 nm (in ethyl acetate)

$\epsilon_{max}$: $2.55\times10^4$ l.mol$^{-1}$.cm$^{-1}$ m.p.: 129° to 131° C.

Synthesis Example 16

Preparation of Compound (110)

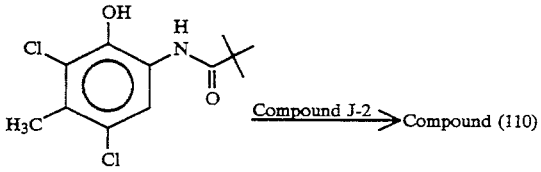

Compound W

Using 2.0 grams of Compound W, 7.1 grams of Compound J-2, 80 ml of methylene chloride, 4.8 grams of triethylamine and 1.7 grams of N-bromosuccinimide, the same procedures as in Synthesis Example 4 were repeated to obtain 2.2 grams (yield: 55.4%) of Compound (110). While it was attempted to recrystallize the product, no crystal was formed.

$\lambda_{max}$: 603 nm (in ethyl acetate)

$\epsilon_{max}$: $1.92\times10^4$ l.mol$^{-1}$.cm$^{-1}$ m.p.: gummy at ambient temperature Synthesis Example 17

Preparation of Compound (111)

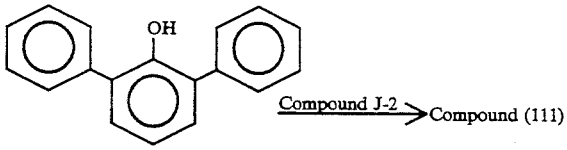

Compound X

Using 2.0 grams of Compound X, 5.1 grams of Compound J-2, 80 ml of methylene chloride, 5.4 grams of triethylamine and 3.8 grams of N-bromosuccinimide, the same procedures as in Synthesis Example 4 were repeated to obtain 1.8 grams (yield: 40.2%) of Compound (111).

$\lambda_{max}$: 582 nm (in ethyl acetate)

$\epsilon_{max}$: $1.04\times10^4$ l.mol$^{-1}$.cm$^{-1}$ m.p.: amorphour and gummy at 70° C. and showing no definite melting point Synthesis Example 18

Preparation of Compound (112)

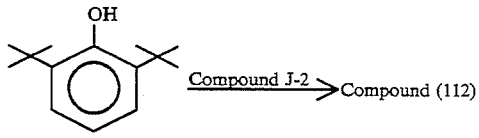

Compound Y

Using 2.0 grams of Compound Y, 6.1 grams of Compound J-2, 80 ml of methylene chloride, 6.5 ml of triethylamine and 3.5 grams of N-bromosuccinimide, the same procedures as in Synthesis Example 4 were repeated to obtain 2.0 grams (yield: 40.0%) of Compound (112). While it was attempted to recrystallize the product, no crystal was formed.

$\lambda_{max}$: 545 nm (in ethyl acetate)

$\epsilon_{max}$: $1.58\times10^4$ l.mol$^{-1}$.cm$^{-1}$ m.p.: gummy at ambient temperature Synthesis Example 19

Preparation of Compound (113)

Compound (113) was repeated as a by-product in the preparation of Compound (97) and isolated by silica gel column chromatography.

$\lambda_{max}$: 418 nm (in ethyl acetate)

$\epsilon_{max}$: $3.16\times10^4$ l.mol$^{-1}$.cm$^{-1}$ m.p.: 126° to 127° C.

The thermo-mobile dyes of this invention are used for image formation in thermal transfer systems where they are included in a colorant layer on a support to provide thermal transfer dye donating materials.

Cases in which thermo-mobile dyes of this invention are used to form an image in a thermal transfer system are described in detail below.

Dyes of the three colors, yellow, magenta and cyan, are generally required in order to form a full color image.

Full color image formation can be achieved by selecting all of the yellow, magenta and cyan dyes from among the thermo-mobile dyes of this invention.

Alternatively, image formation can be achieved using thermo-mobile dyes of this invention for one or two of these colors and a conventionally known dye for the other two or one dye.

Mixtures of dyes of this invention and conventionally known dyes can also be used for the same color. Furthermore, two or more types of dye of this invention of the same color can be mixed together for use.

The thermal transfer dye donating material can be used in the form of sheets or in the form of a continuous roll or ribbon. The yellow, magenta and cyan dyes of this invention are generally arranged on a support in such a way that they each form a separate region. For example, a yellow dye region, a magenta dye region and a cyan dye region can be arranged in surface order or in line order on a single support. Furthermore, three types of thermal transfer dye donating material which have the above-mentioned yellow dyes, magenta dyes and cyan dyes each established on a separate support can be used, and in this case, thermal transfer of the dye in each thermal transfer dye donating material can be carried out sequentially.

The yellow dyes, magenta dyes and cyan dyes of this invention can each be dissolved or dispersed in a suitable solvent, together with a binder resin, and coated onto a support, or they may be printed onto the support using a printing procedure such as gravure printing. The thickness of the dye donating layers which contain these dyes is generally from about 0.2 μ to about 5 μ, and it is preferably set within the range from 0.4 μ to 2 μ.

Furthermore, any of the binder resins used for this purpose in the past can be used for the binder resins which are used together with the thermo-mobile dyes of this invention, and a binder which is resistant to heat and which does not impede migration of the dye when it is heated is generally selected. For example, use can be made of polyamide based resins, polyester based resins, epoxy based resins, polyurethane based resins, polyacrylic resins (for example, poly(methyl methacrylate), polyacrylamide and poly(styrene-acrylonitrile) resins), vinyl based resins such as polyvinylpyrrolidone, poly(vinyl chloride) based resins (for example, vinyl chloride/vinyl acetate copolymers), polycarbonate based resins, polystyrene, poly(phenylene oxide), cellulose based resins (for example, methylcellulose, ethylcellulose, carboxymethyl cellulose, cellulose acetate hydrogen phthalate, cellulose acetate, cellulose acetate propionate, cellulose acetate butyrate, cellulose triacetate), poly(vinyl alcohol) based resins (for example, poly(vinyl alcohol) and partially saponified poly(vinyl alcohol) such as poly(vinyl butyrate), poly(vinyl acetal)), petroleum based resins, rosin derivatives, coumarone/indene resins, terpene based resins and polyolefin based resins (for example, polyethylene, polypropylene).

Binder resins of this type are preferably used at a rate of some 30 to 600 parts by weight per 100 parts by weight of dye in this invention.

The conventional ink solvents can be used freely as solvents for the dissolution or dispersion of the above-mentioned dyes and binder resins, and actual examples include alcohols such as methanol, ethanol, isopropyl alcohol, butanol and isobutanol, ketones such as methyl ethyl ketone, methyl isobutyl ketone and cyclohexanone, aromatic solvents such as toluene and xylene, dioxane, tetrahydrofuran, and mixtures of these solvents. These solvents must be selected and used in such a way that the binder and the dye can be dissolved or dispersed satisfactorily at the prescribed concentration. For example, the use of an amount of solvent some 5 to 20 times the total weight of dye and binder is preferred.

Any conventionally known support can be used for the support of the thermal transfer dye donating material. For example, use can be made of poly(ethylene terephthalate), polyamide, polycarbonate, glasine paper, condenser paper, cellulose ester, fluoropolymer, polyether, polyacetal, polyolefin, polyimide, polyphenylsulfide, polypropylene, polysulfone and cellophane, etc.

The thickness of the thermal transfer dye donating material support is generally from 2 to 30 μ. It may be provided with an under-layer as required. Furthermore, a layer comprised of a hydrophilic polymer for preventing diffusion of the dye may be established between the support and the dye donating layer. The transfer density is considerably increased by this means. The aforementioned water soluble polymers can be used as hydrophilic polymers.

Furthermore, a slipping layer can be established in order to prevent the thermal head from sticking on the dye donating material. This slipping layer is constructed with a lubricating material which may or may not contain a polymer binder, for example, a surfactant, a solid or liquid lubricant, or a mixture of these materials.

The dye donating material may be subjected to an anti-sticking treatment on the side on which the dye donating layer has not been established with a view to preventing sticking due to the heat from the thermal head and improving slip when printing from the rear surface.

For example, a heat resistant slip layer of which the main components are (1) the reaction product of a poly(vinyl butyrate) resin and an isocyanate, (2) an alkali metal salt or alkaline earth metal salt of a phosphate ester, and (3) a filler can be established. The poly(vinyl butyrate) resin has a molecular weight of some 60,000 to 200,000 and a glass transition point of 80° C. to 110° C. and the isocyanate is used in such a way that the weight % of the vinyl butyrate portion is from 15% to 40% from the viewpoint of providing many reactive sites. "Gafack RD720" made by Toa Kagaku for example can be used as the alkali metal salt or alkaline earth metal salt of a phosphate ester, and this is used in an amount of from 1 to 50 wt %, and preferably in an amount of from 10 to 40 wt %, with respect to the poly(vinyl butyrate) resin.

The heat resistant slip layer may be established by coating on the under-layer a combination of a synthetic resin and a curing agent which can be cured by heating, for example, a combination of poly(vinyl butyrate) and poly-functional isocyanate, acrylic polyol and a titanium chelating agent, or cellulose acetate and an organic titanium compound, and which is preferably resistant to heat.

A hydrophilic barrier layer can also be established in the dye donating material in order to prevent diffusion of the dye towards the support. The hydrophilic dye barrier layer contains hydrophilic substances which are useful for the intended purpose. In general, excellent results can be obtained by using gelatin, polyacrylamide, poly(isopropylacrylamide), butyl methacrylate grafted gelatin, ethyl methacrylate grafted gelatin, cellulose monoacetate, methylcellulose, poly(vinyl alcohol), poly(ethyleneimine), poly(acrylic acid), mixtures of poly(vinyl alcohol) and poly(vinyl acetate), mixtures of poly(vinyl alcohol) and poly(acrylic acid) or mixtures of cellulose mono-acetate and poly (acrylic acid). The most desirable materials are poly(acrylic acid), cellulose monoacetate and poly(vinyl alcohol).

An under-layer may be established in the dye donating material. Any under-layer can be used in this invention provided that i t has the desired effect, and actual examples of preferred materials include acrylonitrile/vinylidene chloride/acrylic acid copolymer (14:80:6 by weight), butyl acrylate/2-aminoethyl methacrylate/2-propoxyethyl methacrylate copolymer (30:20:50 by weight), and linear/saturated polyesters, for example, Bostic 7650 ((E hart Co., Bostic Chemical Group) and chlorinated high density poly(ethylene/trichloroethylene) resin. No particular limitation is imposed upon the amount of under-layer which is coated, but it is usually coated in an amount of from 0.1 to 2.0 g/m$^2$.

In this invention, a thermal transfer dye donating material is laminated with a thermal transfer image receiving material and the dye of the dye donating layer is transferred to the thermal transfer image receiving material in accordance with the magnitude of the thermal energy on applying heat corresponding to an image signal by means of a heating device such as a thermal head from either side, but preferably from the reverse side of the thermal transfer dye donating material, and color images which have excellent sharpness, and gradation of resolution can be obtained in this way.

The means of heating is not limited to a thermal head and other known methods of heating with laser light (with a semiconductor laser, for example), infrared flash and thermal pens, for example, can be used for this purpose.

It is possible to obtain a print and facsimile copies using various types of thermal printers, to form prints of images by means of magnetic recording systems, photomagnetic recording systems, or photorecording systems, and to form prints from television and CRT screens, for example, by combining a thermal transfer dye donating material with a thermal transfer image receiving material in this invention.

See the disclosure of JP-A-60-34895 for details of thermal transfer recording methods.

The thermal transfer image receiving materials which are used together with the thermal transfer dye donating materials of this invention in the execution of the thermal transfer recording procedure are described below. The thermal transfer image receiving material has at least one image receiving layer which can accept a thermo-mobile dye established on a support.

Any support which is able to withstand the transfer temperature and which is satisfactory in respect of smoothness, whiteness, slip properties, friction properties, anti-static properties and indentation after transfer, for example, can be used for the support which is used for a thermal transfer image receiving material. For example, use can be made of paper supports such as synthetic papers (polyolefin or polystyrene based synthetic papers for example), top quality paper, art paper, cast card paper, wall paper, lining paper, synthetic resin or emulsion impregnated paper, synthetic rubber latex impregnated paper, synthetic resin containing paper, cardboard, cellulose fiber paper and polyolefin coated paper (especially paper of which both sides have been covered with polyethylene), various plastic films or sheets, such as films or sheets of polyolefin, poly(vinyl chloride), poly(ethylene terephthalate), polystyrene, methacrylate or polycarbonate, for example, and films or sheets obtained by carrying out a treatment to provide these plastics with white reflecting properties, and any combination of the above-mentioned supports.

From among these supports, polyolefin coated papers are preferred since with these materials there is no indentation type deformation due to the heat which is applied during thermal transfer. They have excellent whiteness and they have a further advantage in that they are not liable to curling.

An image receiving layer for the dye is established on the thermal transfer image receiving material. This image receiving layer is preferably a film of thickness from about 0.5 m to about 50 m which contains a dye accepting substance which accepts the thermo-mobile dye which has migrated from the thermal transfer dye donating material during printing and is dyed by the thermo-mobile dye either on its own or together with some other binder material.

Resins such as those indicated below can be cited as dye accepting polymers which are typical examples of dye accepting materials.

(a) Resins which have an Ester Bond

Polyester resins obtained by the condensation of a dicarboxylic acid component such as terephthalic acid, isophthalic acid and succinic acid (these dicarboxylic acid components may be substituted with sulfo groups or carboxyl groups for example) and ethylene glycol, diethylene glycol, propylene glycol, neopentyl glycol or bis-phenol A for example, poly(acrylic acid ester) resins or poly(methacrylic acid ester) resins such as poly(methyl methacrylate), poly(butyl methacrylate), poly(methyl acrylate) and poly(butyl acrylate) for example, polycarbonate resins, poly(vinyl acetate) resins, styrene acrylate resins and vinyl toluene acrylate resins. Actual examples have been disclosed in JP-A-59-101395, JP-A-63-7971, JP-A-63-7972, JP-A-63-7973 and JP-A-60-294862. Furthermore, Bailon 290, Bailon 200, Bailon 280, Bailon 300, Bailon 103, Bailon GK-140 and Bailon GK-130 made by Toyo Bosei, and ATR-2009 and ATR-2010 for example can be used as commercial products.

(b) Resins which have a Urethane Bond

Polyurethane resins for example.

(c) Resins which have a Amide Bond

Polyamide resins for example.

(d) Resins which have a Urea Bond

Urea resins for example.

(e) Resins which have a Sulfone Bond

Polysulfone for example.

(f) Resins which have Other Highly Polar Bonds

Polycaprolactone resins, styrene/maleic anhydride resins, poly(vinyl chloride) resins and polyacrylonitrile resins, for example.

Mixtures or copolymers of these materials can also be used in addition to the synthetic resins such as those indicated above.

High boiling point organic solvents or thermal solvents can be included in thermal transfer image receiving materials, and especially in the image receiving layers, as dye accepting substances or as dye diffusion promoter.

Actual examples of such high boiling point organic solvents and thermal solvents include the compounds disclosed in JP-A-62-174754, JP-A-62-245253, JP-A-61-209444, JP-A-61-200538, JP-A-62-8145, JP-A-62-9348, JP-A-62-30247 and JP-A-62-136646.

The receiving layer of a thermal transfer image receiving material may be constructed by dispersing and loading a dye accepting substance in a water soluble binder. A variety of known water soluble polymers can be used for the water soluble binder which is used in such a case, but the use of water soluble polymers which have groups which can undergo a crosslinking reaction with a film hardening agent is preferred, and of these materials gelatin is the most desirable.

Any of the known methods which can be used when dispersing a hydrophobic substance in a water soluble polymer can be used for dispersing the dye receiving substance in the water soluble binder. Typically, there are methods in which a solution obtained by dissolving the dye accepting substance in an organic solvent which is immiscible with water is mixed with an aqueous solution of the water soluble binder and emulsified and dispersed, and methods in which a latex of a dye accepting substance (polymer) is mixed with an aqueous solution of a water soluble binder.

The image receiving layer may consist of a single layer or it may be constructed from two or more layers. In cases where two or more layers are established, sometimes a synthetic resin which has a low glass transition point is used for the layer closest to the support to form a structure of which the dying properties with the dye are good, using a high boiling point organic solvent or thermal solvent, and a synthetic resin which has a higher glass transition point is used for the outermost layer and such structures are desirable in that by using the minimum amount of high boiling point solvent or thermal solvent on no such material at all in this layer it is possible to eliminate surface stickiness, adhesion with other materials, re-transfer of the dye to other substances after transfer and blocking with the thermal transfer dye donating material for example.

The thickness of the image receiving layer overall is from 0.5 to 50 μm, and preferably from 3 to 30 μm, and in those cases where there are two layers, the thickness of the outermost layer is from 0.1 to 2 μm, and preferably within the range from 0.2 to 1 μm.

The thermal transfer image receiving material may have an intermediate layer between the support and the image receiving layer.

Depending on the material from which it is made, an intermediate layer may be a cushioning layer, a porous layer or a layer for preventing diffusion of the dye, or a layer which has two or more of these functions and, depending on the particular case, it may also function as an adhesive.

A dye diffusion preventing layer is a layer which fulfills the role of preventing the thermo-mobile dye from diffusing into the support in particular. The binders used to form these layers may be soluble in water or in organic solvents, but the use of water soluble binders is preferred, and the use of the water soluble binders, and especially gelatin, which are used as binders for the image receiving layers aforementioned is most desirable.

Porous layers are layers which fulfill the roll of preventing the heat which is applied during printing from diffusing from the image receiving layer into the support at the time of thermal transfer and thus ensuring that the printing heat which is applied is used effectively.

Fine powders consisting of silica, clay, talc, diatomaceous earth, calcium carbonate, calcium sulfate, barium sulfate, aluminum silicate, synthetic zeolites, zinc oxide, lithophone, titanium oxide or alumina, for example, can be included in the image receiving layers, cushioning layers, porous layers, diffusion preventing layers and adhesive layers etc. from which the thermal transfer image receiving materials of this invention are constructed.

Fluorescent whiteners may be used in the thermal transfer image receiving materials. Examples of such materials include the compounds disclosed in Chapter 8 of *The Chemistry of Synthetic Dyes* by K. Veenkataraman, and in JP-A-61-143752. Actual examples of such compounds include stilbene based compounds, coumarin based compounds, biphenyl based compounds, benzoxazolyl based compounds, naphthalimide based compounds, pyrazoline based compounds, carbostyril based compounds and 2,5-dibenzoxazolethiophene based compounds.

The fluorescent whiteners can be used in combination with anti-color fading agents.

The inclusion of release agents in the layers from which the dye donating materials and/or image receiving materials are formed, and especially in the outermost layers at the surfaces where the two types of material are brought into contact, is desirable for improving the release properties of the thermal transfer dye donating materials and thermal transfer image receiving materials in this invention.

Known release agents, for example, solids or waxes such as polyethylene wax, amide wax and teflon powder; fluorine based or phosphate ester based surfactants and paraffin based, silicone based and fluorine based oils, can all be used as release agents, but the use of silicone oils is preferred.

Modified silicone oils, such as the carboxy modified, amino modified and epoxy modified silicone oils, can be used as well as unmodified silicone oils. Examples of such modified oils include the various modified silicone oils described on pages 6 to 18B of the Shinetsu Silicon Company's data sheet *Modified Silicone Oils*. The use of amino modified silicone oils which have groups which can undergo a reaction with the crosslinking agent for the binder (for example, groups which can react with isocyanates) is effective in those cases where it is used with an organic solvent based binder, while in cases where the oil is to be emulsified and dispersed in a water soluble binder the use of a carboxy modified silicone oil (for example, the silicon oil of trade name X-22-3710, made by the Shinetsu Silicone Co.) is effective.

Anti-color fading agents may be used in the thermal transfer dye donating materials and thermal transfer image receiving materials to further increase the fastness of the dyes. Antioxidants, ultraviolet absorbers and certain types of metal complexes can be used, for example, as anti-color fading agents. When an anti-color fading agent is used in a thermal transfer dye donating material it may be included in the dye donating layer or it may be established in a region other than the region in which the dye donating layer has been established on the support.

Examples of antioxidants include, chroman based compounds, coumarin based compounds, phenol based compounds (hindered phenols for example), hydroquinone derivatives and spiroindane based compounds. The compounds disclosed in JP-A-61-159644 are also effective.

Benzotriazole based compounds (for example, U.S. Pat. No. 3,533,794), 4-thiazolidone based compounds (for example, U.S. Pat. No. 3,352,681), benzophenone based compounds (for example, JP-A-56-2784) and the other compounds disclosed, for example, in JP-A-54-48535, JP-A-62-136641 and JP-A-61-88256, can be used, for example, as ultraviolet absorbers. Furthermore, the ultraviolet absorbing polymers disclosed in JP-A-62-260152 are also effective.

The compounds disclosed, for example, in U.S. Pat. No. 4,241,155, columns 3 to 36 of U.S. Pat. No. 4,245,018, columns 3 to 8 of U.S. Pat. No. 4,254,195, JP-A-62-174741, pages 27 to 29 of JP-A-61-88256, and Japanese Patent Application Nos. 62-234103, 62-31096 and 62-230596 can be used as metal complexes.

Examples of useful anti-color fading agents have been disclosed on pages 125 to 137 of JP-A-62-215272.

Anti-color fading agents for preventing the fading of dyes which have been transferred to the image receiving material may be included in the image receiving material beforehand, or they may be supplied to the image receiving material from the outside using a method involving transfer from the dye donating material for example.

The above-mentioned antioxidants, ultraviolet absorbers and metal complexes may be used in combination with one another.

The layers from which the thermal transfer image receiving materials of this invention and the thermal transfer dye donating materials are constructed may be hardened by means of film hardening agents.

The film hardening agents disclosed, for example, in JP-A-61-199997 and JP-A-58-215398 can be used for hardening organic solvent based polymers. The use of isocyanate based film hardening agents is especially desirable for polyester resins.

The film hardening agents disclosed, for example, in column 41 of U.S. Pat. No. 4,678,739, JP-A-59-116655, JP-A-62-245261 and JP-A-61-18942 are appropriate for hardening water soluble polymers. In practical terms, aldehyde based film hardening agents (for example, formaldehyde), aziridine based film hardening agents, epoxy based film hardening agents, (for example,

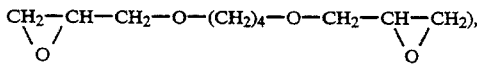

vinylsulfone based film hardening agents (for example, N,N'-ethylenebis(vinylsulfonylacetamido)ethane), N-methylol based film hardening agents (for example, dimethylolurea) or polymeric film hardening agents (the compounds disclosed, for example, in JP-A-62-234157) can be used for this purpose.

Anti-color fading agents such as those described earlier may be included beforehand in the thermal transfer image receiving material.

Various surfactants can be used in the structural layers of the thermal transfer dye donating materials and thermal transfer image receiving materials either as coating promoters or with a view to improving peeling properties, improving slip properties, providing anti-static properties or accelerating development, for example.

For example, use can be made of non-ionic surfactants, anionic surfactants, amphoteric surfactants and cationic surfactants. Actual examples have been disclosed, for example, in JP-A-62-173463 and JP-A-62-183457.

Furthermore, the use of surfactants as dispersion promoters is desirable in those cases where a substance which can accept a thermo-mobile dye, release agents, anti-fading agents, ultraviolet absorbers, fluorescent whiteners or other hydrophobic compounds are dispersed in a hydrophilic binder. In addition to the surfactants described above, the use of the surfactants disclosed on pages 37–38 of JP-A-59-157636 for this purpose is especially desirable.

Organic fluoro compounds can be included in the structural layers of the thermal transfer dye donating materials and thermal transfer image receiving materials with a view to improving slip properties, providing anti-static properties and improving the peeling properties, for example. Typical examples of organic fluoro compounds include the fluorine based surfactants disclosed, for example, in columns 8 to 17 of JP-B-57-9053, JP-A-61-20944 and JP-A-62-135826, and hydrophobic fluorine based compounds such as the oil like fluorine based compounds such as the fluorine oils and the solid fluorine based resins such as the tetrafluoroethylene resins. (The term "JP-B" as used herein signifies an "examined Japanese patent publication".)

Matting agents can be used in the thermal transfer dye donating materials and thermal transfer image receiving materials. Compounds such as the benzoguanamine resin beads, polycarbonate resin beads and AS resin beads disclosed in JP-A-63-274944 and JP-A-63-274952 can be used for this purposes as well as the compounds such as silicon dioxide, polyolefins and polymethacrylates disclosed on page 29 of JP-A-61-88256.

The preparation of the thermal transfer dye donating materials and thermal transfer image receiving materials in the examples and comparative examples described hereinafter, the printing in which these two materials were used and thermal transfer image receiving material tests were carried out in the ways indicated below.

EXAMPLE 1

Preparation of the Thermal Transfer Dye Donating Material (A)

A poly(ethylene terephthalate) film of thickness 6 μm (made by Teijin Ltd.) of which the reverse side had been subjected to a heat resistant slip treatment was used as a support and the paint composition (A-1) for a thermal transfer dye donating layer indicated below was coated by wire bar coating so as to provide a film thickness when dry of 1.5 μm on the surface of the film to form the thermal transfer dye donating material (A).

| Coating Composition (A-1) for Thermal Transfer Dye Donating Layer Purposes | |
|---|---|
| Dye (No. 1) | 10 mmol |
| Poly(vinyl butyrate) resin ("Denka Butyral 5000-A", made by Denki Kagaku) | 3 g |
| Toluene | 40 ml |
| Methyl ethyl ketone | 40 ml |
| Polyisocyanate ("Takenate D110N", made by Takeda Yakuhin) | 0.2 ml |

The thermal transfer dye donating materials (B)–(K) and the comparative materials (L), (M) and (N) shown in Table 1 were prepared by replacing the dye with a different one.

Preparation of the Thermal Transfer Dye Materials (1) and (2)

Synthetic paper (YUPO-FPG-150, made by Oji Yuka) of thickness 150 μm was used as a base material and the paint composition (1-1) for image receiving purposes indicated below was coated by wire bar coating onto the surface in such a way that the film thickness when dry was 8 μm to form the thermal transfer image receiving material (1). After preliminary drying in a drier, drying was completed over a period of 30 minutes in an oven at a temperature of 100° C.

| Coating Composition (1-1) for an Image Receiving Layer | |
|---|---|
| Polyester resin (Bailon 280, made by Toyo Bosei) | 22 g |
| Polyisocyanate (KP-90, made by Dainippon Ink Kagaku) | 4 g |
| Amino-modified silicone oil (KF-857, made by Shinetsu Silicone) | 0.5 g |
| Methyl ethyl ketone | 85 ml |
| Toluene | 85 ml |
| Cyclohexanone | 15 ml |

Moreover, the thermal transfer image receiving material (2) was prepared in the same way using the paint composition (2-1) for image receiving layer purposes.

Paint Composition (2-1) for Image Receiving Layer Purposes

This composition was the same as the paint composition (1) for image receiving layer purposes except that 0.3 gram of hydroquinone dimethyl ether was added. (0.3 gram of hydroquinone dimethyl ether is the amount of this substance to provide more or less the same number of mol per unit area as the number of mol of dye per unit area ($D_{max}$ part) in the image receiving paper after the dye has been transferred).

The thermal transfer dye donating materials (A)–(N) and the thermal transfer image receiving materials (1) and (2) obtained in the ways described above were laminated together in such a way that the thermal transfer dye donating layers and the image receiving layers were in contact with one another and printing was carried out using a thermal head from the support side of the thermal transfer image receiving material under conditions of thermal head output 0.25 W/dot, pulse width 0.15–15 msec, dot density 6 dot/mm, and on dying with the magenta dyes in the form of an image in the image receiving layer of the image receiving thermal transfer material, clear images with no transfer blurring were obtained.

The recorded image receiving materials so obtained were illuminated with a fluorescent lamp at 12,000 lux for a period of 4 days to investigate the stability of the colored image. The status A reflection density was measured before and after irradiation and the stability was evaluated in terms of the ratio between these densities. The results obtained shown in Table 1. (The measurement was made in an area where the density was 1.0.)

TABLE 1

| No. | Dye | Dye Donating Material | Image Receiving Material | Maximum Density | Survival Rate (%) | |
|---|---|---|---|---|---|---|
| 1 | 1 | (A) | (1) | 2.8 | 88 | Invention |
| 2 | a | (L) | (1) | 2.8 | 70 | Comp. Ex. |
| 3 | a | (L) | (2) | 2.8 | 71 | Comp. Ex. |
| 4 | 2 | (B) | (1) | 2.6 | 84 | Invention |
| 5 | b | (M) | (1) | 2.6 | 60 | Comp. Ex. |
| 6 | b | (M) | (2) | 2.6 | 62 | Comp. Ex. |
| 7 | 3 | (C) | (1) | 1.5 | 97 | Invention |
| 8 | c | (N) | (1) | 1.5 | 96 | Comp. Ex. |
| 9 | c | (N) | (2) | 1.5 | 95 | Comp. Ex. |
| 10 | 4 | (D) | (1) | 2.5 | 89 | Invention |
| 11 | 5 | (E) | (1) | 2.6 | 88 | Invention |
| 12 | 11 | (F) | (1) | 2.8 | 90 | Invention |
| 13 | 18 | (G) | (1) | 2.8 | 88 | Invention |
| 14 | 31 | (H) | (1) | 2.5 | 92 | Invention |
| 15 | 32 | (I) | (1) | 2.8 | 89 | Invention |
| 16 | 51 | (J) | (1) | 2.0 | 82 | Invention |
| 17 | 56 | (K) | (1) | 2.2 | 88 | Invention |

Comparative Dyes a.

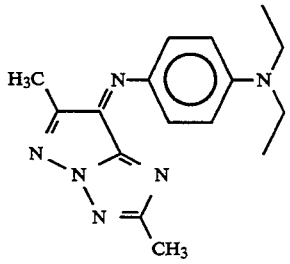

TABLE 1-continued b.

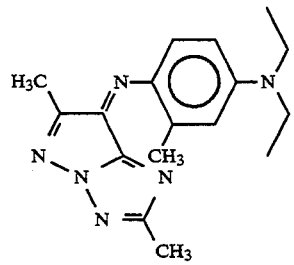

c.

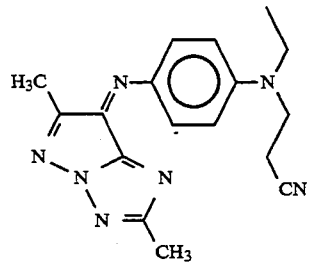

It is clear from these results that dyes 1, 2 and 3 of this invention had much greater fastness than the corresponding comparative dyes a, b and c (which had no atomic grouping which had the effect of suppressing fading).

Moreover, it is clear on comparing Nos. 3, 6 and 9 where the comparative dyes a, b and c were transferred to the image receiving material (2) which contained an anti-fading agent and Nos. 2, 5 and 8 where the transfer was made to the image receiving material (1) which did not contain an anti-fading agent that there was no improvement in fastness.

From the above it is clear that the high degree of light fastness of the dyes of this invention is a function only of the structure of the dyes of this invention which have an atomic grouping which has the effect of suppressing fading within the dye molecule.

Moreover, it is clear from a comparison of the maximum densities of the dyes of this invention and the corresponding comparative dyes that, although the dyes of this invention have an atomic grouping which has the effect of suppressing fading and an increased molecular weight, there is no loss of maximum density.

Moreover, it is clear on looking at Nos. 10–17 that all of the dyes provide a high maximum density and a high degree of fastness.

EXAMPLE 2

Thermo-mobile dye donating materials (O)–(W) were prepared using the dyes indicated in Table 2 by changing the dye 1 in the thermo-mobile dye donating layer paint composition (A-1) of Example 1.

When printing was carried out using the image receiving material (1) prepared in Example 1, all of the dyes provided sharp recorded images with no transfer blurring and the densities were high. Furthermore, the light fastness was also excellent.

TABLE 2

| No. | Dye Donating Material | Dye |
|---|---|---|
| 18 | (O) | 40 |
| 19 | (P) | 47 |
| 20 | (Q) | 58 |
| 21 | (R) | 63 |

TABLE 2-continued

| No. | Dye Donating Material | Dye |
|---|---|---|
| 22 | (S) | 64 |
| 23 | (T) | 65 |
| 24 | (U) | 66 |
| 25 | (V) | 68 |
| 26 | (W) | 73 |

EXAMPLE 3

Thermal transfer dye donating materials (3-1) to (3-14) were prepared by changing the poly(vinyl butyrate) resin of the thermal transfer dye donating layer paint composition (A-1) of Example 1 using the resins and dyes shown in Table 3.

Sharp recorded images with no transfer blurring were obtained when printing was carried out in the same way as in Example 1 using image receiving material (1). Furthermore, the light fastness was also excellent.

TABLE 3

| No. | Dye Donating Material | Dye | Survival Rate | Remarks |
|---|---|---|---|---|
| 28 | (3-1) | 60 | 87 | Invention |
| 29 | (3-2) | e | 66 | Comp. Ex. |
| 30 | (3-3) | 76 | 85 | Invention |
| 31 | (3-4) | f | 79 | Comp. Ex. |
| 32 | (3-5) | 82 | 66 | Invention |
| 33-1 | (3-6) | g | 62 | Comp. Ex. |
| 33-2 | (3-7) | 113 | 95 | Invention |
| 33-3 | (3-8) | h | 90 | Comp. Ex. |
| 33-4 | (3-9) | 114 | 85 | Invention |
| 33-5 | (3-10) | i | 62 | Comp. Ex. |
| 33-6 | (3-11) | 122 | 82 | Invention |
| 33-7 | (3-12) | j | 75 | Comp. Ex. |
| 33-8 | (3-13) | 125 | 92 | Invention |
| 33-9 | (3-14) | k | 85 | Comp. Ex. |

Comparative Dyes e.

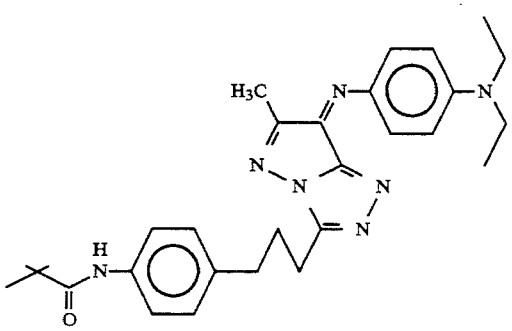

TABLE 3-continued f.

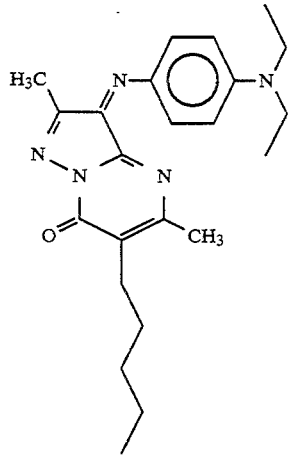

g.

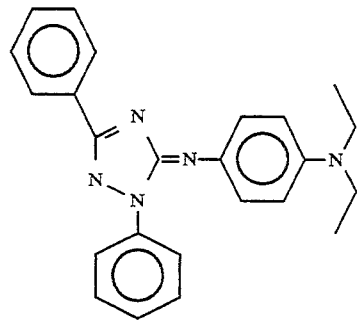

(disclosed in JP-A-63-113077)

h.

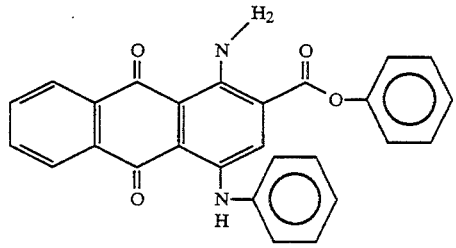

i.

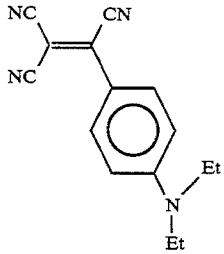

j.

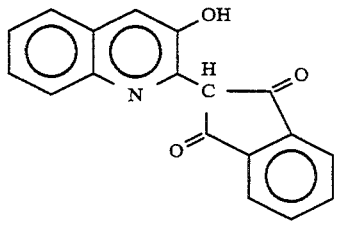

TABLE 3-continued k. 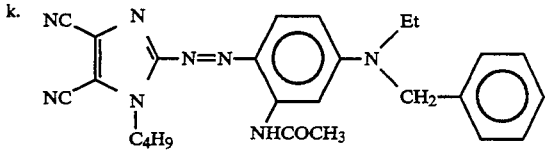

EXAMPLE 4

Preparation of Thermal Transfer Image Receiving Material

Using synthetic paper (YUPO-FPG-150, made by Oji Yuka) of thickness 150 μm as a support, the paint composition for image receiving purposes indicated below was coated on the surface by wire bar coating so as to provide a thickness when dry of 10 μm and thermal transfer image receiving material (3) was obtained. This was dried provisionally in a drier and then for 30 minutes in an oven at a temperature of 100° C.

| Paint Composition (3-1) for Image Receiving Layer Purposes | |
|---|---|
| Polyester resin No. 1 | 20 g |
| Amino modified silicone oil (KF-857, made by Shinetsu Silicone) | 0.5 g |
| Epoxy modified silicone oil (KF-100T, made by Shinetsu Silicone) | 0.5 g |
| Methyl ethyl ketone | 85 ml |
| Toluene | 85 ml |
| Cyclohexanone | 30 ml |

Sharp image recordings were obtained when printing was carried out with combinations of the dye donating materials of Examples 1 and 2. Furthermore, the light fastness was also excellent.

EXAMPLE 5

Preparation of Thermal Transfer Image Receiving Material (4)

Using a resin coated paper for which a paper of thickness 200 μ had been laminated with polyethylene to a thickness of 15 μ and 25 μ respectively on both sides as a support, the thermal transfer image receiving material (4) was prepared by coating the paint composition for image receiving layer purposes of which the composition is indicated below by wire bar coating on the surface laminated with 15 μ of polyethylene in such a way that the dry thickness was 10 μ and drying.

| Paint Composition for Image Receiving Layer Purposes | |
|---|---|
| Polyester resin No. 1 | 25 g |
| Amino modified silicone oil (KF-857, made by Shinetsu Silicone) | 0.8 g |
| Polyisocyanate (KP-90, made by Dainippon Ink) | 4 g |
| Methyl ethyl ketone | 100 ml |
| Toluene | 100 ml |

Sharp, high density image recordings were obtained on printing in the same way as described in Example 4.

EXAMPLE 6

Preparation of Thermal Transfer Image Material (5)

A gelatin dispersion of a dye accepting substance was prepared by the emulsification and dispersion in a homogenizer of an organic solvent solution of a dye accepting polymer of composition (B') in an aqueous gelatin solution of composition (A') as indicated below.

| (A') Aqueous Gelatin Solution | |
|---|---|
| Gelatin | 2.3 g |
| Sodium dodecylbenzenesulfonate (5% aqueous solution) | 20 ml |
| Water | 80 ml |
| (B') Dye Accepting Polymer Solution | |
| Polyester resin (Vylon 300, made by Toyobo Co., Ltd.) | 7.0 g |
| Carboxy modified silicone oil (X-22-3710, made by Shinetsu Silicone) | 0.7 g |
| Methyl ethyl ketone | 20 ml |
| Toluene | 10 ml |
| Triphenyl phosphate | 1.5 g |

A solution obtained by dissolving 0.5 gram of the fluorine based surfactant (a),

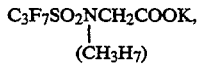

in 10 ml of a mixed (1:1) water/methanol solvent was added to the dispersion prepared in this way to form a paint composition for a receiving layer. This paint composition was coated using the wire bar coating method onto a synthetic paper of thickness 150 μm (YUPO-SGG-150, made by Oji Yuka) of which the surface had been subjected to a corona discharge in such a way as to provide a wet film thickness of 75 μm and dried.

Image recording was then carried out in the same way as in Example 1 using the thermal transfer dye donating materials (A)–(W) obtained in Examples 1 and 2 and the thermal transfer image receiving material (5). The images obtained had a high density and were sharp, and they also had a high degree of light fastness.

EXAMPLE 7

Preparation of Thermo-mobile Dye Image Receiving Material (6)

Thermal transfer image receiving material (6) was prepared in the same way as in Example 1 using the paint composition (7-1) for image receiving layer purposes.

Paint Composition (7-1) for Image Receiving Layer Purposes

This composition was the same as that of the paint composition (1-1) for image receiving layer purposes of Example 1 except that 7 grams of the ultraviolet absorber indicated below was added.

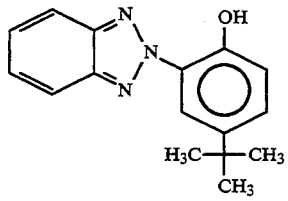

Ultraviolet Absorber

Sharp images of high density were obtained on printing in the same way as described in Example 1 using the thermal transfer dye donating materials (A)–(K). The light fastness was also increased in comparison to that observed when thermal transfer image receiving material (1) had been used.

EXAMPLE 8

Thermo-mobile dye donating materials (4-1)–(4-10) were prepared using the dyes indicated in Table 4 by changing the dye 1 in the thermo-mobile dye donating layer paint composition (A-1) of Example 1.

When printing was carried out using the image receiving material (1) prepared in Example 1, all of the dyes provided sharp recorded images with no transfer blurring.

The recorded thermal transfer image receiving materials so obtained were illuminated with a fluorescent lamp at 12,000 lux for a period of 7 days to investigate the stability of the colored image. The status A reflection density was measured before and after irradiation and the stability was evaluated in terms of the ratio between these densities. The results obtained shown in Table 4. (The measurement of the survival rate was made in an area where the density was 1.0.)

TABLE 4

| No. | Dye Donating Material | Dye | $D_{max}$ | Rate (%) | Survival Remarks |
|---|---|---|---|---|---|
| X-1 | (4-1) | 93 | 1.4 | 88 | Invention |
| X-2 | (4-2) | 94 | 2.0 | 83 | Invention |
| X-3 | (4-3) | 95 | 1.5 | 88 | Invention |
| X-4 | (4-4) | 96 | 1.9 | 92 | Invention |
| X-5 | (4-5) | 97 | 2.1 | 94 | Invention |
| X-6 | (4-6) | 98 | 2.4 | 80 | Invention |
| X-7 | (4-7) | 99 | 1.7 | 85 | Invention |
| X-8 | (4-8) | 100 | 1.6 | 80 | Invention |
| X-9 | (4-9) | 101 | 2.0 | 83 | Invention |
| X-10 | (4-10) | d | 1.2 | 68 | Comp. Ex. |

Comparative Dyes d.

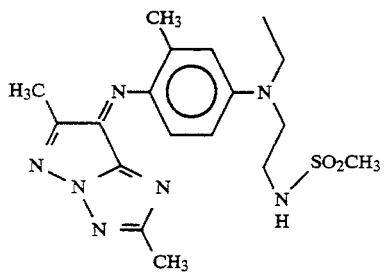

(disclosed in JP-A-64-63194)

It is clear from Table 4 that the images obtained by using the dyes of this invention having an atomic grouping which has the effect of suppressing fading are extremely high in light fastness and excellent in transfer properties as compared with that obtained by using the comparative dye.

EXAMPLE 9

Thermo-mobile dye donating materials (5-1)–(5-6) were prepared using the dyes indicated in Table 5 by changing the dye 1 in the thermo-mobile dye donating layer paint composition (A-1) of Example 1.

When printing was carried out using the image receiving material (1) prepared in Example 1, all of the dyes provided sharp recorded images with no transfer blurring.

The recorded thermal transfer image receiving materials so obtained were illuminated with a fluorescent lamp at 12,000 lux for a period of 7 days to investigate the stability of the colored image. The status A reflection density was measured before and after irradiation and the stability was evaluated in terms of the ratio between these densities. The results obtained shown in Table 5. (The measurement was made in an area where the density was 1.0.)

TABLE 5

| No. | Dye Donating Material | Dye | Survival Rate (%) | Remarks |
|---|---|---|---|---|
| X-11 | (5-1) | 102 | 87 | Invention |
| X-12 | (5-2) | e | 66 | Comp. Ex. |
| X-13 | (5-3) | 104 | 85 | Invention |
| X-14 | (5-4) | f | 79 | Comp. Ex. |
| X-15 | (5-5) | 108 | 66 | Invention |
| X-16 | (5-6) | g | 62 | Comp. Ex. |

It is clear from Table 5 that dyes 60, 76, 82 and 98 of this invention having an atomic grouping which has the effect of suppressing fading gave color images having high light fastness as compared with the corresponding comparative dyes e, f and g.

EXAMPLE 10

Thermo-mobile dye donating materials (6-1)–(6-8) and (6-Y) and (6-M) were prepared using the dyes indicated in Table 6 by changing the dye 1 in the thermo-mobile dye donating layer paint composition (A-1) of Example 1.

When printing was carried out using the image receiving material (1) prepared in Example 1, all of the dyes dye donating materials (6-1) to (6-8) provided sharp recorded images with no transfer blurring.

Each of the image receiving materials so obtained was further subjected to transfer using the dye donating materials (6-Y) and (6-M) to obtain gray color images.

The recorded thermal transfer image receiving materials so obtained were illuminated with a fluorescent lamp at 12,000 lux for a period of 7 days to investigate the stability of the colored image. All of the dyes were tested in an area where the density was 1.0.

TABLE 6

| No. | Dye Donating Material | Dye | Survival Rate (monochromatic) | Survival Rate (gray area) (%) | Remarks |
|---|---|---|---|---|---|
| X-17 | (6-1) | 109 | 90 | 85 | Invention |
| X-18 | (6-2) | l | 87 | 44 | Comp. Ex. |
| X-19 | (6-3) | 110 | 98 | 90 | Invention |
| X-20 | (6-4) | m | 91 | 51 | Comp. Ex. |
| X-21 | (6-5) | 111 | 50 | 59 | Invention |
| X-22 | (6-6) | n | 34 | 21 | Comp. Ex. |
| X-23 | (6-7) | 112 | 65 | 72 | Invention |
| X-24 | (6-8) | o | 60 | 32 | Comp. Ex. |
| | (6-Y) | p | | | |
| | (6-M) | q | | | |

Comparative Dyes l.

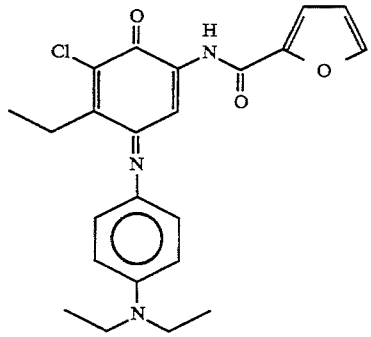

(cyan dye disclosed in JP-A-2-98492)

TABLE 6-continued m.

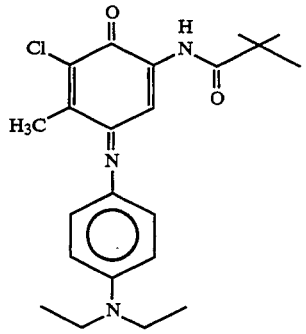

n.

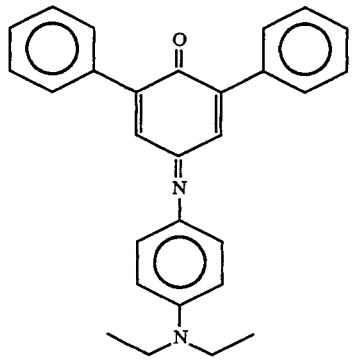

o.

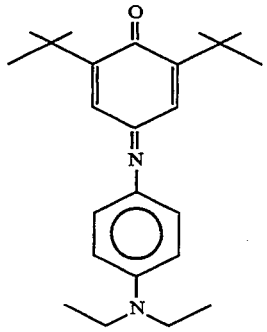

p.

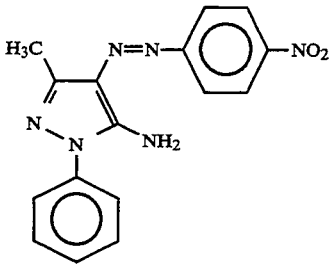

(yellow dye disclosed in JP-A-1-225592)

TABLE 6-continued q.

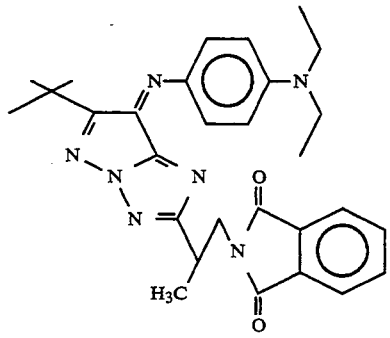

(magenta dye disclosed in JP-A-1-80105

EXAMPLE 11

Thermo-mobile dye donating materials (7-1)–(7-6) were prepared using the dyes indicated in Table 7 by changing the dye 1 in the thermo-mobile dye donating layer paint composition (A-1) of Example 1. Printing was carried out using the image receiving material (1) prepared in Example 1.

The recorded thermal transfer image receiving materials so obtained were illuminated with a fluorescent lamp at 12,000 lux for a period of 7 days to investigate the stability of the colored image. The status A reflection density was measured before and after irradiation and the stability was evaluated in terms of the ratio between these densities. The measurement was made in areas where the density was 0.3, 0.5, 1.0 and 2.0.

TABLE 6

| No. | Dye Donating Material | Dye | Survival Rate (%) 0.3 | 0.5 | 1.0 | 2.0 | Remarks |
|---|---|---|---|---|---|---|---|
| X-25 | (7-1) | 3 | 80 | 84 | 88 | 90 | Invention |
| X-26 | (7-2) | 96 | 82 | 85 | 92 | 92 | Invention |
| X-27 | (7-3) | 97 | 85 | 87 | 94 | 94 | Invention |
| X-28 | (7-4) | 68 | 80 | 84 | 90 | 91 | Invention |
| X-29 | (7-5) | 110 | 92 | 95 | 98 | 98 | Invention |
| X-30 | (7-6) | r | 42 | 62 | 75 | 85 | Comp. Ex. |

Comparative Dyes r.

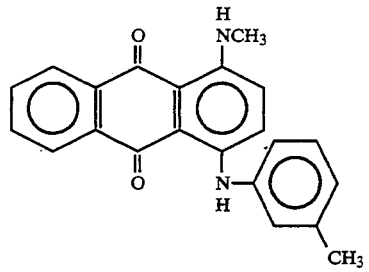

(disclosed in JP-A-63-15790)

It is clear from Table 6 that the images obtained by using the dyes of this invention having an atomic grouping which has the effect of suppressing fading are high in light fastness in a low-density area as compared with that obtained by using the comparative dye not having such an atomic grouping.

While the invention has been described in detail and with reference to specific embodiments thereof, it will be apparent to one skilled in the art that various changes and modifications can be made therein without departing from the spirit and scope thereof.

What is claimed is:

1. A thermal transfer dye donating material comprising a support having thereon a dye donating layer which contains a thermo-mobile dye, wherein said thermo-mobile dye is an azo dye represented by at least one of formulae (XXVI)-A, (XXVII)-A, (XXXII)-A and (XXXIII)-A:

(XXVI)-A

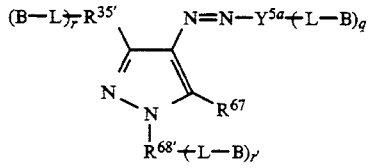

(XXVII)-A

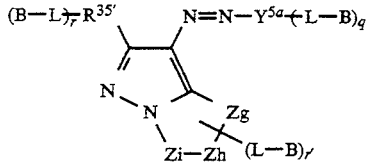

(XXXII)-A

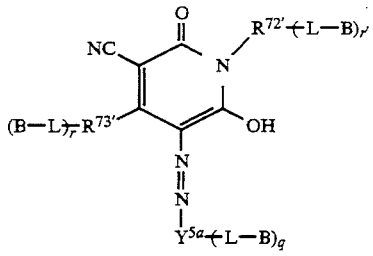

(XXXIII)-A

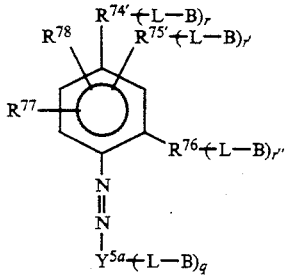

wherein q, r, r' and r'' are each 0 or 1; the sum of q, r, r' and r'' is 1 or 2; when q, r, r' or r'' is 0, then —(L—B) represents a hydrogen atom or a halogen atom;

B represents a structure represented by one of formulae (IV)-A-α, (IV)-A-β, (IV)-β-α, (IV)-B-β, IV-A-γ and (IV)-A-δ:

(IV)-A-α

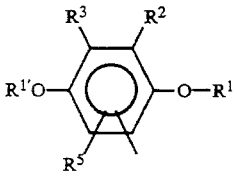

-continued (IV)-A-β

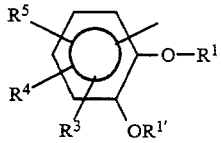

(IV)-B-α

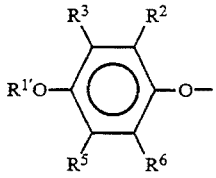

(IV)-B-β

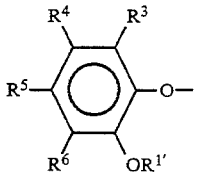

(IV)-A-γ

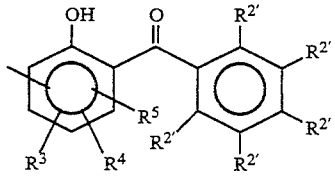

(IV)-A-δ

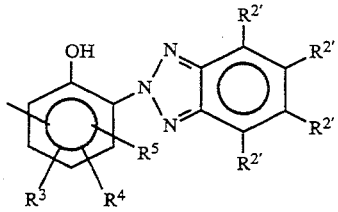

wherein $R^1$ represents a hydrogen atom, an alkyl group, an alkenyl group, an aryl group, a heterocyclic group, a silyl group or a phosphino group; and $R^2$, $R^3$, $R^4$, $R^5$, $R^6$ and $R^{2'}$ each represents a hydrogen atom or a non-metal substituent group;

L represents a divalent linking group represented by one of formulae (L-I), (L-II), (L-III), (L-IV), (L-V), (L-VI) and (L-VII):

(L-I)

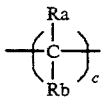

(L-II)

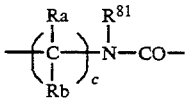

(L-III)

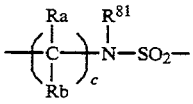

(L-IV)

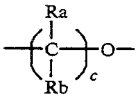

-continued

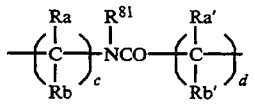

(L-V)

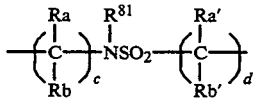

(L-VI)

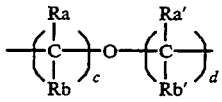

(L-VII)

wherein Ra, Rb, Ra′ and Rb′ each represents a hydrogen atom, an alkyl group, an aryl group, a halogen atom, an alkoxy group, an aryloxy group, an acylamino group or an acyloxy group;

c and d each represents a positive integer; and $R^{81}$ represents a hydrogen atom, an alkyl group or an aryl group;

$R^{67}$ represents an OH group or

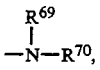

wherein $R^{69}$ and $R^{70}$ each represents a hydrogen atom, an alkyl group or an aryl group;

$R^{76}$, $R^{77}$ and $R^{78}$ each represents a hydrogen atom or a non-metal substituent group;

in formula (XXVI)-A and (XXVII)-A, $R^{35'}$ represents a divalent structure of a non-metal substituent group, from which one hydrogen atom has been eliminated; $R^{68'}$ represents a divalent structure of an alkyl group or an aryl group, from which one hydrogen atom has been eliminated; $Y^{5a}$ represents a divalent structure of an aryl group or a heteryl group, from which one hydrogen atom has been eliminated; and Zg, Zh and Zi each represents —N= or —C($R^{71}$)=, wherein $R^{71}$ represents a hydrogen atom or a non-metallic atomic group;

in formula (XXXII)-A, $R^{72'}$ represents a divalent structure of an alkyl group or an aryl group, from which one hydrogen atom has been eliminated; $R^{73'}$ represents a divalent structure of a non-metal substituent group, from which one hydrogen has been eliminated; and $Y^{5a}$ represents a divalent structure of an aryl group or a heteryl group, from which one hydrogen atom has been eliminated; and in formula (XXXIII)-A, $R^{74'}$ and $R^{75'}$ each represents a divalent structure of a non-metal substituent group, from which one hydrogen atom has been eliminated; and $Y^{5a}$ represents a divalent structure of an aryl group or a heteryl group, from which one hydrogen has been eliminated.

2. The thermal transfer dye donating material of claim 1, wherein B is represented by formula (IV)-B-α.

3. The thermal transfer dye donating material of claim 1, wherein said thermo-mobile dye is an azo dye represented by formula (XXVII)-A.

* * * * *